US008702085B2

(12) United States Patent
Carter et al.

(10) Patent No.: US 8,702,085 B2
(45) Date of Patent: Apr. 22, 2014

(54) NOTEPAD FORMING METHOD AND APPARATUS THEREFOR

(75) Inventors: Ashley Craige Carter, Caringbah (AU); Rohan Tilak Liyanaratchi, Brunswick (AU)

(73) Assignee: Ra Corporation Pty Ltd, Caringbah (AU)

( * ) Notice: Subject to any disclaimer, the term of this patent is extended or adjusted under 35 U.S.C. 154(b) by 118 days.

(21) Appl. No.: 12/863,358

(22) PCT Filed: Jan. 16, 2009

(86) PCT No.: PCT/AU2009/000046

§ 371 (c)(1),
(2), (4) Date: Jan. 21, 2011

(87) PCT Pub. No.: WO2009/089586

PCT Pub. Date: Jul. 23, 2009

(65) Prior Publication Data

US 2011/0110749 A1 May 12, 2011

(30) Foreign Application Priority Data

Jan. 17, 2008 (AU) ..... 2008900220
Jul. 17, 2008 (AU) ..... 2008903669

(51) Int. Cl.
*B42B 9/02* (2006.01)

(52) U.S. Cl.
USPC ..... 270/58.07; 270/52.17; 270/52.18; 412/8; 412/33

(58) Field of Classification Search
USPC ..... 270/58.07, 52.09, 52.17, 52.18; 156/250, 256; 412/8, 16, 33, 37
See application file for complete search history.

(56) References Cited

U.S. PATENT DOCUMENTS 3,709,595 A * 1/1973 Turner et al. ..... 399/410
4,406,247 A * 9/1983 Baughman et al. ..... 118/684

(Continued)

FOREIGN PATENT DOCUMENTS

WO 94/11202 A1 5/1994
WO 96/05065 A1 2/1996

(Continued)

OTHER PUBLICATIONS

International Search Report issued in connection with corresponding International Application PCT/AU2009/000046 on Apr. 20, 2009.

*Primary Examiner* — Patrick Mackey
(74) *Attorney, Agent, or Firm* — The H.T. Than Law Group

(57) ABSTRACT

Theres is disclosed a device (10) for manufacturing a notepad (15) comprising a stack of sheets, a first side of each sheet having an adhesive to attach the first side to a reverse face of a sheet immediately facing said first side in said stack. The device (10) including a sheet feeder (20) for loading one or more loose sheets (24) of similar dimensions with the reverse face of each sheet (24) in said stack facing in the same direction and feeding each said sheet downstream of said device (10). A cutting means (40) is provided to cut each sheet (24) or a number of said sheets (24) to predetermined dimensions. An adhesive applicator (60) applies adhesive to a portion or portions of the first side of each sheet (24). A stacking means (100) stacks the cut sheets one on top of the other whereby a forming means (120) forms the cut sheets together to form the notepad (15).

19 Claims, 56 Drawing Sheets

(56) References Cited

U.S. PATENT DOCUMENTS

| | | | | | |
|---|---|---|---|---|---|
| 4,473,425 | A | * | 9/1984 | Baughman et al. | 156/356 |
| 4,537,650 | A | * | 8/1985 | Coons, Jr. | 156/384 |
| 4,611,741 | A | * | 9/1986 | Wilson | 227/99 |
| 5,172,238 | A | * | 12/1992 | Kuboki | 358/296 |
| 5,601,389 | A | * | 2/1997 | Minami | 412/14 |
| 5,863,372 | A | * | 1/1999 | Fabel | 156/277 |
| 6,286,871 | B1 | | 9/2001 | Spector et al. | |
| 6,485,606 | B2 | * | 11/2002 | Boss | 156/583.1 |
| 6,978,990 | B2 | * | 12/2005 | Silverbrook | 270/58.07 |
| 7,152,860 | B2 | * | 12/2006 | Silverbrook | 271/207 |
| 7,172,672 | B2 | * | 2/2007 | Silverbrook | 156/277 |

FOREIGN PATENT DOCUMENTS

| | | | |
|---|---|---|---|
| WO | 98/15413 | A1 | 4/1998 |
| WO | 02/070274 | A1 | 9/2002 |

* cited by examiner

NOTEPAD FORMING METHOD AND APPARATUS THEREFOR

CROSS-REFERENCE TO RELATED APPLICATIONS

This application claims priority to international patent application no. PCT/AU2009/000046 filed on Jan. 16, 2009 and to Australian patent application nos. AU 2008900220 filed on Jan. 17, 2008 and AU 2008903669 filed on Jul. 17, 2008. The disclosures of these applications are incorporated herein by reference in their entireties.

FIELD OF INVENTION

The present invention relates to a notepad forming apparatus and method, more particularly, the present invention relates to a method and apparatus for forming a notepad that receives and processes individual sheets of fibrous material in a desktop environment.

BACKGROUND OF THE INVENTION

Notepads generally comprise multiple sheets of fibrous material, such as paper, formed together into a pad by attaching the sheets together along a common edge. Each of the individual sheets are then able to be used by a user for a variety of purposes and can be readily detached or separated from the pad of sheets where required. The size of the notepad and the sheets contained therein may vary depending upon the specific use of the notepad.

In the formation and manufacture of documents, such as notepads, individual, sheets or pages of the document are typically processed by a production line or facility. The sheets are typically initially fed into the production line where they are transported to a collation device that firstly collates the sheets into an ordered stack. The ordered stack of sheets are then transported to a cropping or cutting station that typically crops or cuts the sheets into the desired size. The cropped sheets are then delivered to a binding station where they are bound together along a common edge to form a volume of sheets. Depending upon the nature of the document or notepad, the volume of sheets may be further processed, such as by covering or the like, for distribution and sale. It will be appreciated that the cutting steps and the binding steps may be performed in any order.

Traditional document binding processes vary depending upon the final desired form of the document. Mechanical binding means, typically involve the use of a mechanical means, such as a wire or plastic coil, which is threaded through a plurality of perforations formed along a common edge of the sheets of the document. The coil acts to retain the individual sheets together in an ordered manner. In other forms, chemical binding means, such as adhesives, may be employed to bind the pages of a document together. Following collation of individual pages into a stack and cropping the stack, an applicator is typically employed to apply a layer of binding adhesive along an edge of the stack of pages. A press may also be employed by the production line to apply a pressing force to the edge of the stack of sheets to facilitate a bond between the adjacent sheets.

It will be appreciated that such traditional processes of forming a document, such as a notepad, require a dedicated manufacturing facility comprising a number of distinct stations provided along the production line for performing separate tasks associated with processing individual sheets and binding them into a finished document. Such assembly lines do not easily and economically provide for manufacturing documents in small runs or batches, and do not readily provide for simple customization of the manufactured document to variable sizes and the like.

One particular type of notepad that is in common use is the Post-It™ note pads that are marketed under the trademark "Post-it" by Minnesota Mining and Manufacturing Company, St. Paul, Minn. These notepads typically comprise varying sized stacks or sheets of paper joined along a common edge by adhesive. The notepad comprises a stack of sheets of paper, each haying a narrow strip or band of generally low-tack, pressure-sensitive adhesive aligned along an edge on its rear side by which the sheets can, be temporarily adhered together. The sheets can be separated from the stack by breaking the low-tack adhesive bond between that sheet and an adjacent sheet in the stack such that the separated sheet can be further adhered to substrates such as documents, computer screens or other articles, generally for leaving a message or reminder. The strip of adhesive allows the sheets to be adhered together in the stack, and when a sheet is removed from the stack, the adhesive remains in position to enable the sheet to be further adhered to another surface. Such notepads are typically made from clean sheets of paper to enable a user to write on or otherwise use the sheet, whereby it can be repositioned. It will be appreciated that the manufacture of such sheets also comprises a dedicated assembly line to process the sheets and bond the individual sheets together.

Thus, there is a need to provide a method and device for forming a notepad in a home, work or office environment that can be performed simply and economically by a dedicated unit that provides customization by the user specific to their own needs.

Further, it is well established that offices and homes throughout the world generate masses of paper where the sheets are printed on only one side. Best office practice may include re-using the clean or reverse side of the sheet as rough note paper or, where a printer or photocopier can reuse second hand paper by printing on the reverse side without jamming, re-using the paper in such machines. One-sided paper may otherwise be shredded for pulping and recycling as cardboard, newspaper, toilet paper, recycled office paper or paper toweling. However, such recycling, although useful to preserve wood resources and preferred to delivering one-sided paper to landfill, may be energy intensive and environmentally undesirable.

Thus, there is also a need to provide a method and device for forming a notepad in a home, work or office environment that can process one-sided paper generated in the home, work or office environment to form notepads that can utilise the clean or reverse side of the sheet for further use.

The above references to and descriptions of prior proposals or products are not intended to be, and are not to be construed as, statements or admissions of common general knowledge in the art. In particular, the following prior art discussion does not relate to what is commonly or well known by the person skilled in the art, but assists in the understanding of the inventive step of the present invention of which the identification of pertinent prior art proposals is but one part.

STATEMENT OF INVENTION

Accordingly, in one aspect of the invention there is provided a method of manufacturing a notepad comprising a stack of sheets, a first side of each sheet having an adhesive to attach said first side to the reverse face of the sheet immediately facing it in said stack, said method including the steps of:

loading loose sheets or similar dimensions into a sheet feeder with the reverse face of each sheet in said stack facing in the same direction;

feeding each sheet into a device;

cutting each sheet or a number of said sheets to form cut sheets of predetermined dimensions;

applying said adhesive to a portion or portions of said first side of each sheet;

stacking said cut sheets; and forming said cut sheets together to form said notepad.

The step of forming the sheets together may comprise a step of pressing the sheets together where the sheets are adhered together by way of a pressure sensitive, repositionable adhesive.

In another aspect, the invention provides a notepad made from a stack of sheets, a first side of each sheet having an adhesive to attach said first side to the reverse face of the sheet immediately facing it in said stack, said sheets being loose sheets of similar dimensions, each sheet cut to predetermined dimensions, said adhesive applied to a portion or portions of said first side of each sheet and said cut sheets pressed together to form said notepad.

In still another aspect, the invention provides a device for manufacturing a notepad comprising a stack of said sheets, a first side of each sheet having an adhesive to attach said first side to the reverse face of the sheet immediately facing it in said stack, said device including:

a sheet feeder for loading a stack of loose sheets of similar dimensions with the reverse face of each sheet in said stack facing in the same direction and feeding each said sheet downstream of said device;

cutting means to cut each sheet or a number of said sheets to predetermined dimensions;

adhesive applicator to apply said adhesive to a portion or portions of said first side of each sheet;

stacking means to stack said cut sheets one on top of the other; and forming means to press said cut sheets together to form said notepad.

In yet another aspect, the invention provides a method of manufacturing a notepad from office paper, said notepad comprising a stack of said sheets, a first side of each sheet having an adhesive to attach said first side to the reverse race of the sheet immediately facing it in said stack, said method including the steps of:

loading loose office paper of similar dimensions into a paper feeder;

feeding each sheet of office paper into a device;

cutting each sheet or a number of said sheets of said office paper into cut sheets of predetermined dimensions;

applying said adhesive to a portion or portions of said first side of each cut sheet;

stacking said cut sheets; and pressing said cut sheets together to form said notepad.

The sheets may be made from any suitable material to which indicia may be applied, for example by printing or inscribing thereon. The sheets may be made from suitable polymeric material, from cellulosic material such as paper, or a combination or blend thereof. The sheets may be paper sheets the sheets may be used or unused, recycled or virgin. The sheets may be pre-used sheets on which one side has had indicia printed thereon. The sheets may be re-used office paper. The loose sheets are preferably of uniform dimensions. However, the device may be adjustable to accommodate loose stacks of sheets of different dimensions.

The notepad may comprise a plurality of sheets of fibrous material grouped together. The purpose of the notepad may be for writing on, or may include pre-printed material such as photographs or information, that can be used for a variety of purpose such as advertising or decoration. In one form, the notepad preferably comprises a stack of sheets derived from office paper whereby the plan dimensions of the notepad are smaller than the plan dimensions of an office sheet or paper. Typically, the different dimensions of an office sheet of paper will correspond to that of A4, letter, legal, executive and other standard office paper sizes.

The notepad formed by the present invention may assume a variety of different sizes in one form the notepad may have a size equivalent to standard A3, foolscap, A4, letter, legal, executive and other standard office paper sizes. In another form the notepad may have dimensions of between 20 100 mm*20 100 mm and may be rectangular or square in con figuration. In a preferred form the notepad may have a substantially square configuration of 75 mm*75 turn another form the notepad may have a substantially rectangular dimension of 40 mm*50 mm. It will be appreciated that the dimensions of the notepad may vary depending upon the needs of the user of the present invention.

In determining which face of a sheet will be the first side and which will be the reverse face, this may be decided by an operator. Where the sheets are pre-printed with specifically intended printed material, then the non-printed side may be the first side to which adhesive is to be applied. If the sheet is pre-used with unwanted inscriptions or printed matter, this side may be the first side and the other (presumably clean) face will be the reverse face. Where the sheet is virgin and both faces are clean, the operator may determine which side, if any, is preferred as the first (adhesive receiving) side. Typically, the first side will face downwards and the reverse face will face upwards; although alternative arrangements are fully within the scope of the invention.

The adhesive may be a re-positional adhesive. The re-positional adhesive may be a low tack or pressure-sensitive adhesive such as that used in the 3M Post-It™ notepad product referred to above. However, other low-tack adhesives are contemplated as being within the scope of the present invention.

Alternatively, the adhesive may be a high strength, permanent glue and the portion bearing the adhesive may be separated from the rest of the cut sheet by a weakened line, for example, a perforated line. The printable, printed, inscribed or inscribable section of the cut sheet may therefore be removed by tearing along the weakened line for use as a non-adhesive bearing sheet.

The device of the present invention may be a stand alone device or may be incorporated in any one of a range of office equipment, such as a printer, photocopier, scanner, fax machine, multifunction device or the like.

The sheets are preferably shifted from one zone to another within the device by means of a combination of driven and free wheeling rollers. The driven rollers may be rubber-surfaced to provide suitable grip to the sheet surface. The rollers may be driven by one or more stepper motors. Each driven roller may be separately driven by a separate stepper motor. The positioning and movement of the sheets may be detected and controlled by photosensitive means feeding back sheet position data to the drive motors, all of which is preferably controlled by a central processing unit (CPU). The photosensitive means may be in the form of photodiodes. The photosensitive means may be in the form of one or more linear photodiode arrays. For example, if the fed sheet is skewed, the photosensitive means may detect the mal-aligned sheet and feedback the CPU. The CPU may then command roller drive motor to adjust its rate by speeding up or slowing down to effect a correction in the alignment of the sheet.

The cutting means that may be a static knife or blade suitably positioned to cut the sheet as it proceeds through a cutting zone. The cutting means may be in the form of a guillotine that periodically drops to effect a cut in the sheet at predetermined intervals. The cutting means may include any other suitable cutting device, and includes non-physical devices such as laser or hot melt devices which may be suitable for polymeric sheet material. Of course, the various operations in the series of processes performed by the notepad forming device can be interchanged and varied in order or performed simultaneously, depending on their nature. For example, the transverse cutting process may be performed before or alter the longitudinal cutting operation, or at the same time (for example by a punch or stamp knife with longitudinal and transverse blades). Irregular cuts using stamp knifes or arrays of knives may thus be performed to produce novelty shape pads, such as geometric, animal, building or vehicle shapes. For office applications, the typical shaped pad produced will be rectangular, including square.

The adhesive applicator includes any suitable means for applying a layer, strip or band of adhesive material to a portion or portions of the sheet surface. Where the adhesive is applied in portions, the portions May be randomly or regularly spaced. The adhesive applicator may include a reciprocating stamp means, a roller with an adhesive application zone on its surface, optionally protruding therefrom or may involve the use of adhesive transfer tape applied by driven or free-wheeling rollers. The adhesive applicator may include an adhesive storage vessel with one or more applicators. The applicator(s) may be, for example, located on a drum or may be mounted on a reciprocating frame. The applicator(s) may inter alia include brush material, tabs, glue absorbent stubs or non-absorbent stubs.

The cutting means may include a support guide and rollers to stiffen the sheet preparatory to cutting.

The stacking means may include any suitable device adapted to collect cut sheets of similar dimensions and to order their stacking, one on top of the other. The stacking means preferably ensures that the respective adhesive-beating surfaces of the cut sheets are facing in the same direction and that the edges of the sheets in the stack are aligned in registration with one another.

The pressing means may include a plunger. The plunger may move relative to the stacking means. That is, in one embodiment, the plunger may be stationary and the stacking means may be movable relative thereto. The plunger may push up or press down on the stacked cut sheets against an upper or lower panel in the stacking means whereby to enable the cut sheets to be pressed together to form the notepad.

In still yet another aspect, the present invention provides an adhesive applicator cartridge for a sheet processing device including:

a body mountable to the sheet processing device so as to be positioned adjacent a sheet being processed by said sheet processing device, said body having:

an adhesive receptacle for receiving a supply of adhesive; and an adhesive applicator for applying said adhesive to a surface of the sheet being processed by said device.

In one embodiment of this aspect of the invention, the body is mountable within a recess provided in the sheet processing device, in one farm, the sheet processing device may be a sheet binding device for binding together sheets into a bound volume. In another form, the sheet binding device may be a notepad forming device as described in relation to any of the above described aspects of the invention.

In a first embodiment, the adhesive receptacle is a bore formed in the body. A tubular cylinder may be provided within the bore to receive the adhesive therein. The adhesive may be in the form of an adhesive stick having a shape that conforms to the cylinder such that the adhesive stick is inserted into the cylinder and retained therein. A cap may be provided on an end of the cylinder to seal an end of the adhesive stick.

The adhesive applicator may be an open end of the cylinder through which an exposed end of the stick of adhesive projects. The exposed end of the stick of adhesive may be directed to contact the surface of the sheet being processed by the device to apply adhesive thereto as the sheet is being transported by the device. The body may be pivotally mounted to the sheet processing device and be movable between an idle position, wherein the exposed end of the stick of adhesive is positioned remote from the sheet being transported by the device, and an application position wherein the exposed end of the stick of adhesive is positioned in contact with the sheet being transported by the device.

The body may include a control mechanism to control longitudinal movement of the stick of adhesive within the cylinder. The control mechanism may be configured to advance the stick of adhesive as it is consumed during use, to ensure that the end of the stick of adhesive projects from the open end of the cylinder.

In a second embodiment, the adhesive receptacle may be a storage reservoir for receiving a volume of liquid adhesive. The storage reservoir may be provided within the body and have an inlet to facilitate filling of the storage reservoir with liquid adhesive. The inlet may be sealed by a removable cap, The adhesive applicator may be mounted at a lower end of the body so as to be in fluid communication with the liquid adhesive contained within reservoir. The adhesive applicator may include a ball or roller member secured within an outlet of the storage reservoir. The ball or roller member may project at least partially from the outlet to contact the sheet being processed by the device to apply adhesive thereto as the sheet is being transported by the device. The body may be pivotally mounted to the sheet processing device and be movable between an idle position, wherein the ball or roller member is positioned remote from the sheet being transported by the device, and an application position wherein the ball or roller member is positioned in contact with the sheet being transported by the device.

In a third embodiment of the present invention, the adhesive receptacle is a bore formed in the body. A tubular cylinder may be provided within the bore to receive the adhesive therein. The adhesive may be in the form of an adhesive stick having a shape that conforms to the cylinder such that the adhesive stick is inserted into the cylinder and retained therein. The tubular cylinder may be configured such that the adhesive stick projects from an open end thereof to be in contact with the adhesive applicator. A cap may be provided on the other end of the cylinder to seal an end of the adhesive stick.

The adhesive applicator may be a roller mounted adjacent the open end of the cylinder. The roller may be substantially cylindrical and may be free to rotate about its central axis. The roller is mounted between a pair of arms extending from the body such that it extends substantially across the open end of the cylinder to be in contact with the stick of adhesive. A control mechanism may be provided to control advancement of the stick of adhesive within the cylinder.

In a fourth embodiment of the present invention, the body is the adhesive receptacle and receives the adhesive in the limn of an adhesive tape. The body may have an open portion formed adjacent the sheet being processed by the device. The adhesive tape may be mounted within the body and wound around an internal perimeter of the body such that it extends across the open portion of the body.

In this embodiment, the adhesive applicator is a stamp member mounted within the body. The stamp member may be actuable to extend from the open portion of the body to contact a surface of the sheet being processed by the device as the sheet is being transported past the body. Upon actuation of the stamp member, the stamp member may contact the adhesive tape extending, across the open portion of the body, thereby causing the adhesive tape to contact the surface of the passing sheet to facilitate transfer of adhesive present on the tape to the surface of the sheet.

In each of the above embodiments, the adhesive may be a low-tack or pressure sensitive adhesive. In an alternative embodiment, the adhesive may high strength or permanent adhesive.

The sheets being processed by the sheet processing device may be sheets of paper or other print media. The sheets may be printed on one or both sides, or may be previously used sheets of paper. In another form, the sheets may be made from cardboard or from a polymeric material.

In each of the above embodiments, the body may be removable from the sheet processing device to facilitate replacement of the adhesive applicator cartridge, and/or replenishment of the supply of adhesive.

BRIEF DESCRIPTION OF THE DRAWINGS

Preferred features of the present invention will now be described with particular reference to the accompanying drawings. However, it is to be understood that the features illustrated in and described with reference to the drawings are not to be construed as limiting on the scope of the invention. In the drawings:

FIG. 1*i* is a schematic side view of a notepad forming device including a sticker applicator;

DETAILED DESCRIPTION OF THE DRAWINGS

Figure 1:
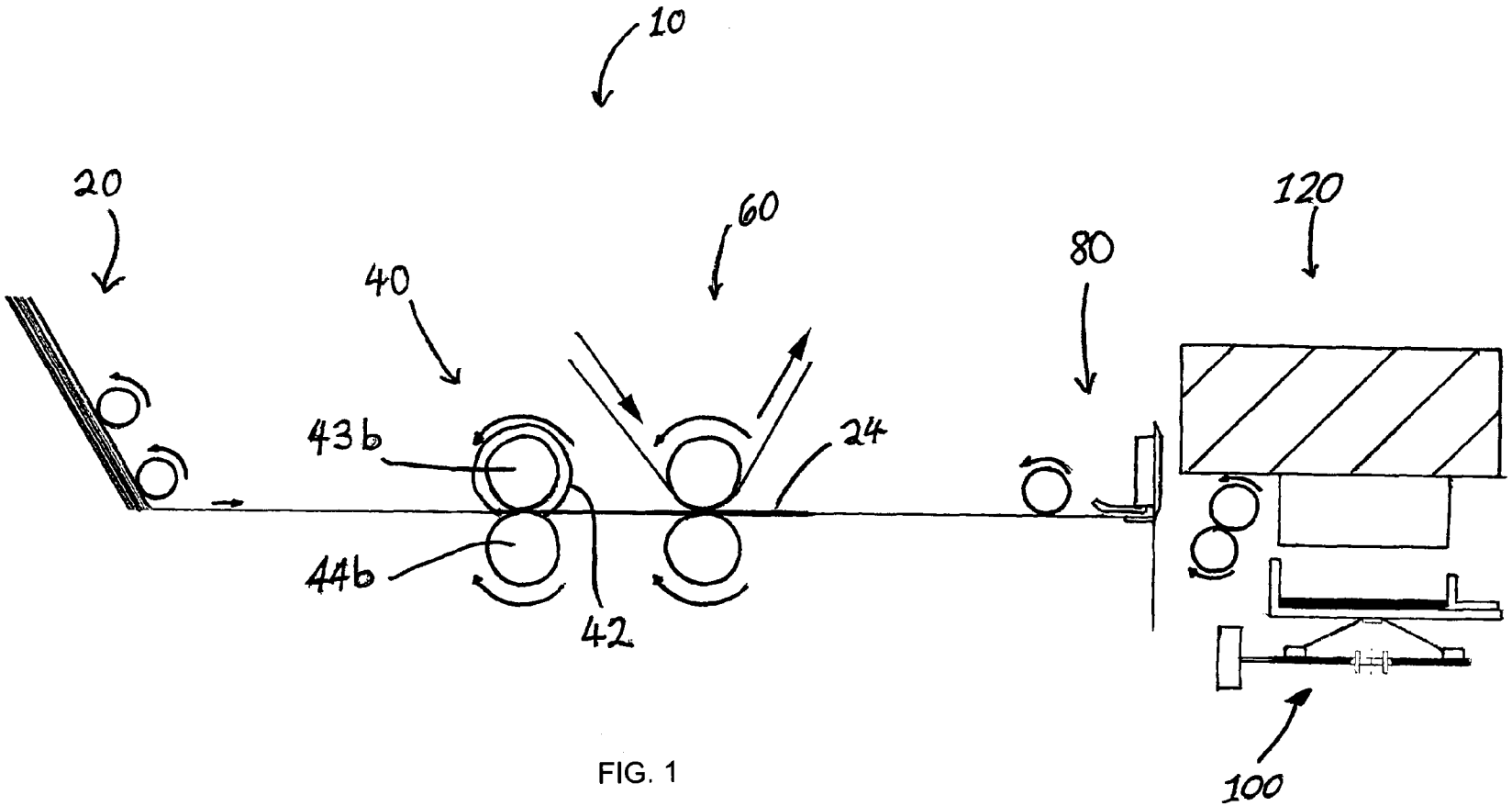
FIG. 1 is a schematic side view of the device according to a preferred embodiment of the invention.

Referring to the drawings, where possible like components are referred to using like reference numerals.

The present invention will be described below in relation to its application for use in the formation of a notepad. However, it will be appreciated that the present invention may be equally employed in the formation of a variety of different types of documents and other products that comprise a plurality of sheets of fibrous material, such as paper, grouped together. Further, the notepads referred to in the present application may be employed for use in a variety of differing applications, other than for writing or making notes. In this regard, the notepads of the present invention need not be for writing on, but may be prior printed with material such that they can be used as advertising products, or as photo pads. It will be appreciated by those skilled in the art that throughout the present application the term "notepad" will be assumed to broadly mean any form of document comprising a plurality of sheets of fibrous material grouped together.

Referring firstly to FIG. 1, there is shown a notepad forming device 10 comprising a feeder mechanism 20, alignment correction means 30 (refer to FIG. 3), longitudinal cutting means 40, adhesive applicator 60, lateral cutting means 80, stacking means 100 and forming means 120. In a preferred form, the loaning means 120 is a pressing means, particularly where the adhesive used by the adhesive applicator 60 is a pressure sensitive adhesive.

Figure 1A:
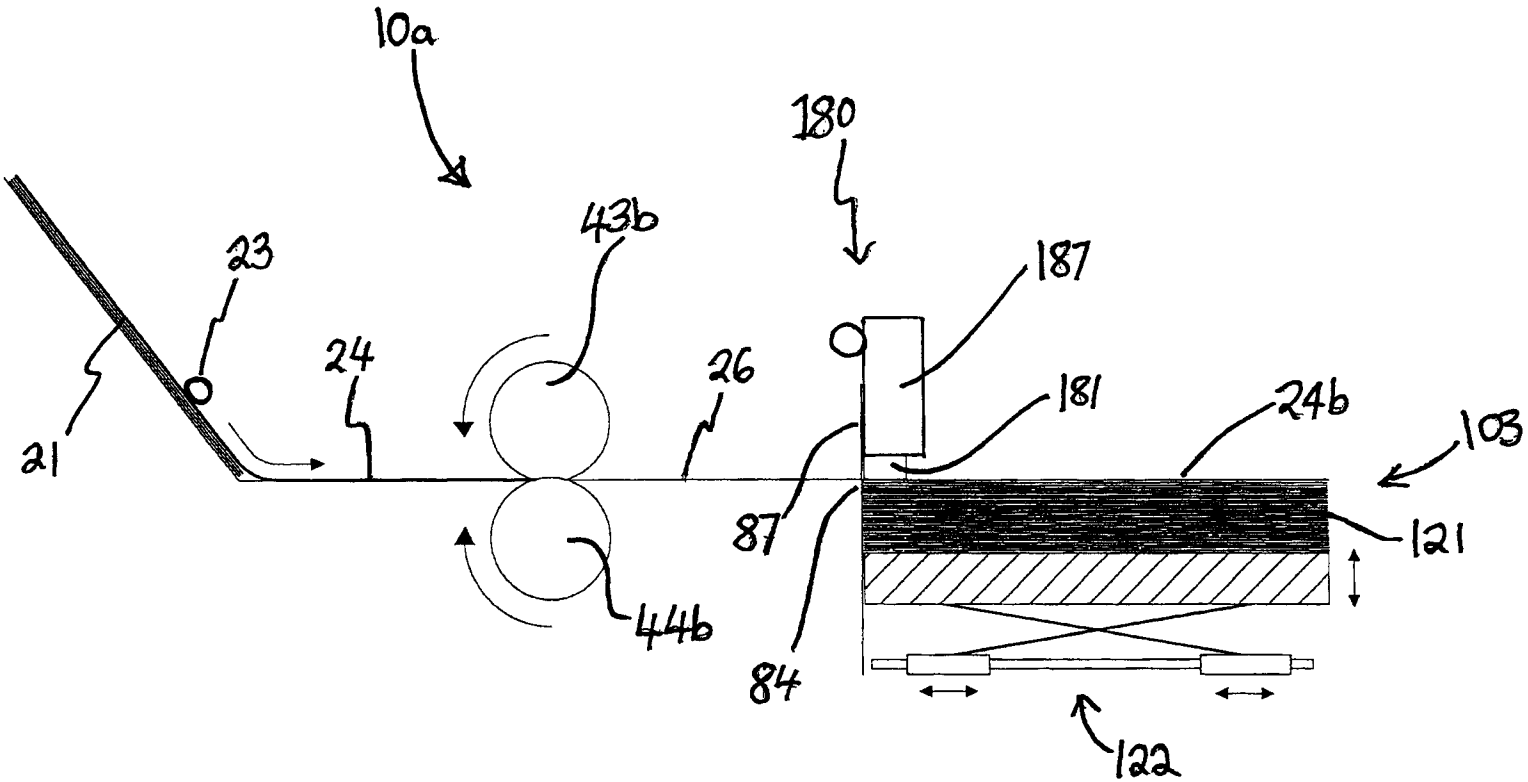
FIG. 1*a* is a schematic side view of a notepad forming device according to another embodiment of the invention.

Referring to FIG. 1*a*, in a paper processing device 10*a*, a paper sheet 24 is moved and controlled through the use of feeder rollers 23 onto the planar panel or main body 26. A shearing cutting wheel 43*h* is located substantially above the planar panel. The shearing cutting wheel 43*b* has a cutting edge penetrating the paper 24 through the plane of the upper surface of the planar panel 26. The cutting wheel 43*b* is mounted for rotation about an axis above the planar panel 26, parallel to the planar panel upper surface and normal to the direction of travel of the paper 24. The cutting wheel 43*b* counter rotates with a complimentary shearing edge wheel 44*b* located substantially below the planar panel 26. The shearing action of wheels 43*b*, 44*b* creates one or more longitudinal slits in the paper 24, whereby to determine the width of longitudinally cut paper 24*b*. In this specification, reference to longitudinal means in the direction of travel of the sheet 24 over the planar panel 26, whereas transverse or lateral means across the line of travel of the paper 24.

The paper 24 may then be cut transversely to a predetermined length by a transverse cutting module including a transverse cutting wheel 80 mounted on a rail/linear bearing 187. Of course, the various operations in the series of processes performed by the devices 10-10*f* can be interchanged and varied in order or, performed simultaneously, depending on their nature. However, typically the preferred order of cutting will be longitudinal as the sheet 24 is conveyed from the feeder mechanism 20 to the stacking mechanism 120, followed directly or indirectly by transverse cutting. The adhesive, printing or indicia stamping operations, particularly where the operation applies something to the paper 24 parallel to the direction of paper 24 travel, are preferably performed as the paper 24 travels over the panel 26.

The transverse cutting module 180 may include a cutting wheel 87 and a shearing edge 84. The transverse cutting module 180 also includes an adhesive tape applicator 181 whereby adhesive is applied to each sheet of cut paper 24*b*. The paper 24*b* is stacked on a retractable shelf 103 that linearly vertically reciprocates by the operation of a scissor lift 122. Each time that the roller 181 for the tape/glue passes over the stack 121 of cut paper 24*b*, the retractable shelf 103 compresses the stack 121 and the cut sheets 24*b* are glued together.

Figure 1B:
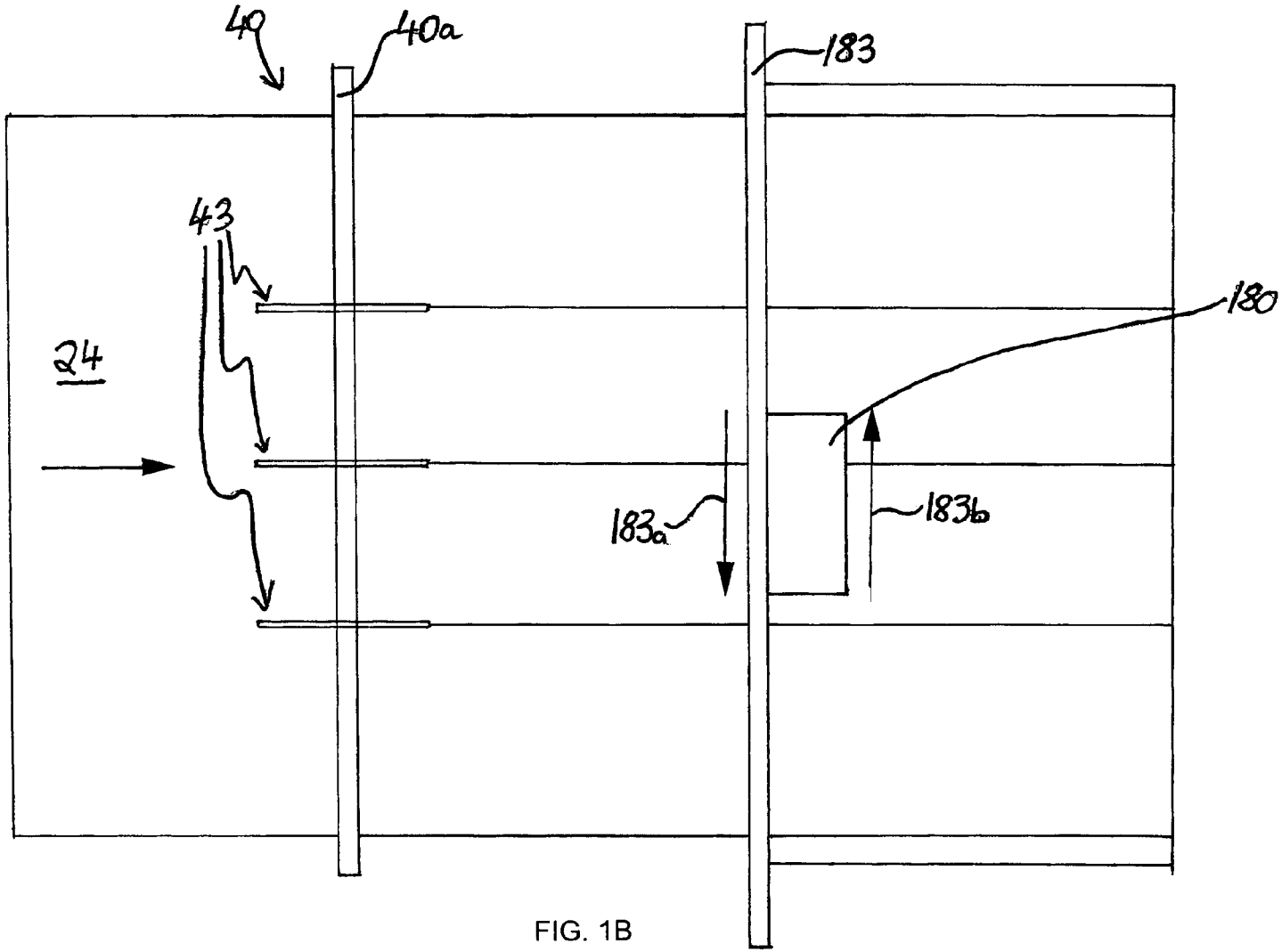
FIG. 1*b* is a schematic top plan view of the notepad forming device shown in FIG. 1*a;*

FIG. 1*b* shows part of the arrangement of FIG. 1*a* in plan view. The sheet of paper 24 is fed from the feeder mechanism 20 (not shown) through to the longitudinal cutting means 40 comprising a triplet of longitudinal cutting wheels 43. The longitudinal cutting wheels 43 may be variously spaced along a single shall 40*a*, but are preferably equispaced. Multiple, optionally employable, shafts that are vertically retractable may be employed to effect a variety of longitudinal slit combinations. The transverse cutting-adhesive transfer tape head 180 is shown mounted on a linear rail 183 and is mounted for reciprocal linear motion along the rail 183 as indicated by the arrows 183*a,b*.

Figure 1C:
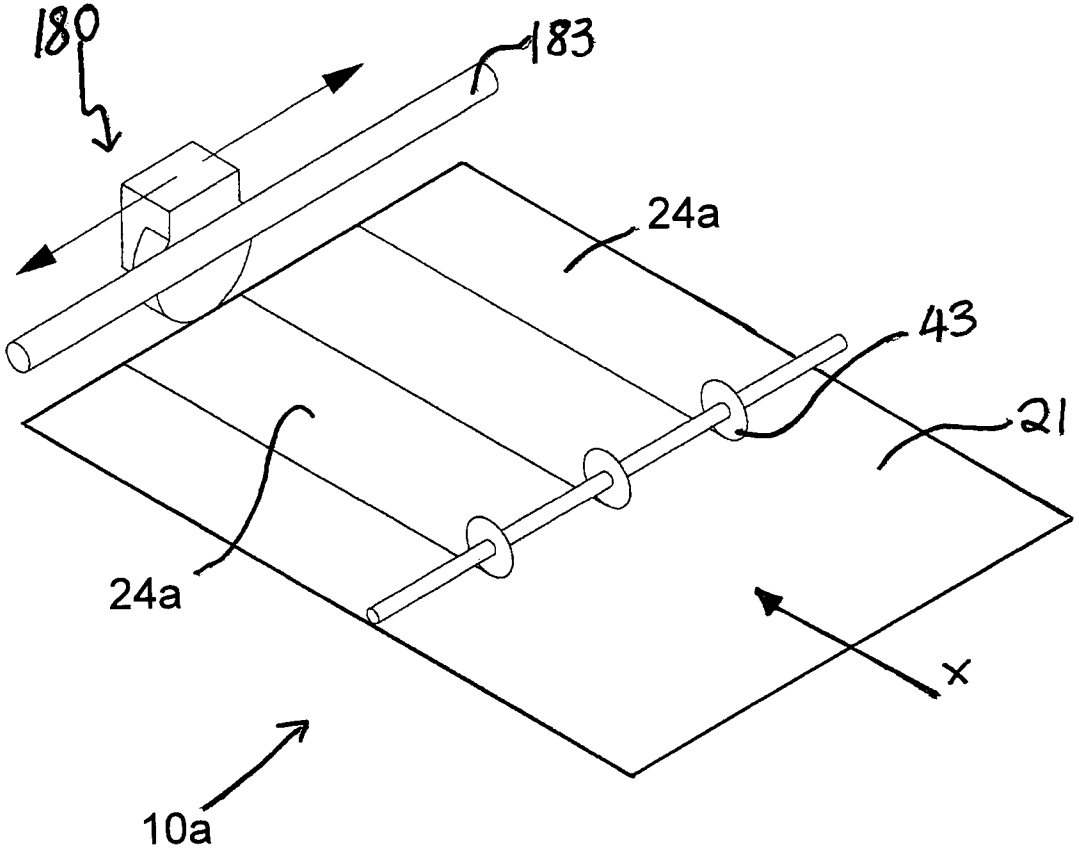
FIG. 1*c* is a schematic perspective view of the arrangement shown in FIG. 1*c;*

FIG. 1*c* is a perspective view of the device 10*a* shown in FIGS. 1*a, b* and schematically shows the paper 24 fed in direction x. The paper 24 is longitudinally cut by the longitudinal cutting wheels 43 to produce four (4) strips of paper 24*a* or equal width. The four strips 24*a* are transversely cut by the transverse cutting wheel 180 reciprocally travelling along the rail 183.

Figure 1D:
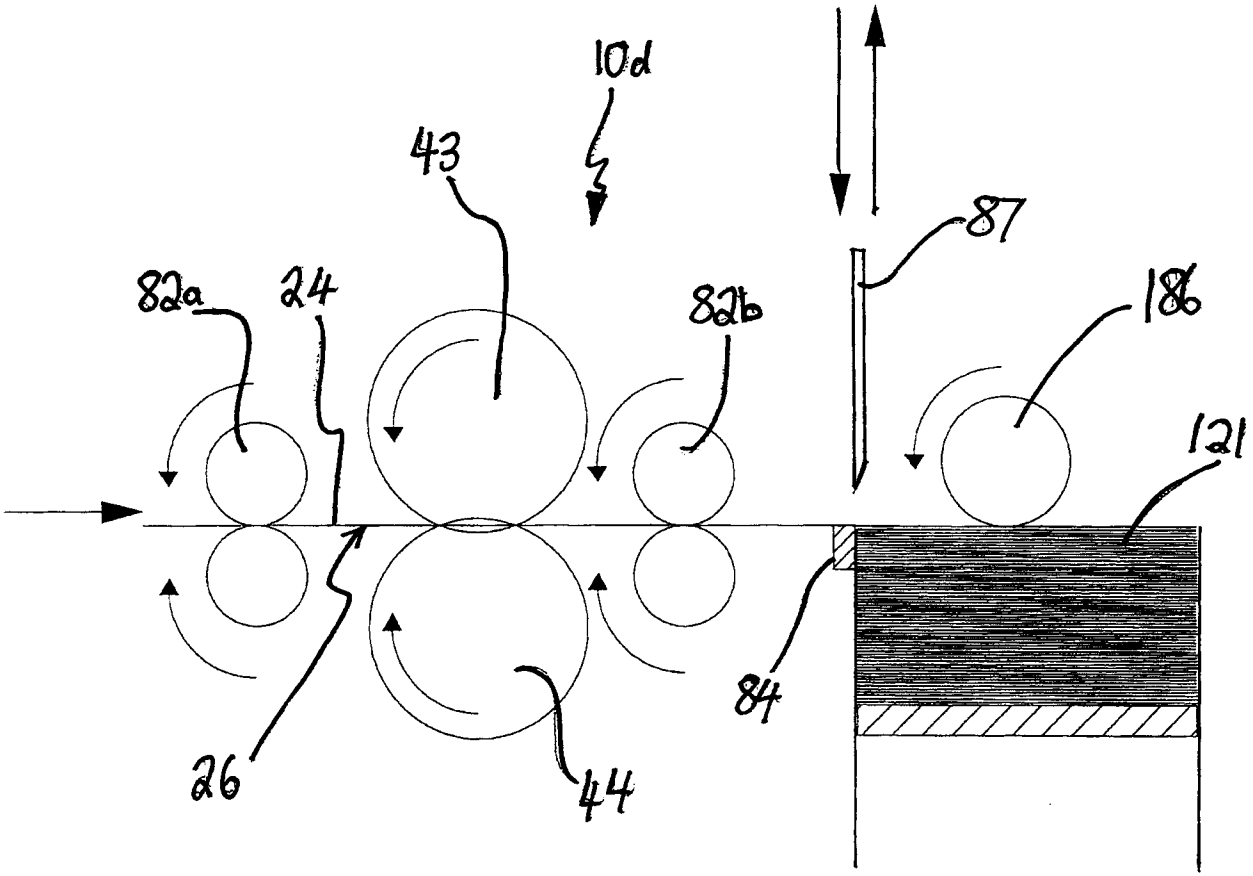
FIG. 1*d* is a schematic side view of a cutting and stacking means according to another embodiment of the invention.

In FIG. 1*d*, a paper processing device 10*d* provides a series of pairs of counter rotating rollers 82*a,b* operable to hold the sheet 24 firmly against the panel/body. 26 and under tension to achieve a clean, linear, longitudinal cut by the longitudinal cutting wheel 43 counter rotated against a complimentary shearing edge wheel 44. The paper 21 is then cut again by a transverse blade 87 cutting against a shearing edge 84 and then fed onto a stack 121 and compressed by another roller 186. Adhesive paper or glue may be applied before, during or after the longitudinal cut elected by the wheels 43, 44.

In FIG. 1*c*, a device 10*ba* having a different type of feeder mechanism 220 is shown comprising a horizontal stack feeder 221. Paper 24 is picked up of the stack 21 by a roller 23 and fed through the apparatus 10*b* by further rollers 82*a*, 82*b* counter rotated with complementary rollers substantially below the line of the planar panel 26. The paper 24 is longitudinally cut by a longitudinal cutting wheel 43 counter rotated against a shearing edge wheel 44 beneath the planar body 26. A transverse cutting punch 190 cuts the longitudinally cut paper 24*a* to length. The longitudinally cut paper 24*a* is thus controlled onto a stack 121. The cut paper stack 121 is then compressed by a platform 206 that extends through an opening 230 in the stack holder 209. The platform 206 is vertically reciprocally mounted on a scissor lift mechanism 122.

Figure 1E:
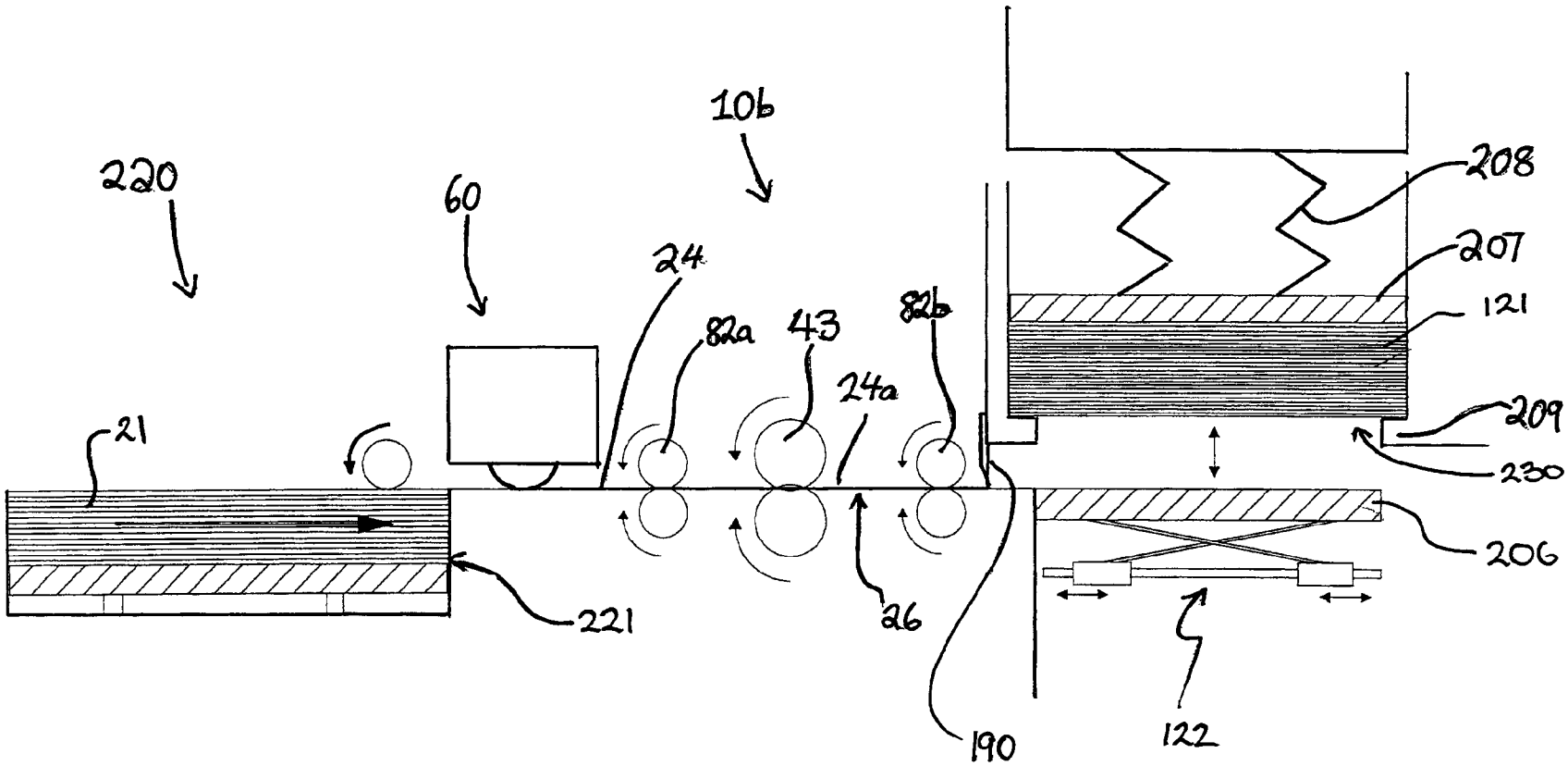
FIG. 1*e* is a schematic side view of a notepad forming device including an adhesive tape applicator.
Figure 1F:
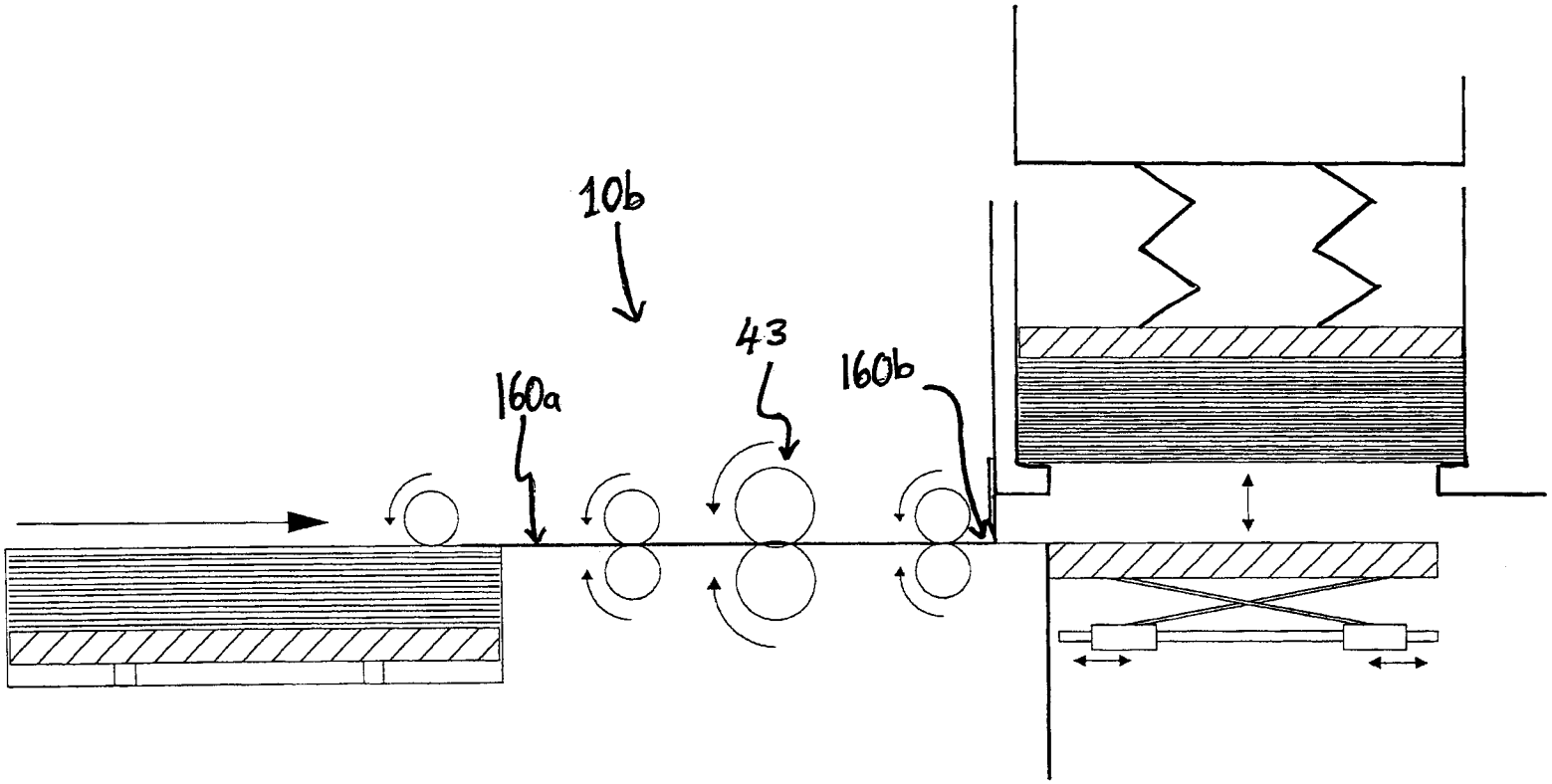
FIG. 1*f* is a schematic side view of a notepad forming device incorporating the cutting and stacking means shown in FIG. 1*d;*

Above the stack 121 and opposed to the platform is a floating floor 207. When a predetermined amount of paper 24*a* has accumulated on stack 121, the platform 206 is pushed against the bias of compression springs 208 from which the floating floor 207 is suspended. This compression of the stack 121 presses the adhesive and forms a pad from the stacked sheets 121. An adhesive tape applicator 60 is provided to apply adhesive to the paper 24 in longitudinal strips. An adhesive applicator can be included at various alternative spots in the series of operations performed by the device 10*b*, for example, before or after the longitudinal cutting means 43 at positions 160*a,b* as shown in FIG. 1*f*.

Figure 1G:
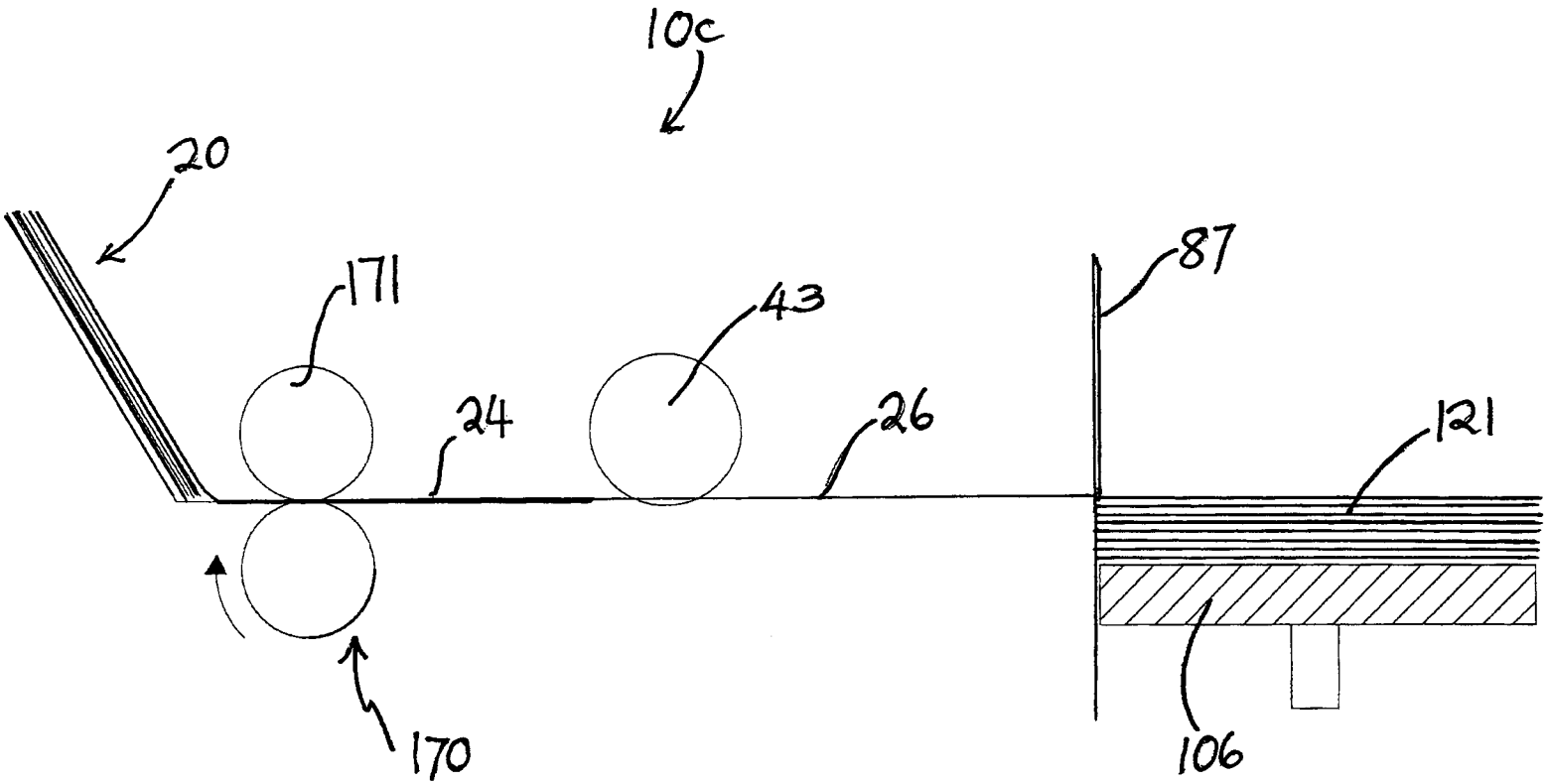
FIG. 1*g* is a schematic side view of a notepad forming device according to another embodiment of the invention.

A different arrangement is shown in FIG. 1*g* in which a device 10*c* comprises a sticker or stamp applicator 170. The application of stickers or stamps, for example to memo pads, may be advantageous. In this case, the stamp applicator 170 includes a free running wheel 171 above the sheet 24 and the planar panel 26, immediately following the feeder mechanism 20 and prior to the longitudinal cutting means 43 in the series of operations performed by the device 10*c*. However, the skilled person will appreciate that the stamp/sticker applicator 170 can be incorporated in or on the device 10*c* at a variety of positions, for example, before or after the longitudinal cutting means 43, and may or may not be used in series with a glue/tape applicator of the type described with reference to FIG. 1*e*.

Figure 1H:
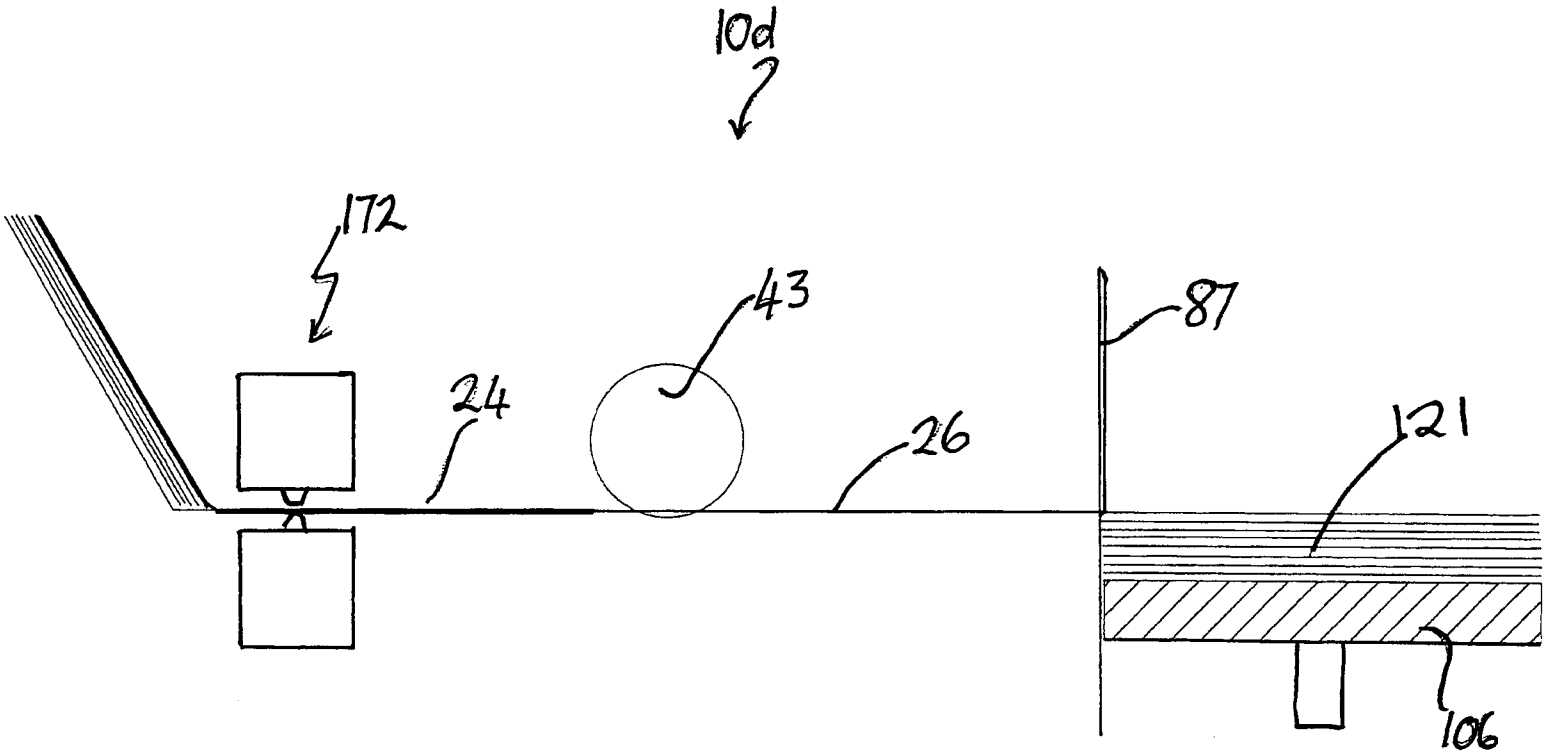
FIG. 1*h* is a schematic side view of a notepad limning device having a printer head.

Turning to FIG. 1*h*, an arrangement 10*d* is shown that is similar to device 100 shown in FIG. 1*g*, but includes a printer head 172 before or after the longitudinal cutting means 43 to apply graphics such as headings or images to the paper 24. The printer head 172 can be used in series with an adhesive tape applicator 60 (see FIG. 1*e*), or can be used in its own right, i.e. merely to apply printed indicia or images to sheets 24 preparatory to forming cut sheets 24*a* in as the form of a pad. The printer head 172 may be located above and/or below the planar panel 26, depending on the sheet lace (upper or lower facing) to be printed on.

In FIG. 1*i*, arrangement 10*e* is similar to arrangement 10*d* shown in FIG. 1*h*, but includes a sticker applicator 174 instead or a printer head. The sticker applicator 174 that may be located above and/dr below the planar panel 26, and before or after the longitudinal cutting means 43 in the device 10*e* operational series.

Figure 1J:
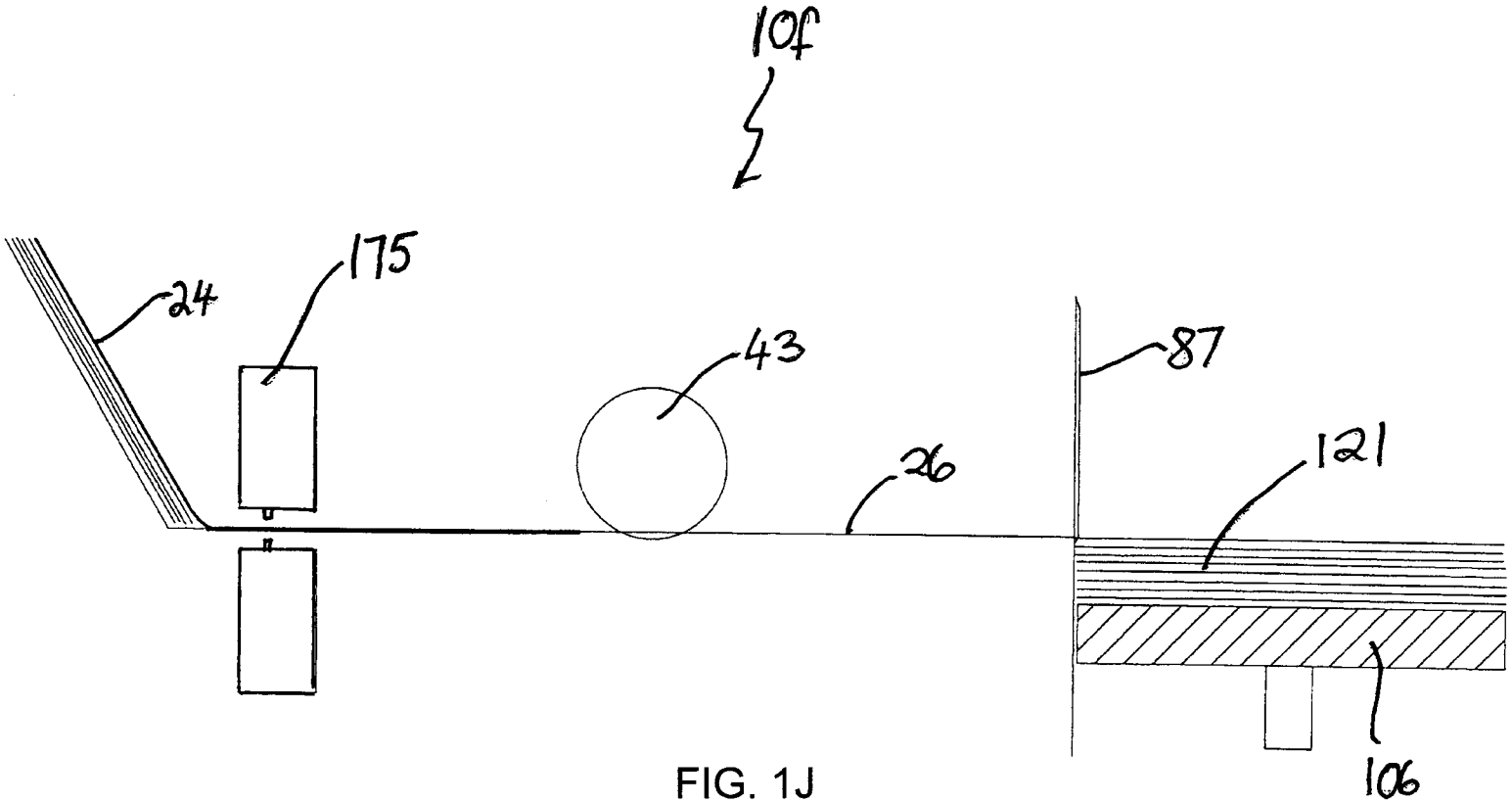
FIG. 1*j* is a schematic side view of a notepad forming device including a laser printing device.

In FIG. 1*j*, the arrangement is similar to those of the devices 10*c*-10*e* shown in FIGS. 1*g*-1*i* respectively, but includes a laser printer head 175 to apply graphics, headings and/or images. Again, the laser printer 175 of device 10*f* may be used together with an adhesive applicator 60, or can be used in its own right.

Figure 2:
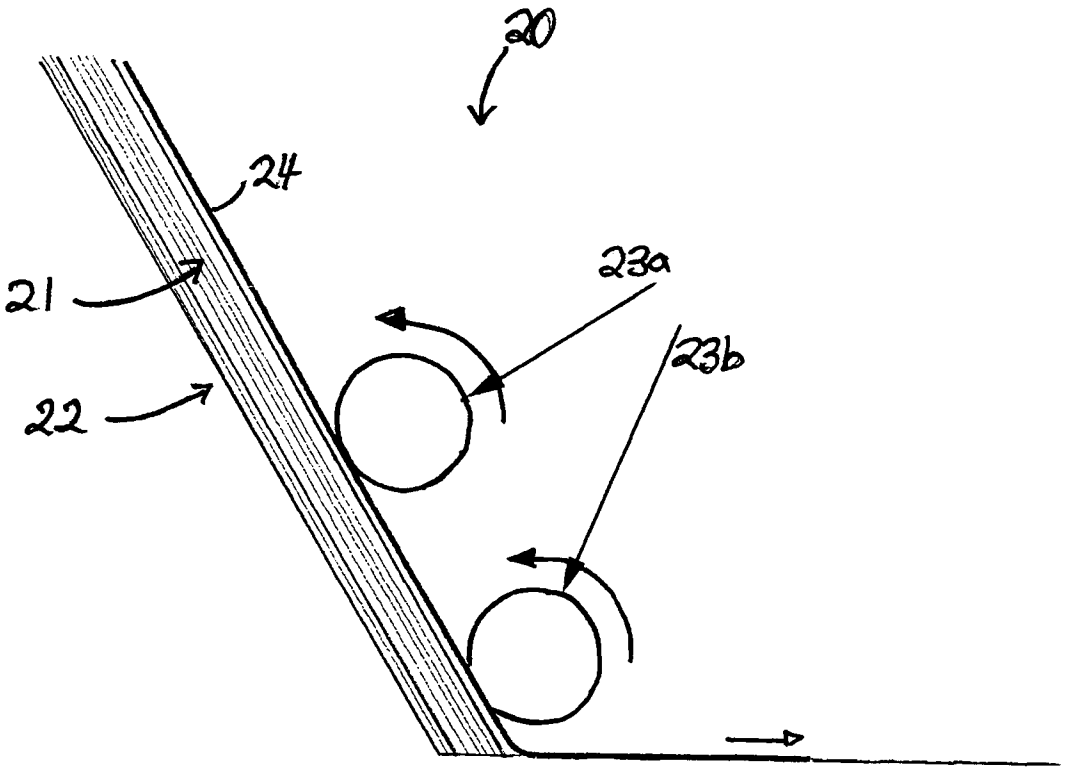
FIG. 2 is a schematic side view of a feeder mechanism according to the preferred embodiment.
Figure 5:
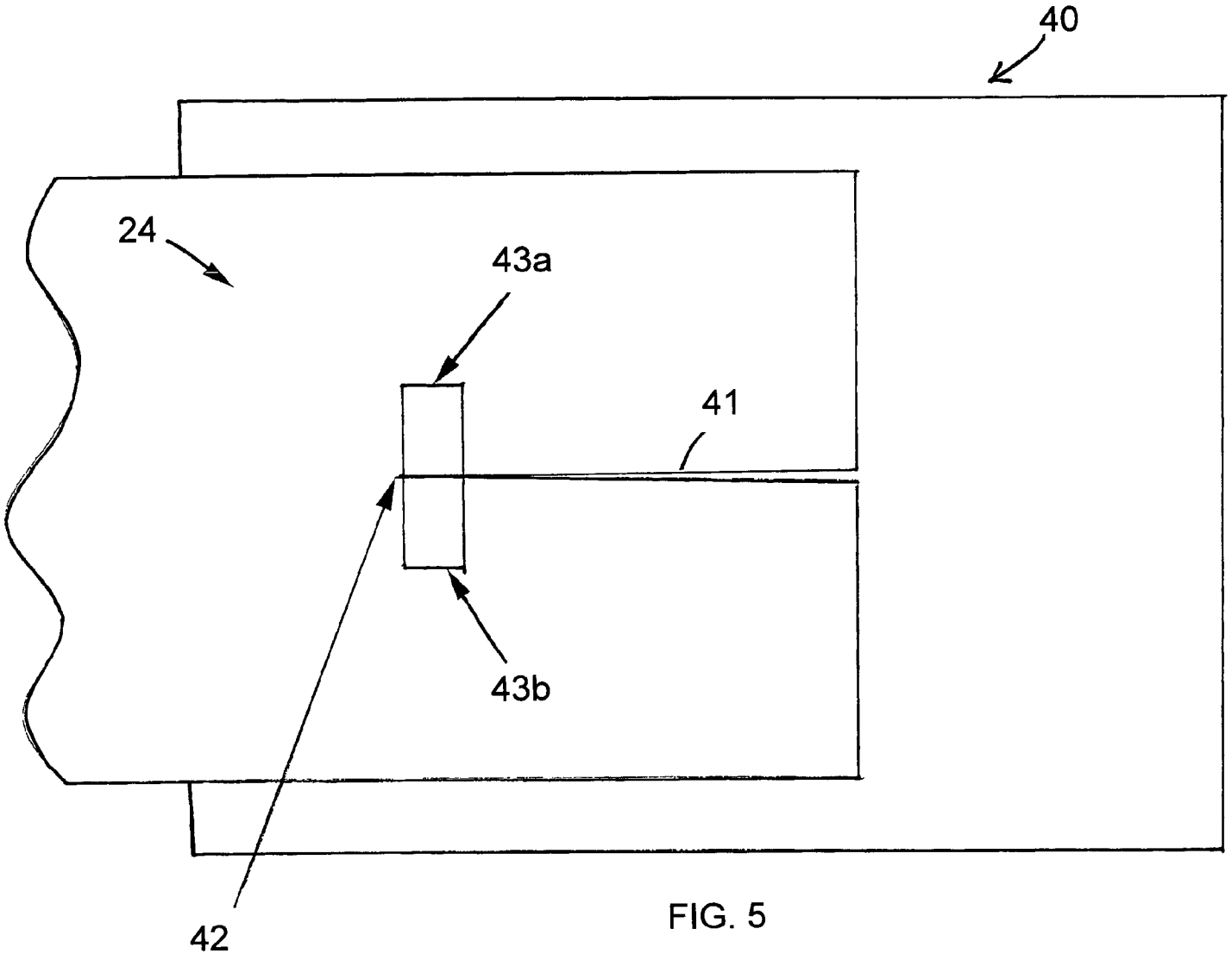
FIG. 5 is schematic plan view of a culling mechanism of the preferred embodiment.
Figure 6:
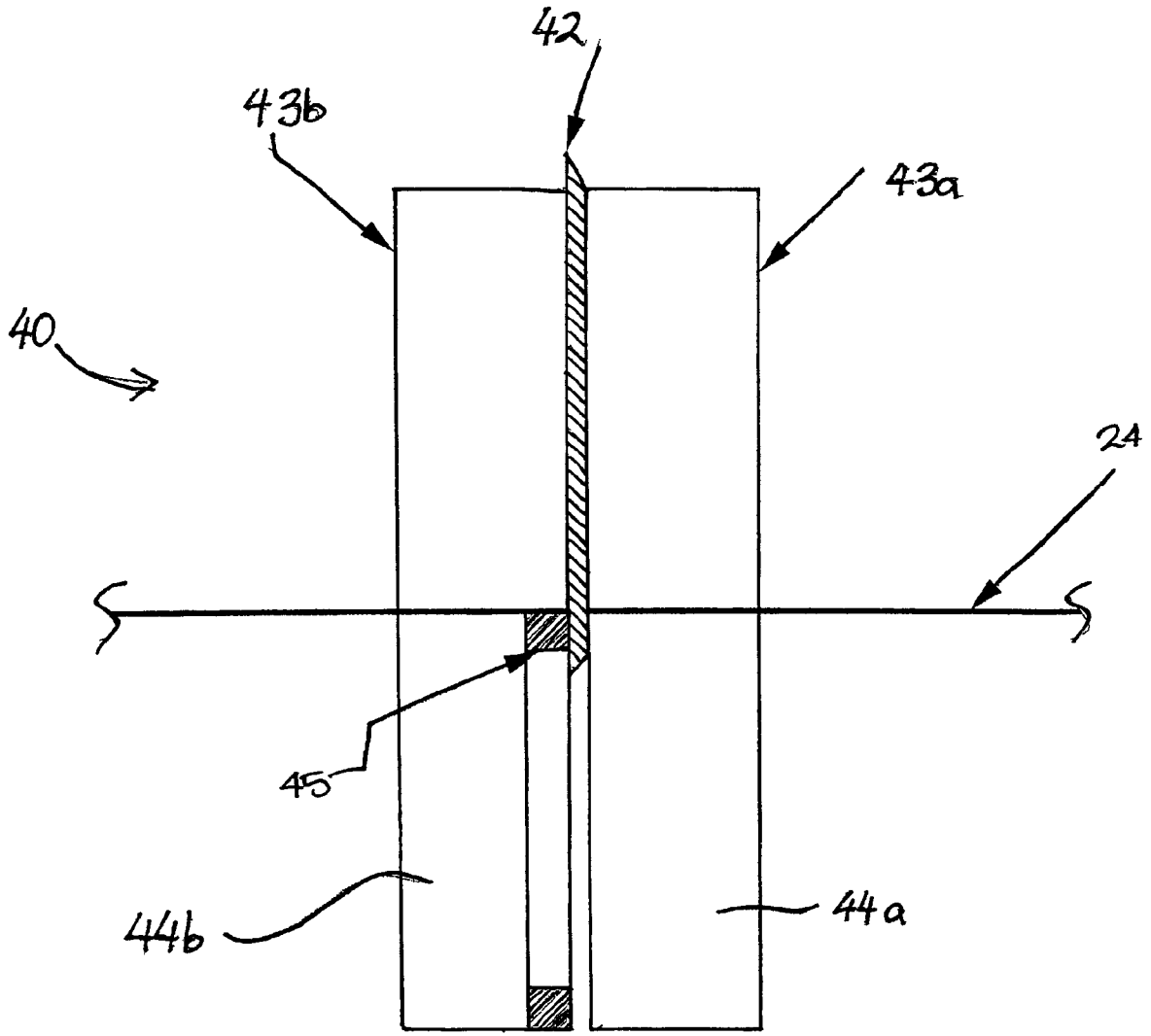
FIG. 6 is a schematic front elevation of the cutting means.

In FIG. 2, there is shown the feeding mechanism comprising an uncut sheet stacking rack 22 for stacking uncut sheets 21 and driven rollers 23*a,b* with high frictional surface material to grip and drag the upper most sheet 24 towards the longitudinal cutting means shown in FIGS. 5 and 6 in the manner of standard paper or polymer film sheet feeding mechanisms found in feeder tray mechanisms of photocopiers, fax machines and standards.

Figure 3:
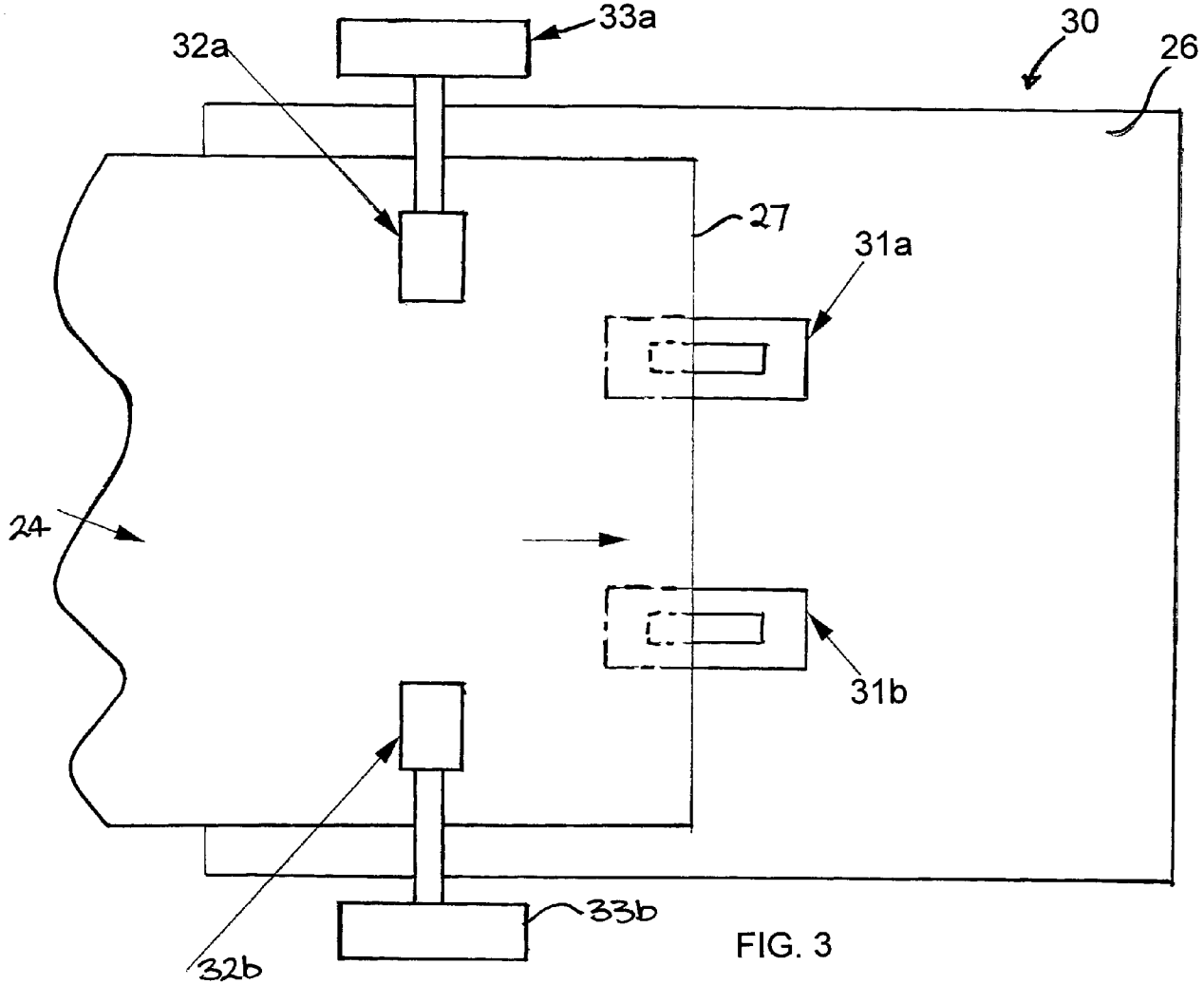
FIG. 3 is a schematic top plan view of the feeder mechanism shown in FIG. 2.
Figure 4A:
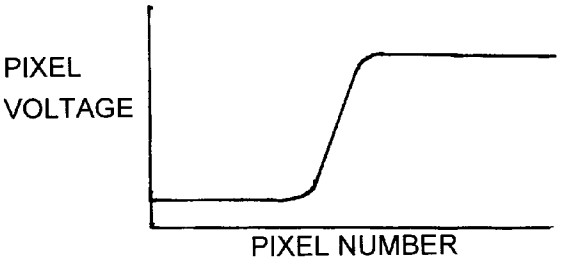
FIGS. 4 (*a*)-(*f*) are graphic representations of the pixel voltage verses pixel number of arrays A and B of photo sensing means of alignment means of the preferred embodiment shown in FIG. 1.
Figure 4D:
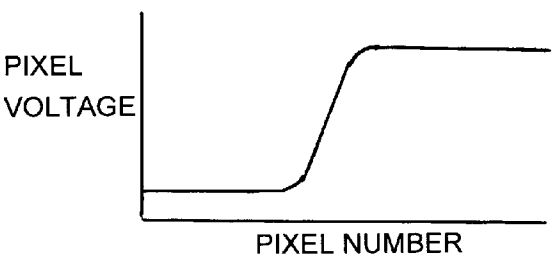
Figure 4B:
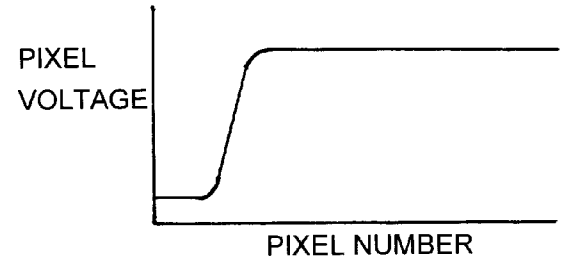
Figure 4E:
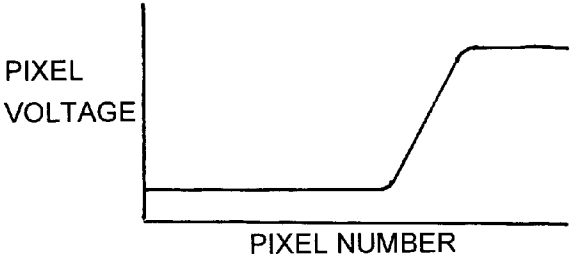
Figure 4C:
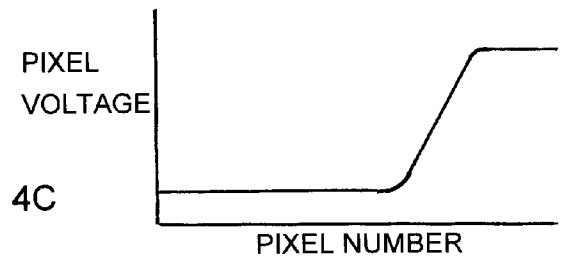
Figure 4F:
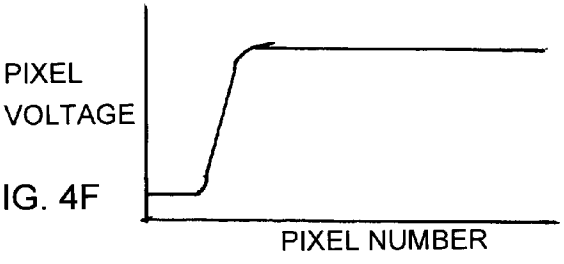

In FIG. 3, the optional alignment correction means 30 is shown from a plan view. This portion of the feeder mechanism is not expressly shown in the drawing or FIG. 1, but is located between the rollers 23*a,b* of feeder mechanism 20 and the longitudinal cutting means 40. The alignment mechanism 30 comprises a pair of coaxially aligned feed rollers 32*a,b* separately driven by respective stepper motors 33*a,b*. The alignment mechanism 30 draws sheet 24 from the feeder mechanism 20.

The pair of rollers 23*a,b* act upon the top sheet of paper 24 in the stack 21 to draw it from the sheets below and to feed it into the alignment/position detection zone of the alignment mechanism 30 shown in FIG. 3. The sheet alignment detection means 30 involves feeding the sheet of paper 24 across the main body 26 of the machine 10. A pair of sensor arrays 31*a,b*, labelled respectively array A and array B, each comprise a linear array of photodiodes.

As the sheet 24 passes over the sensor arrays 31*a,b*, the sensor arrays issue to a CPU a signal corresponding to the leading edge 27 of the sheet 24 as it passes over the arrays 31*a,b*. The position of the edge 27 is determined liar each sensor array 31*a,b* and compared by the CPU software. If both sensor arrays 31*a,b* show the position of the edge 27 to be substantially the same (in time and space), then this indicates to the CPU that the sheet of paper 24 is being fed in correct alignment relative to the body 26.

However, if the edge 27 position is different for the two sensor arrays 31*a,b*, then it is an indication that the sheet 24 is not correctly aligned. If this occurs, the CPU through an operator display may flag an error situation and halt, or the alignment mechanism 30 may be equipped to straighten the sheet 24 as an optional additional feature of the device 10. Prior to the sheet 24 passing over the sensor arrays 31*a,b*, the sheet 24 will pass under a roller 32*a,b* on each side of the sheet 24. Each roller 32*a,b* is independently driven by its own stepper motor 33*a,b*. If the sheet 24 is determined to be incorrectly aligned, this situation can be corrected by advancing one motor (for example stepper motor 334) and or retreating the other motor (for example stepper motor 33*b*) or holding the other motor (33*b*, 33*a* respectively) stationary. In this manner, the sheet 24 may be adjusted into square alignment, using the pair of sensor arrays 31*a,b* to check the sheets 24 position in real time. As alluded to above, this is an optional feature and may be provided only in preferred embodiments or the invention.

Prior to passing completely over the sensor arrays 31*a,b*, the position of the leading edge 27 of the sheet 26 is logged by the CPU so that a datum (reference point) is established. This allows the CPU to calculate the number of steps required to advance the stepper motors 33*a,b* before the sheet edge 27 passes into the final lateral slitting or cutting stage (corresponding to lateral cutting means). This allows the CPU to compute the exact number or steps to advance the stepper motors of the device for achieving a predetermined length of final cut of the sheet 24.

In FIG. 4 there is shown the signal feedback to the CPU from the photodiodes of arrays A and B 31*a,b* to demonstrate the mechanism for, detecting the leading edge 27 and to signal mal-alignment of the sheet 24. In FIGS. 4(*a*) and (*d*) the sheet 24 is correctly aligned square to the body 26. Pixel numbers increase as the sheet 24 passes over them and pixel voltage dramatically increases, thereby enabling the CPU to log the datum liar each side of the sheet 24.

However, in FIG. 4(*b*) the sheet 24 is biased towards one side and leading sheet edge 27 reaches array A (31*a*) first thereby indicated to the CPU that the speed of stepper motor 33*b* should be increased relative to that of stepper motor 33*a* to effect an adjustment of the sheet's 24 alignment. In FIGS. 4(*c*) and (*f*) the reverse situation is indicated in that the sheet 24 is skewed towards stepper motor 33*a* so that edge 27 reaches array B (31*b*) before array A (31*a*) and the speed of stepper motor 33*a* should be increased relative to stepper motor 33*b* to restore sheet 24 alignment.

Referring to FIG. 5, there is shown the longitudinal cutting mechanism 40 adapted to slit the sheet 24 along a centre line 41 by the action of a free wheeling, circular blade 42 with the sheet 24 held under tension and supported by upper feed rollers 43*a,b* and lower feed rollers 44*a, b*. The sheet 24 is drawn into the first slitting operation performed by the longitudinal cutting means 40 by the driven lower feed rollers 44*a,b* (noting that lower feed roller 44*a* is obscured in FIG. 5, but shown in FIG. 6). Under the sheet 24 are the pair of driven elastomeric-surfaced rollers 44*a,b* that are separated by the circular knife 42. Above the driven rollers 44*a, h* are the corresponding pair of freewheeling elastomeric rollers 43*a,b* The rollers 43*a,b* and 44*a,b* sandwich the circular slitting blade 42.

The slitting blade's 42 cutting face is shown in detail in FIG. 6. Interposed between the lower rollers 44*a,b* is a slitting edge 45 that comprises a planar circular disc or ring attached to so the inner side of the lower roller 44*b*. The slitting edge 45 rotates with the lower roller 44*b* to create a scissor-like interaction between the freewheeling slitting blade 42 and the driven slitting edge 45.

Accordingly, the slitting blade's 42 cutting face is in contact with the cutting lace of the slitting edge roller 45. The lower rollers 44*b*, 44*a*, being driven, draw the sheet 24 through the longitudinal cutting means 40 whilst the slitting edge roller 45 slits the sheet along the sheet's 24 centre line 41 to form a longitudinally split sheet 24*a* split down its centre.

Figure 6A:
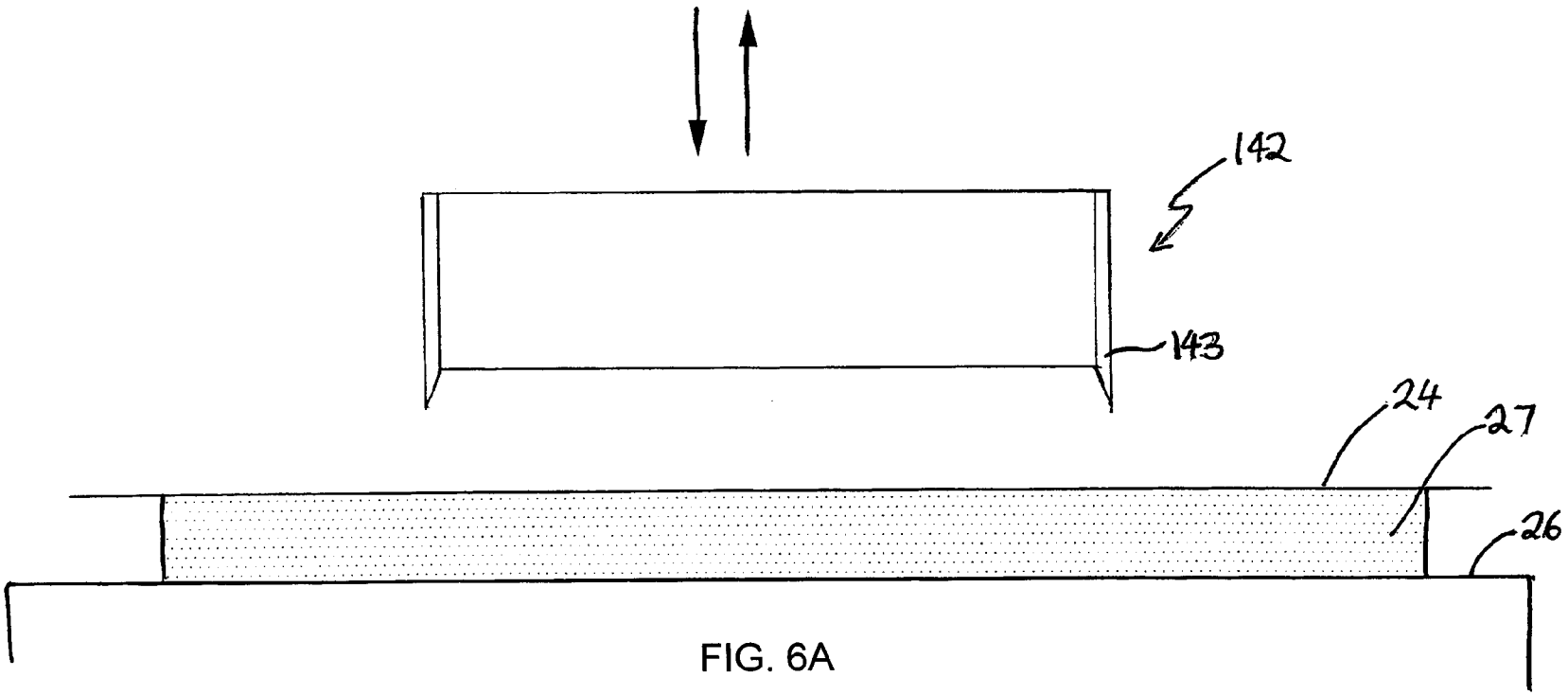
FIG. 6*a* is a schematic side view of a punch blade suitable for various embodiments of the present invention.

In FIG. 6*a*, there is provided a punch/knife 142 adapted to punch a longitudinal or transverse slit in a sheet of paper 24. The paper 24 is supported on a resilient elastomeric medium 27 that, in turn, is supported on the fixed support of the planar panel 26. The knife punch 142 may be used to affect either or both longitudinal or transverse cuts and may include a single knife blade 143 or multiple knife blades as shown.

Figure 6B:
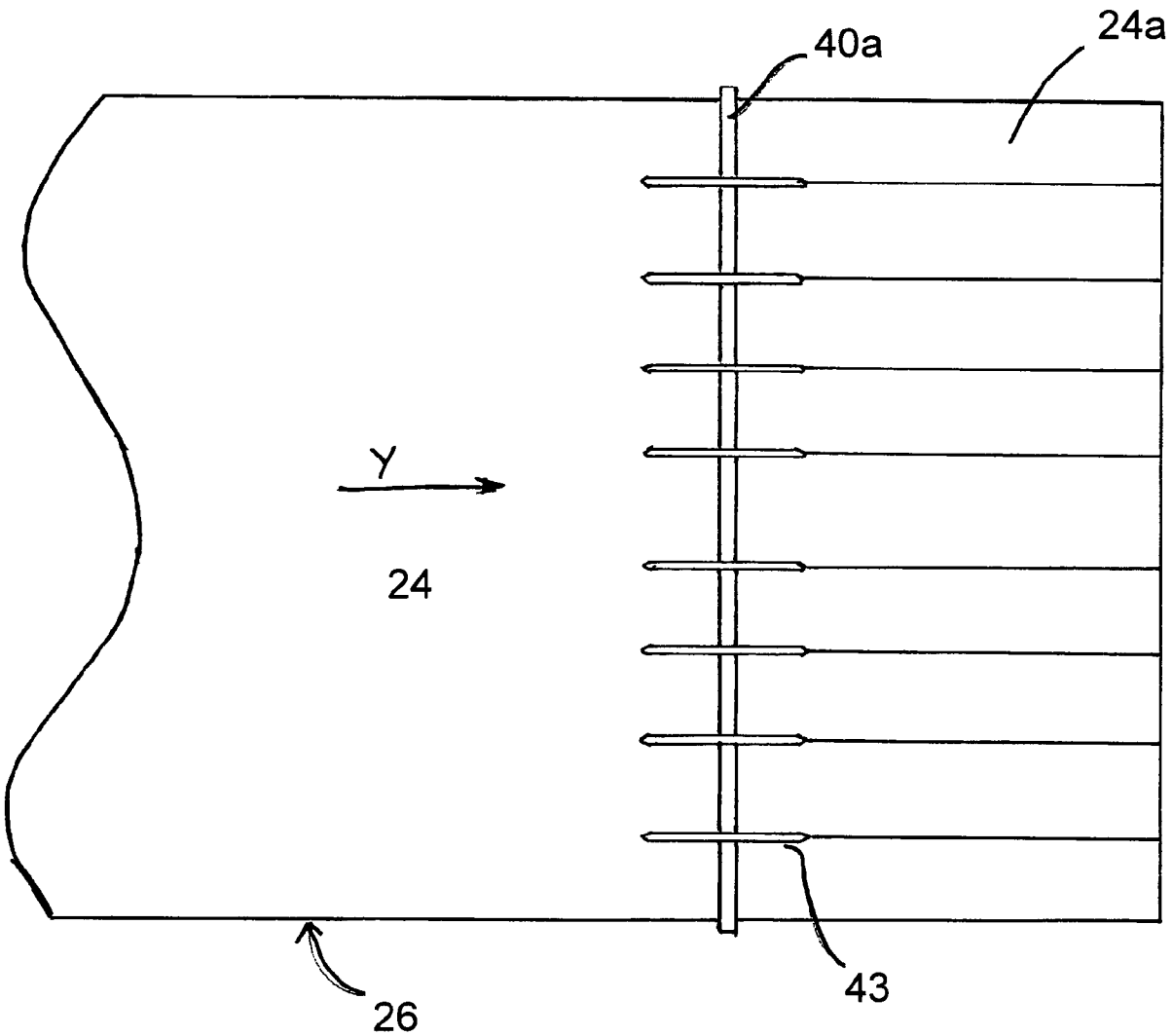
FIG. 6*b* is a schematic partial plan view a longitudinal cutting means suitable for incorporation in various embodiments of the invention.
Figure 6C:
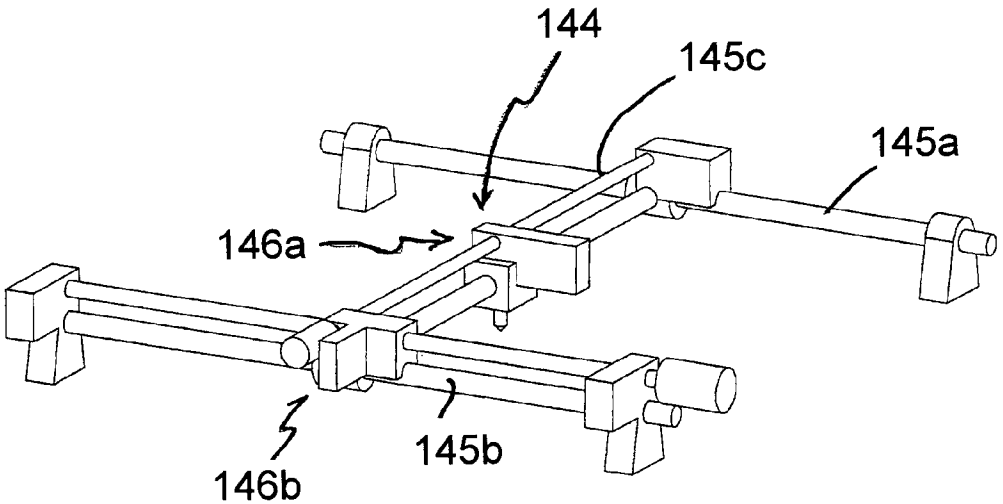
FIG. 6*c* is a perspective view of a laser cutting means driven on a rail suitable for use in various embodiments of the present invention.
Figure 6D:
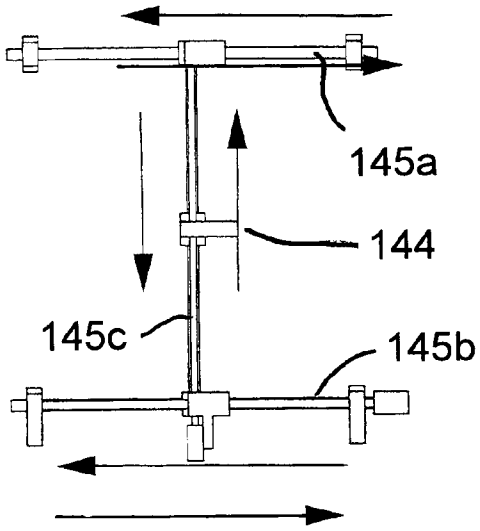
FIG. 6*d* is a schematic top plan view of the laser cutting means shown in FIG. 6*c;*

Referring to FIG. 6*b*, as described in FIG. 1*b*, the number of longitudinal cutting means 43 and the spacing thereof on a shaft 40*a* may vary to determine the width of the longitudinal strips 24*a* produced downstream of the longitudinal cutting means 43 us the paper 24 proceeds in direction y. As previously described, the multiple cutting heads 43 may be mounted on a single shall 40*a* or on two or more alternative retracting shahs:

Referring to FIGS. 6*c* and 6*d*, there is shown a laser cutting head 144 mounted on a set of rails/linear bearings 145*a,b,c* driven by motors 146*a,b* to give the laser cutting head 144 full to movement in two dimensions. The motors 146*a,b* control the direction and speed of the laser cutting head 144, which can be used for both longitudinal and transverse cutting of the paper 24 (not shown in this drawing). In this embodiment, lead screws on the bearings are used as the translation means of the rail/linear bearing mechanisms of rails 145*a,b,c* and the drive mechanisms 146*a,b*.

Figure 6E:
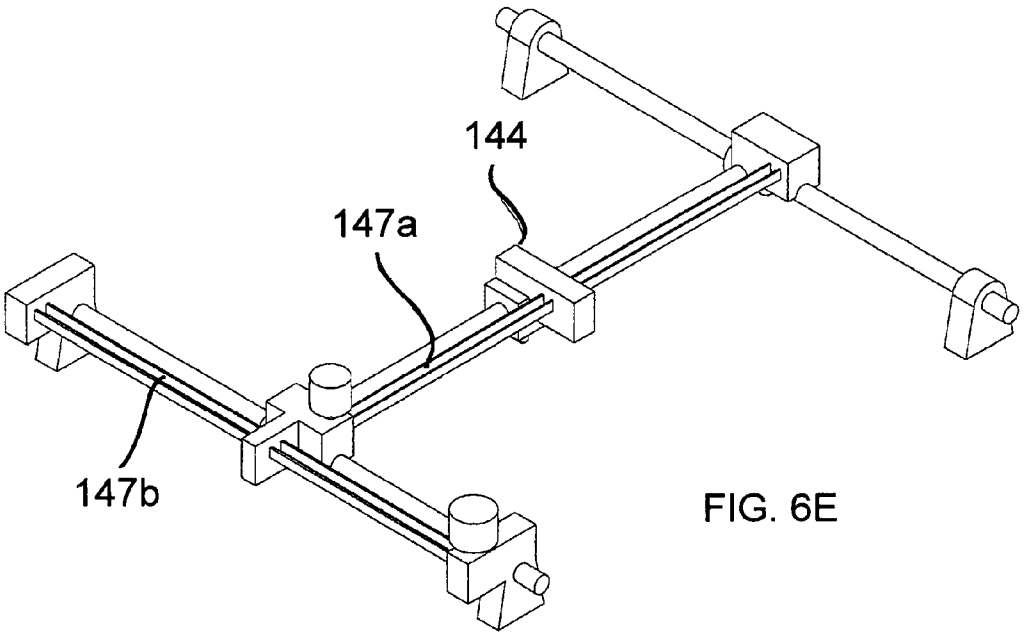
FIG. 6*e* is a schematic perspective view of a cutting means incorporating a laser cutting head and belt drives, but otherwise similar to the cutting means shown in FIG. 6*c;*
Figure 6F:
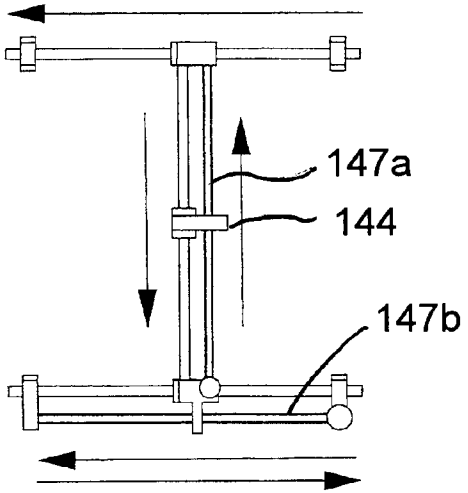
FIG. 6*f* is a schematic plan view of the cutting means shown in FIG. 6*d;*

Referring to FIGS. 6*e* and 6*f*, a laser cutting and translation arrangement similar to that shown in FIGS. 6*c* and 6*d* is shown, except that the laser cutting head 144 is driven using belt drives 147*a,d*, the belt drives 147*a,b* having linear bearings.

Figure 7:
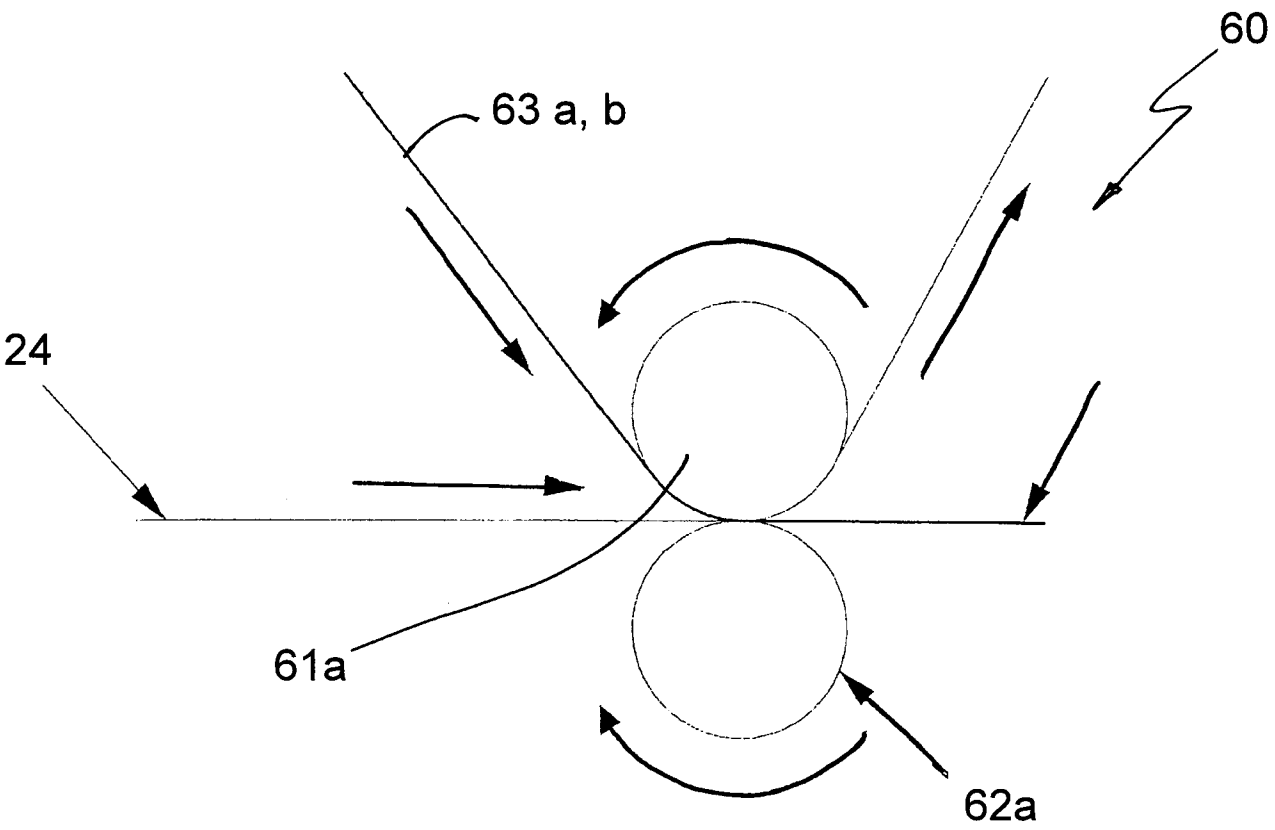
FIG. 7 is a schematic side view of an adhesive applicator forming part of the preferred embodiment.
Figure 8:
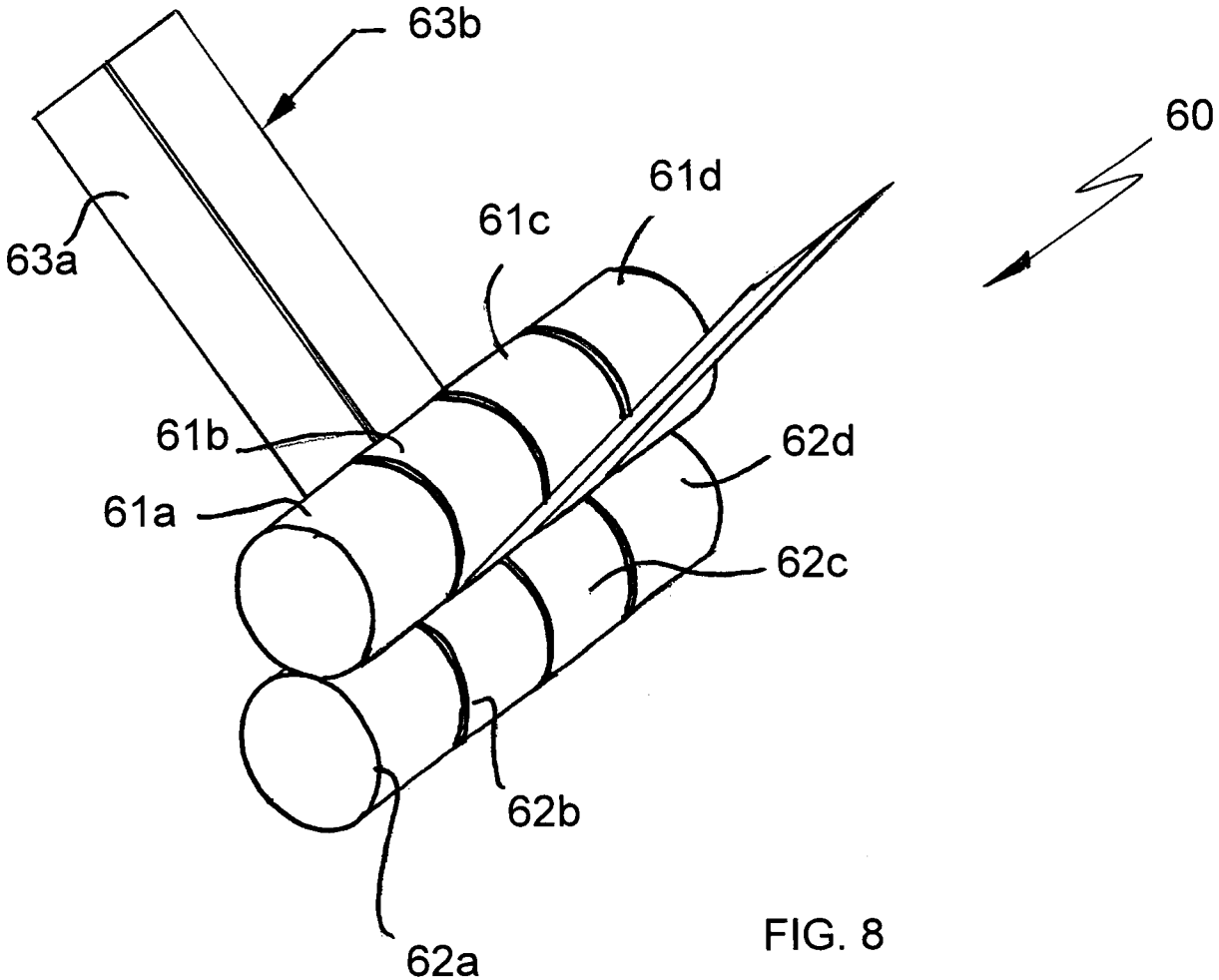
FIG. 8 is a schematic perspective view of the adhesive applicator.

Referring to FIGS. 7 and 8, the adhesive applicator 60 is shown in more detail. Immediately following the slitting rollers 43*a,b* and 44*a,b*, the cut sheet 24*a* is led into an assembly comprising eight elastomeric rollers 61,62. The assembly of the base rollers 61,62 is divided into two rows of lour rollers each one row of four rollers 61*a-d* above the cut sheet 24*a*, the other lower complementary row of four rollers 62*a-d* located in a juxtaposed position vertically below the cut sheet 24*a* and in contact with the corresponding upper rollers 61*a-b* above.

The lower, outer pair of rollers 62*a,d* are driven at the same surface speed as the slitting rollers 44*a,b*. The upper, outer pair of rollers 61*a,d* are allowed to free-wheel and are in contact with the lower pair of corresponding outer rollers 62*a,d* These two pairs of rollers 61*a,d* and 62*a,d* drive the cut sheet 24*a* through the adhesive applicator 60.

The inner, upper pair of rollers 61*b,c* are freewheeling and in contact with a pair of so parallel-aligned ribbons or strips of adhesive transfer tape 63*a,b*. One ribbon or adhesive transfer tape 63*a* passes around the outer surface of upper inner roller 61*b* and the adjacent ribbon or adhesive tape 63*b* passes around the outer surface of upper freewheeling inner roller 61*c*.

Furthermore, the inner lower pair of rollers 62*b,c* are freewheeling and in contact with the adjacent ribbons of adhesive transfer tape 63*a,b*. The upper two pairs of inner rollers 61*b,c* press the cut sheet against the lower corresponding pairs of rollers 62*b,c* to apply the adhesive to the corresponding inner strips of cut sheet 24*a* along its cut edge 41 as the cut sheet 24*a* passes through.

The lower pair of inner rollers 62*b,c* apply pressure to the cut sheet 24*a* which is pressed against the adhesive transfer tape 63*a,b* thereby causing adhesive to be applied to the upper surface of the sheet 24*a* (not shown). It is noted that, in use, the adhesive is on the underside surface of the sheets of the notepad and that the upper surface of each sheet is effectively adhesive-free.

Figure 8A:
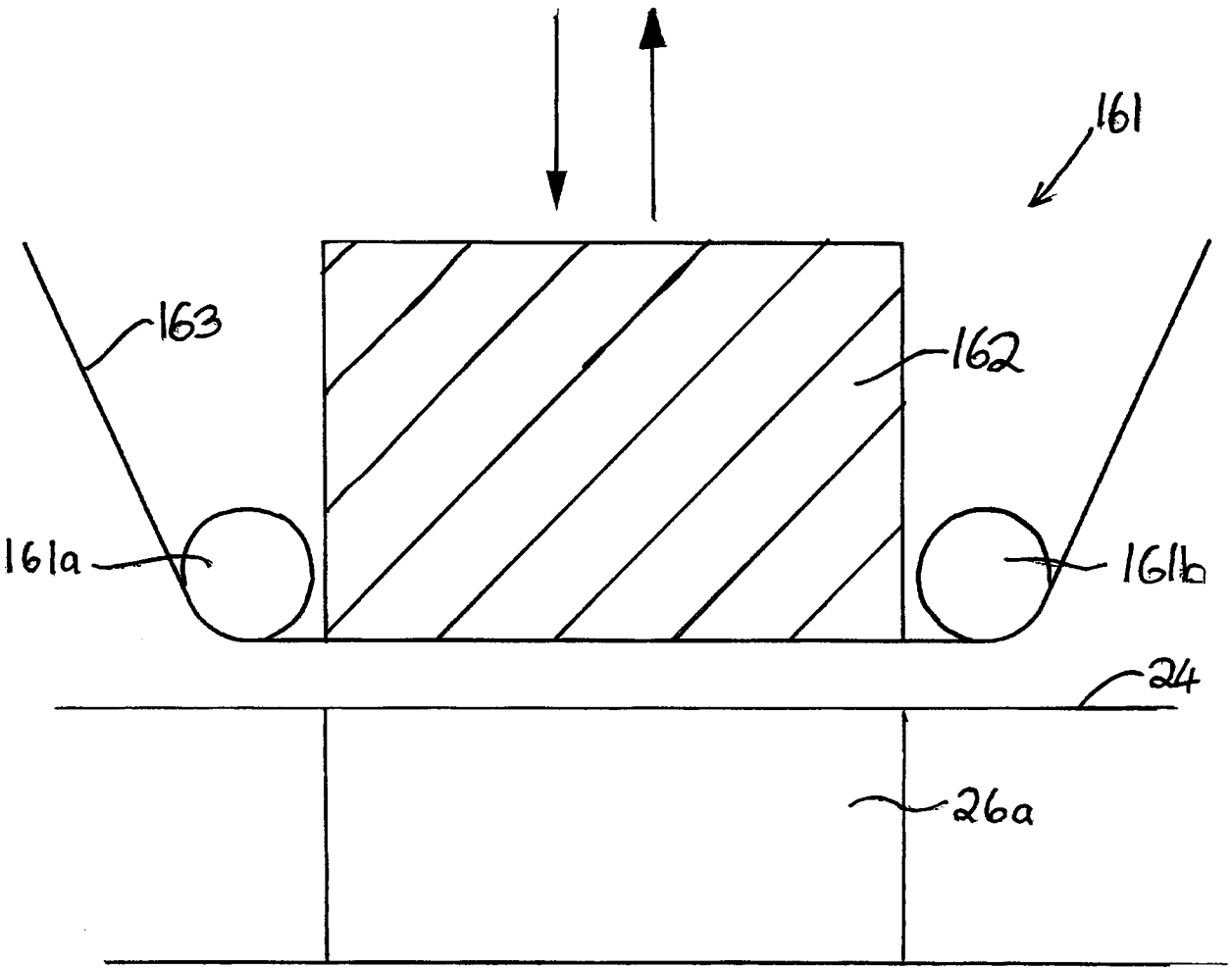
FIG. 8*a* is a schematic side elevation of an adhesive applicator applicable to various embodiments of the invention.

In FIG. 8*a*, there is shown an adhesive transfer tape applicator 161 mounted on a vertically reciprocal stamp head 162 and having driven roller wheel 161*a,b* to roll the tape 163 with each successive stamping operation, in use, the adhesive applicator 161 rises up and down to stamp the paper 24 supported by a fixed support 26*a* to stamp adhesive straight onto the paper 24.

Figure 8B:
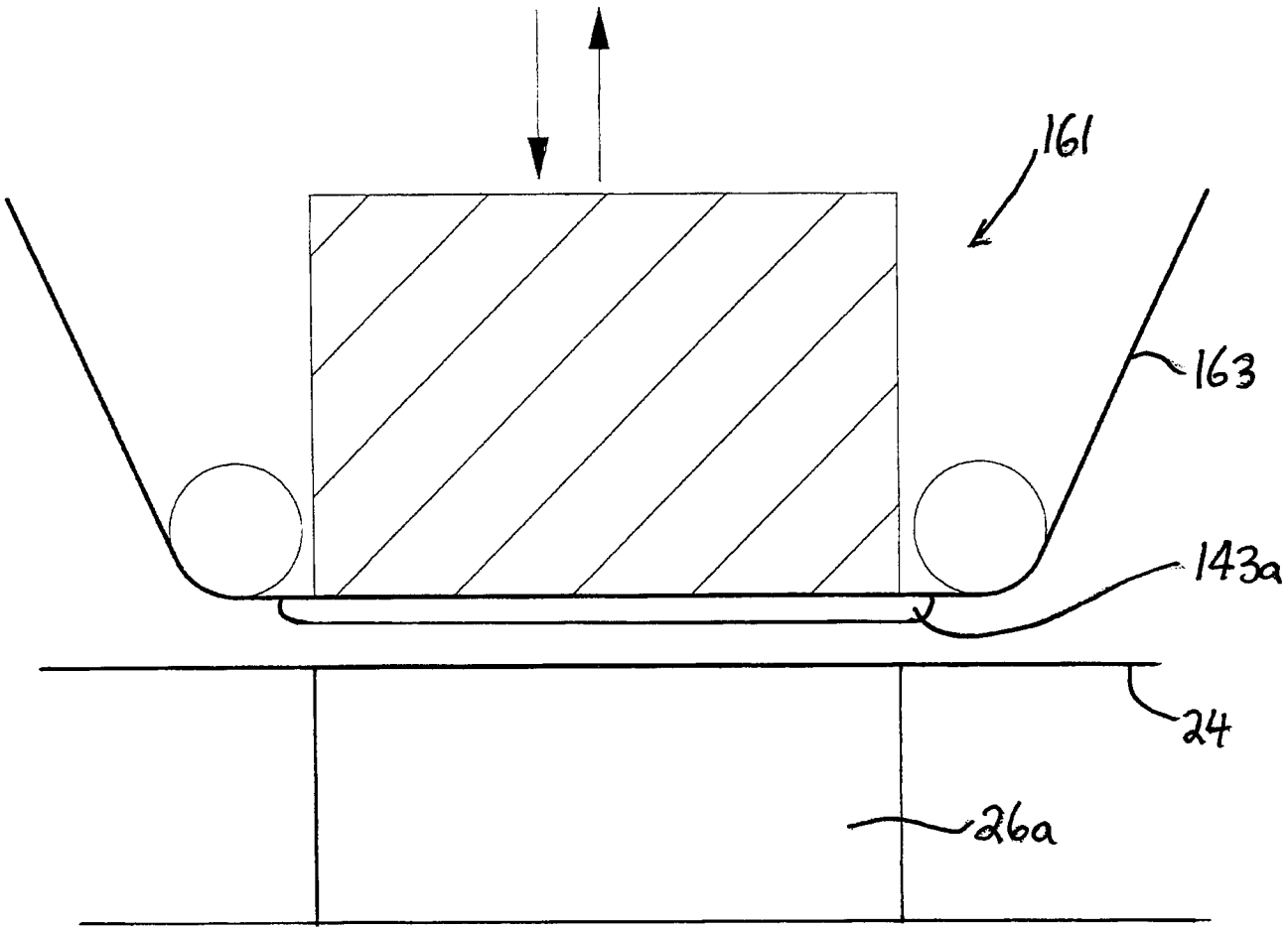
FIG. 8*b* is a schematic side elevation of a modification of the adhesive applicator shown in FIG. 8*a;*

In FIG. 8*b*, an adhesive stamp applicator 161 similar to that shown in FIG. 8*a* is to provided with a blade 143*a* to effect longitudinal cutting or transverse cutting of the paper 24, whereby to combine the adhesive application and cutting operations in a single stamping operation.

Figure 8C:
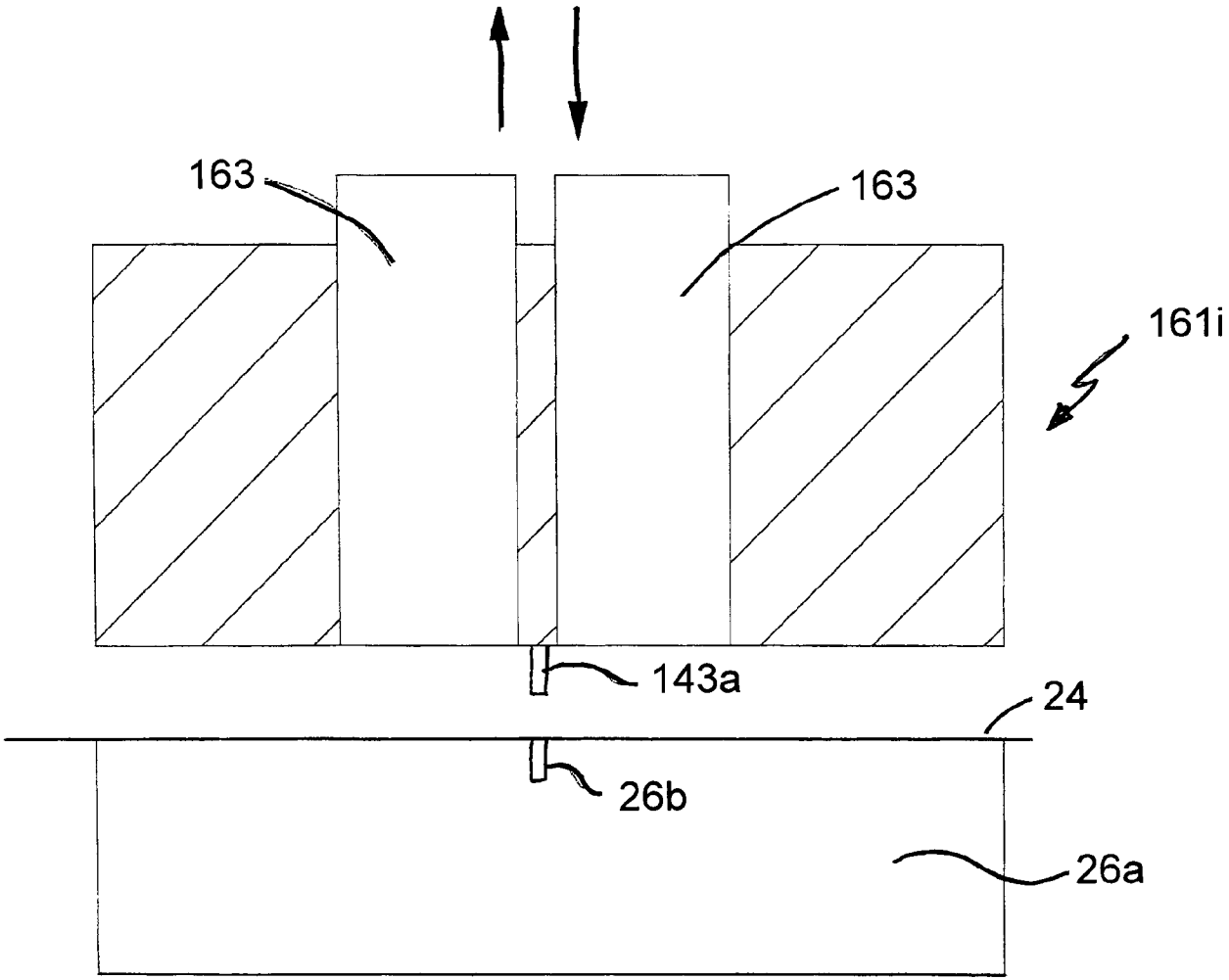
FIG. 8*c* is a schematic front elevation view of the adhesive applicator shown in FIG. 8*b;*

In FIG. 8*c*, an end sectional view of the cutting/adhesive applicator 161 of FIG. 8*b* is shown in which the cutting blade 143*a* is a longitudinal cutting means and the adhesive transfer tape 163 is applied to longitudinal strips of the cut paper 24. The support base 26*a* includes a recessed slot 26*b* that the punch knife 143*a* enters as it cuts through the width of the paper 24. The recessed slot 26*b* is a shearing edge complimentary to the blade 143*a* to effect a clean transverse cut of the paper 24.

Figure 8D:
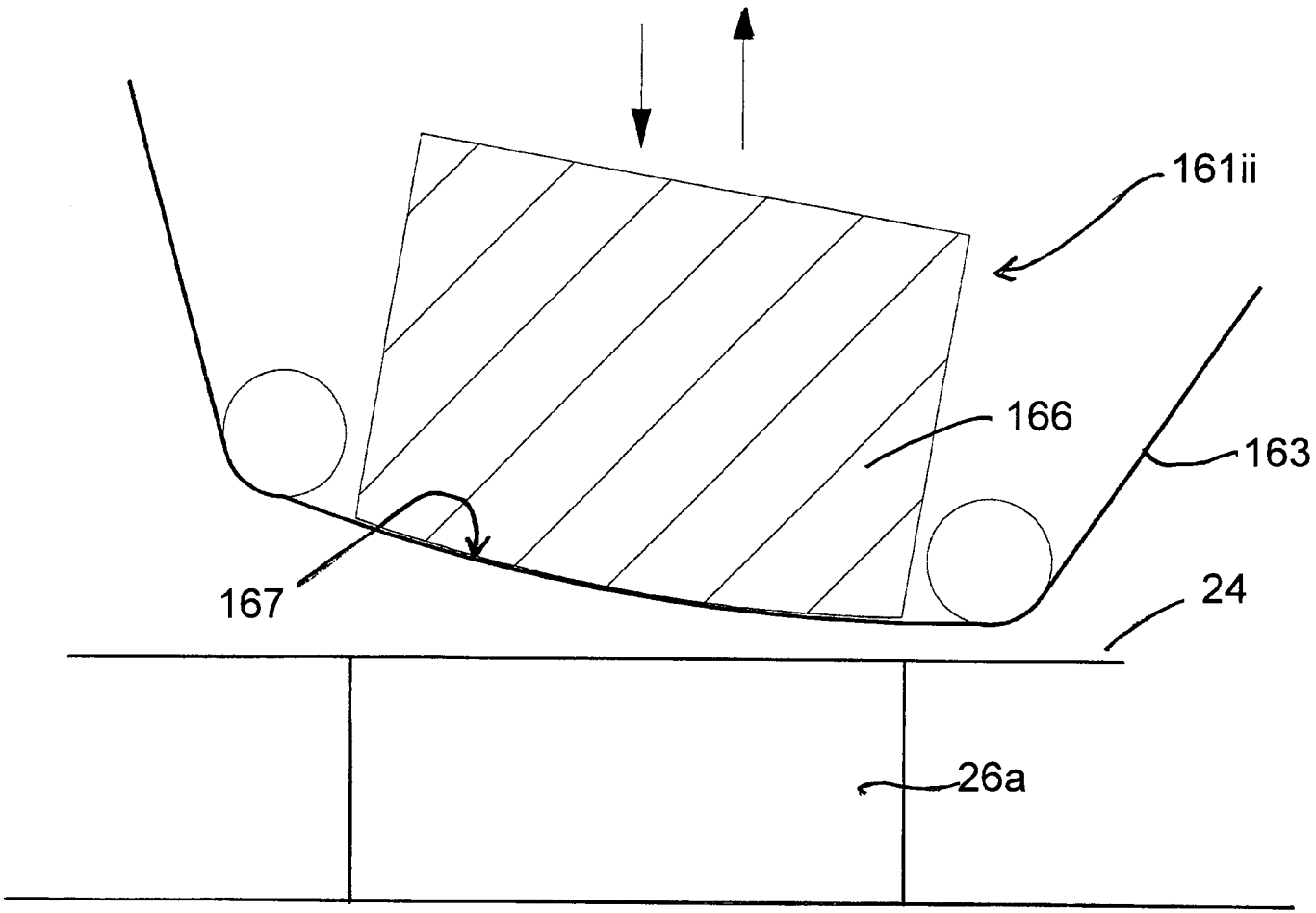
FIG. 8*d* is a schematic side view of an adhesive applicator suitable for incorporation in the various embodiments of the invention.
Figure 8E:
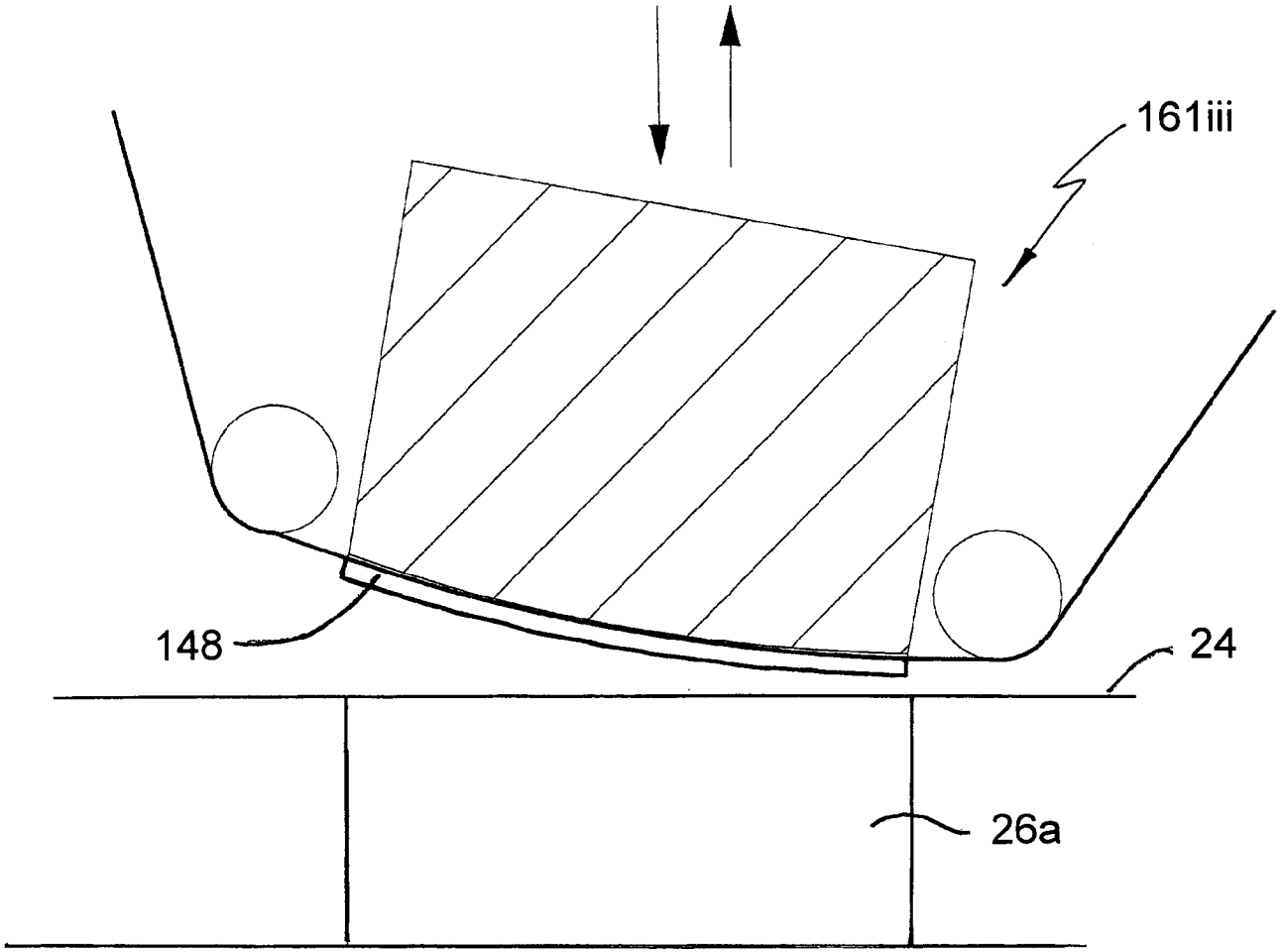
FIG. 8*e* is a schematic side view of an adhesive applicator similar to that shown in FIG. 2, but modified to include a blade.

FIG. 8*d* shows a variation of the previous adhesive transfer tape applicators shown in FIGS. 8*a* and 8*b*, wherein the stamp 161*ii* applies the adhesive to the paper 24 by a rocking motion. The stamp applicator head 166 has a curved lower surface 167 to allow the stamp head 166 to roll along the supported paper 24 surface to achieve good contact between the adhesive tape 163 and the supported paper 24 surface, in FIG. 8; the concepts of the device 161*i* and 161*ii* are combined whereby the adhesive applicator and blade stamp 161*iii* provides a rocking motion stamp of adhesive onto the paper 24 and a curved longitudinal cutting blade 148 to perform the cutting operation.

Figure 8F:
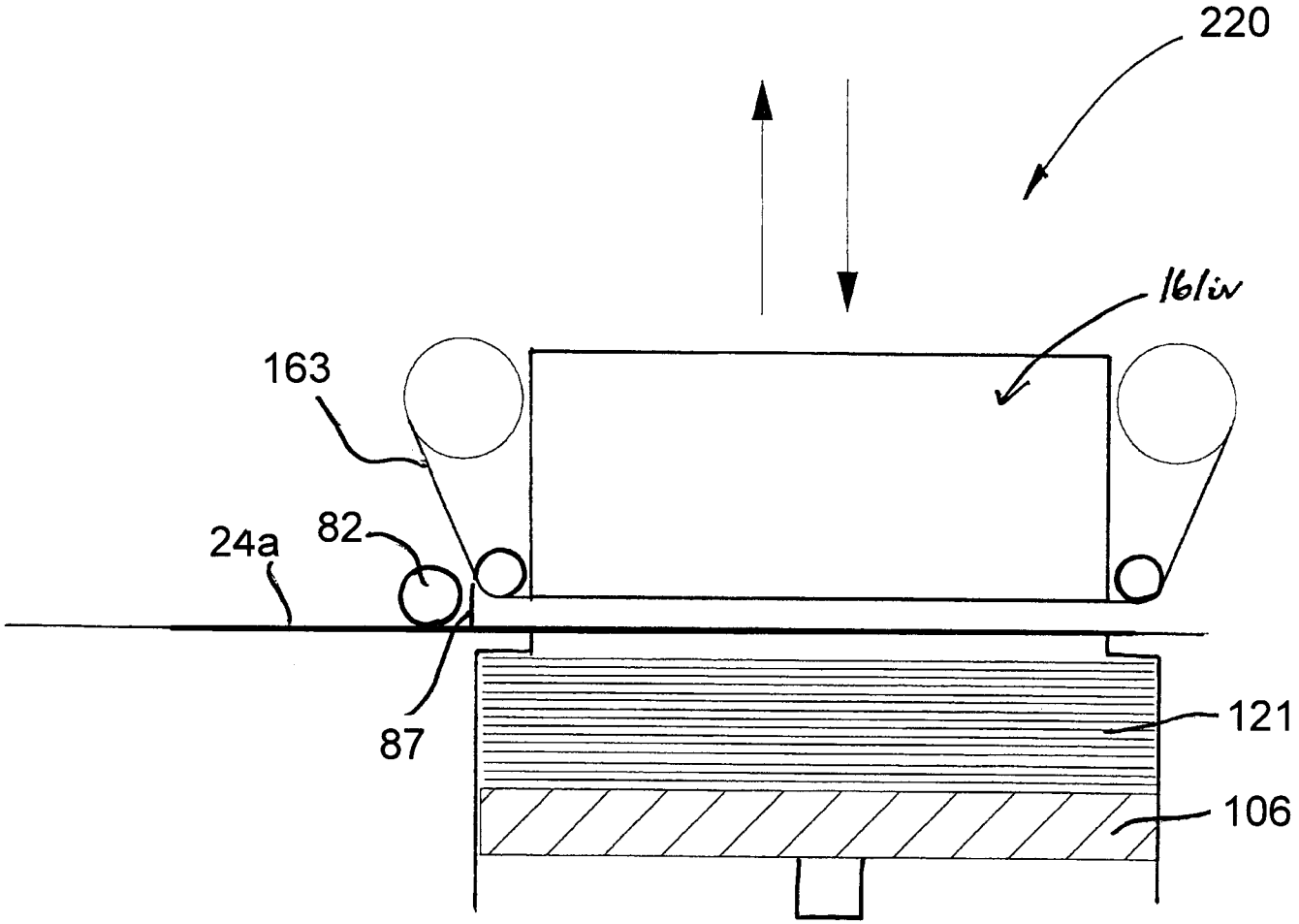
FIG. 8*f* is a schematic side view of an adhesive applicator quid cutting means suitable for various embodiments of the present invention.
Figure 8G:
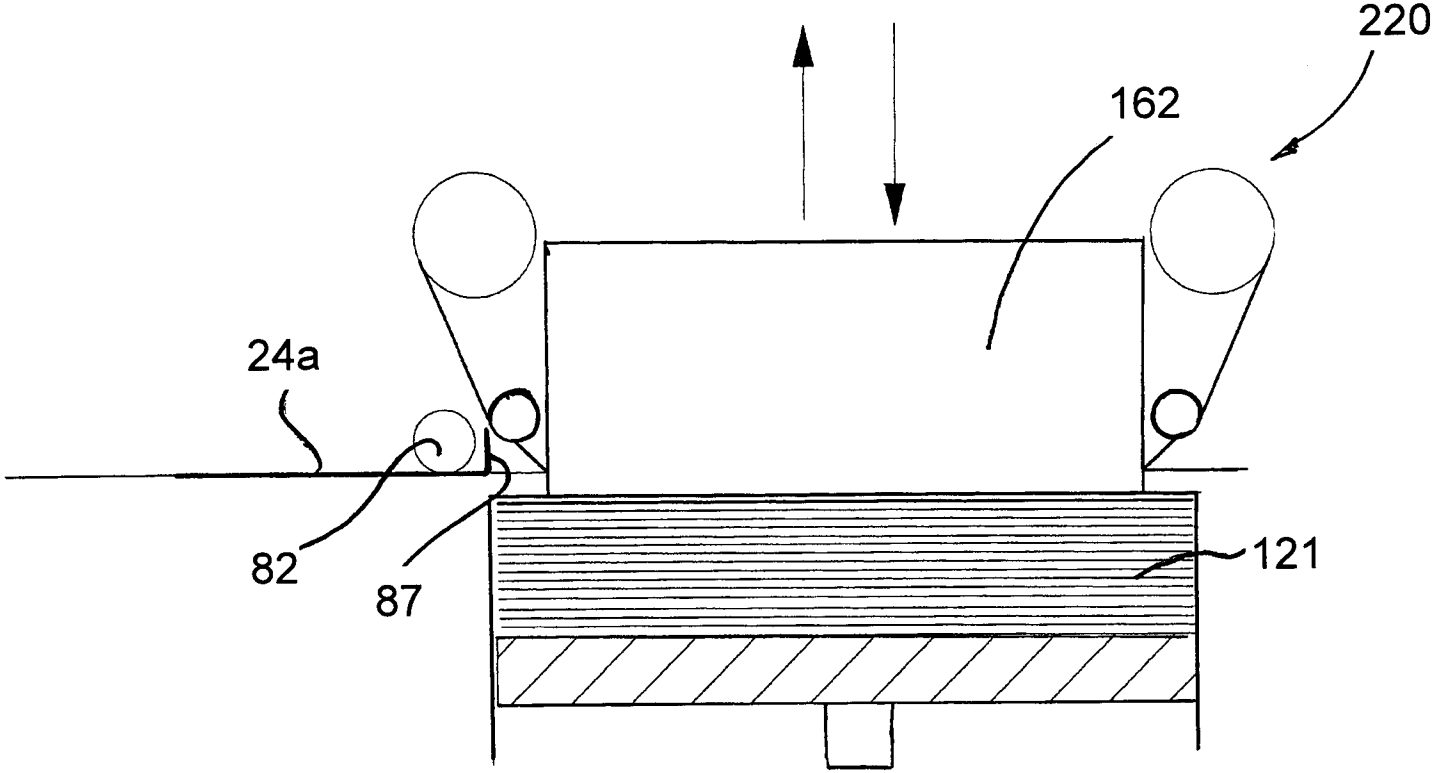
FIG. 8*g* is a schematic side view of the adhesive applicator shown in FIG. 8*f* in a different position.

In FIG. 8*f*, the stamp applicator concept is utilised in a stacking mechanism 220 in which the stamping adhesive applicator 161*iv* not only applies adhesive tape/glue via tape 163 to the sheets 24*a* as they enter a stack 121, but also serve to compress the stack 121 to press the sheets together, index the stack downward and form the pad as an end product. A transverse cutting wheel 87 is also provided to cut the paper 24*a* to length. This is demonstrated in FIG. 8*g* where the paper 24*a* has been cut by the cutting member 87, rolled on to the stack 121 by roller 82 and pressed onto the stack 121 by the stamp head 162.

Figure 11:
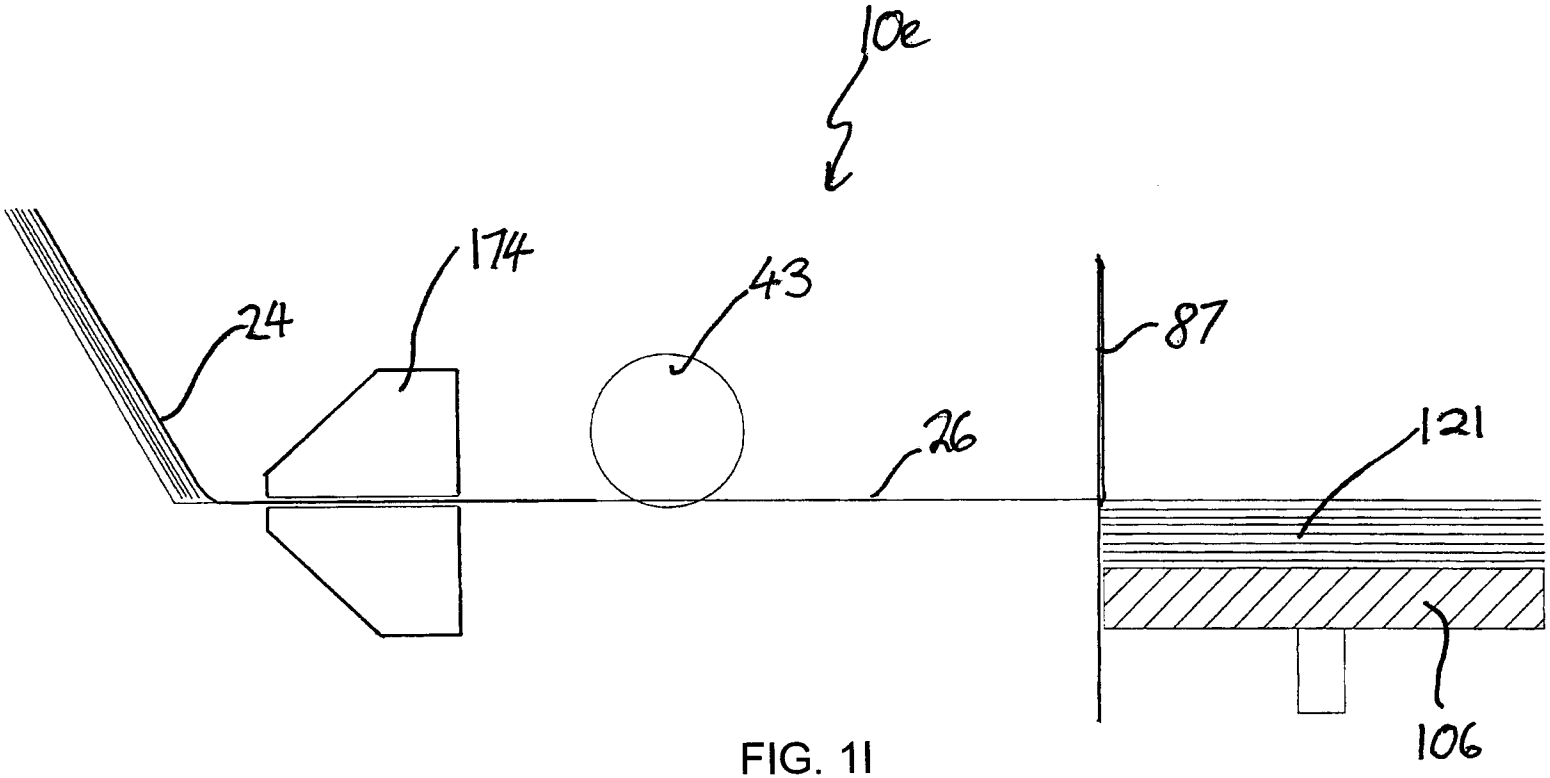
FIG. 11 is a schematic side view of stacking means according to the preferred embodiment.
Figure 9:
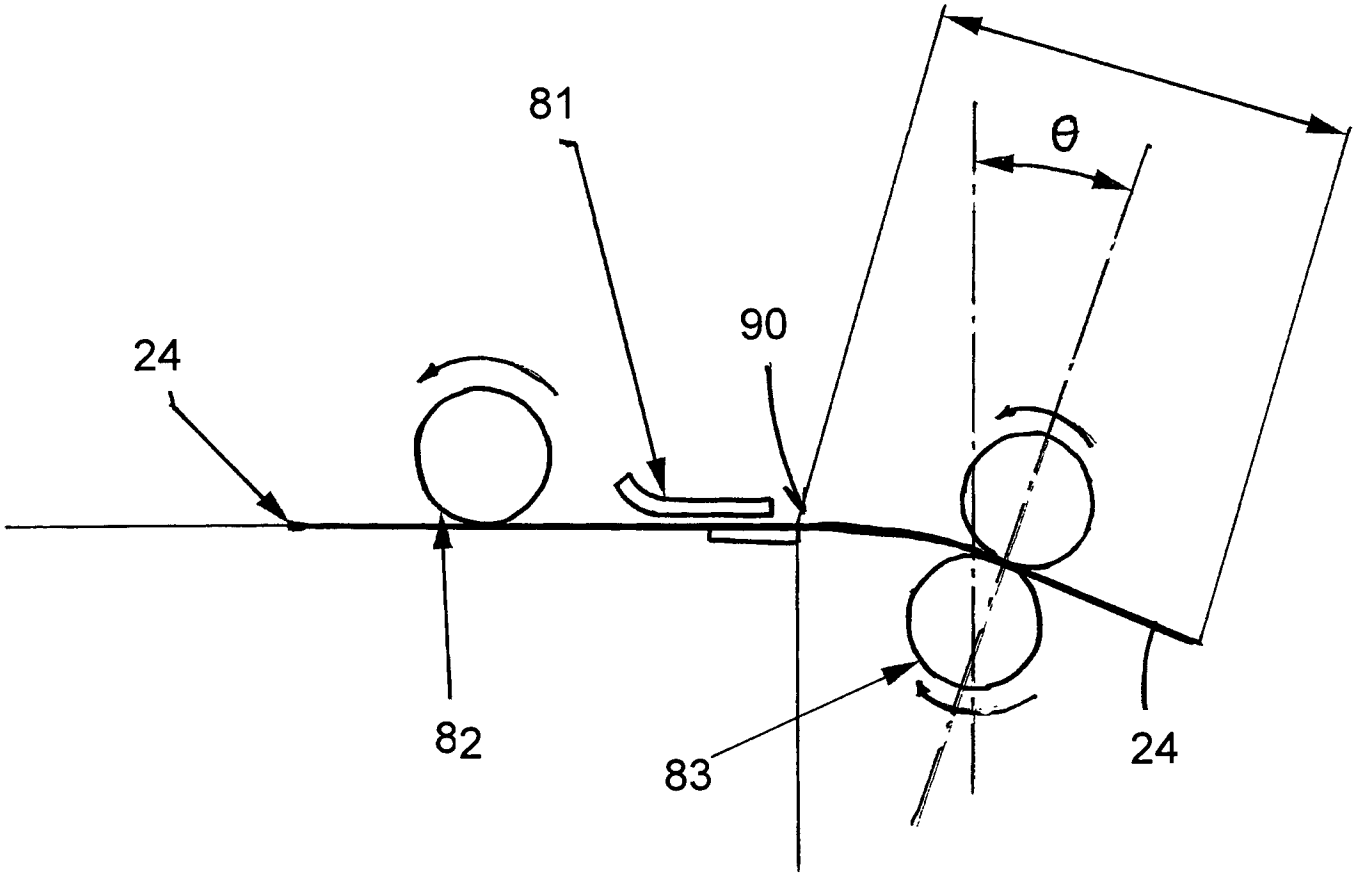
FIG. 9 is a schematic side view lateral cutting means according to the preferred embodiment.
Figure 10:
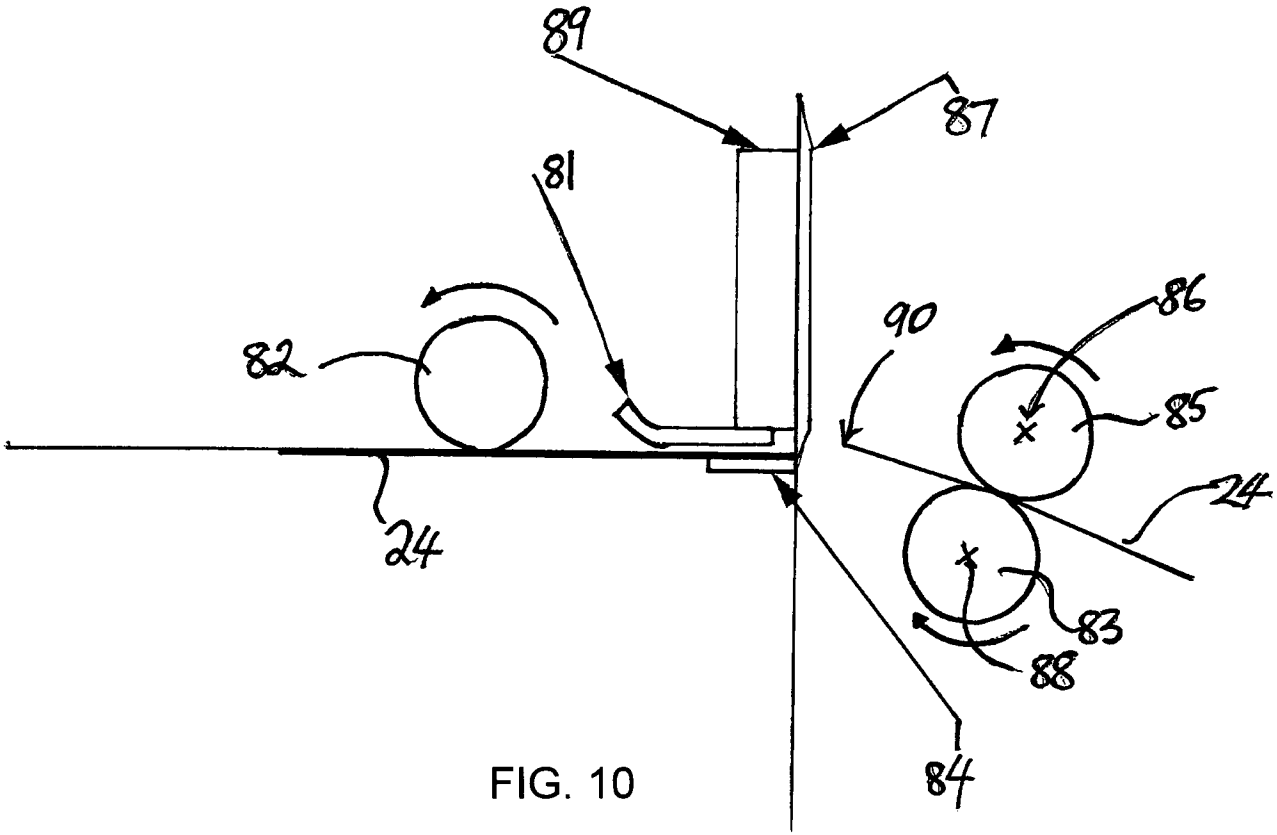
FIG. 10 is a schematic side view of the lateral cutting means showing detail of a slitting blade.
Figure 11:
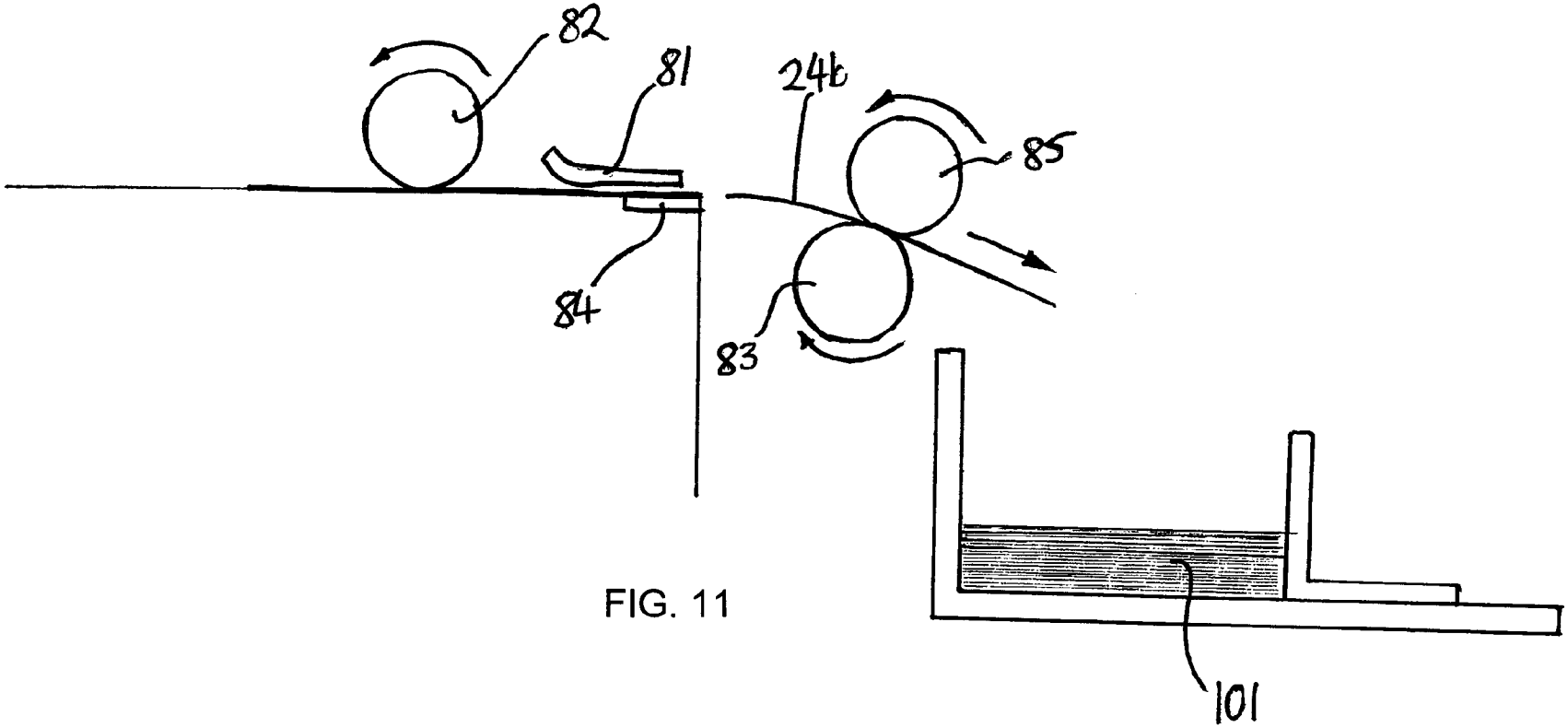

The longitudinally cut sheet 24*a*, slit along its centre line 41, is conveyed by rolls 62 to the lateral cutting means 80 shown in FIGS. 9-11. The lateral cutting means 80 is adapted to cut the two halves of cut sheet 24*a* to the correct length using the datum as the reference point logged by the sensors 31*a,b* in conjunction with the CPU. The slit sheet 24*a* is fed through a transverse slitting support guide 81 by a driven rubber, roller 82 to the extent calculated by the number of predetermined motor 92 steps relative to the datum and/or as determined by the settings entered by an operator to the CPU controlled computer. The cut sheet 24*a* passes through a pair of elastomeric, rollers 83,85 located on the other side of the transverse slitting edge 84 located immediately below the slitting support guide 81.

The external pair of rollers 83,85 are directly in contact with each other, or indirectly, when interposed by the cut sheet 24*a*. The top roller 85 is driven with its rotational axis 86 located slightly further away from the slitting edge 84 relative to the axis of rotation 88 of the lower roller 83. When the cut sheet 24*a* has been led past the slitting edge 84 by the correct length, the cut sheet 24*a* is preferably stopped to best perform the transverse cutting operation. Although the skilled reader will appreciate that arrangements are possible where the cut sheet 24*a* is constantly in motion and laterally cut by a guillotine rather than a rolling blade as described below.

As the cut sheet 24*a* proceeds past the slitting edge 84, the transverse slitting assembly 80, including a slitting blade 87 and an elastomeric rubber pressure roller 89, is drawn across a determined lateral cutting line 90. As alluded to above, an alternative to this rolling blade is arrangement 87,89 is a vertically displaced guillotine arrangement which may permit the cut sheet 24*a* to be in constant motion, although greater accuracy in the cutting length of the paper 24 may be achieved by stopping the motion of the cut sheet 24*a* immediately prior to effecting the lateral cutting action. In this arrangement, the rubber pressure roller 89 contacting the slitting support guide 81 is effective to hold the cut sheet 24*a* flat whilst the lateral slitting operation is effected forming a laterally cut sheet or strip 24*h*.

With regard to FIG. 11, the stacking means 100 is shown. The laterally cut strip 24*b* is fed into a stack 101 of similar strips 24*h* stored in a stacking table or rack 103 that has a front fixed wall 107 and an adjustable rear wall 102 to accommodate different sized cut strips 24*b* terming a uniformly sized stack 101 of cut strips 24*h*. The laterally cut strip 24*b* is driven free of the outer pair of rollers 83,85 and allowed to fall onto the stack of cut strips 101 below it with the adhesive bearing strip along its inner longitudinal edge uppermost.

Figure 12A:
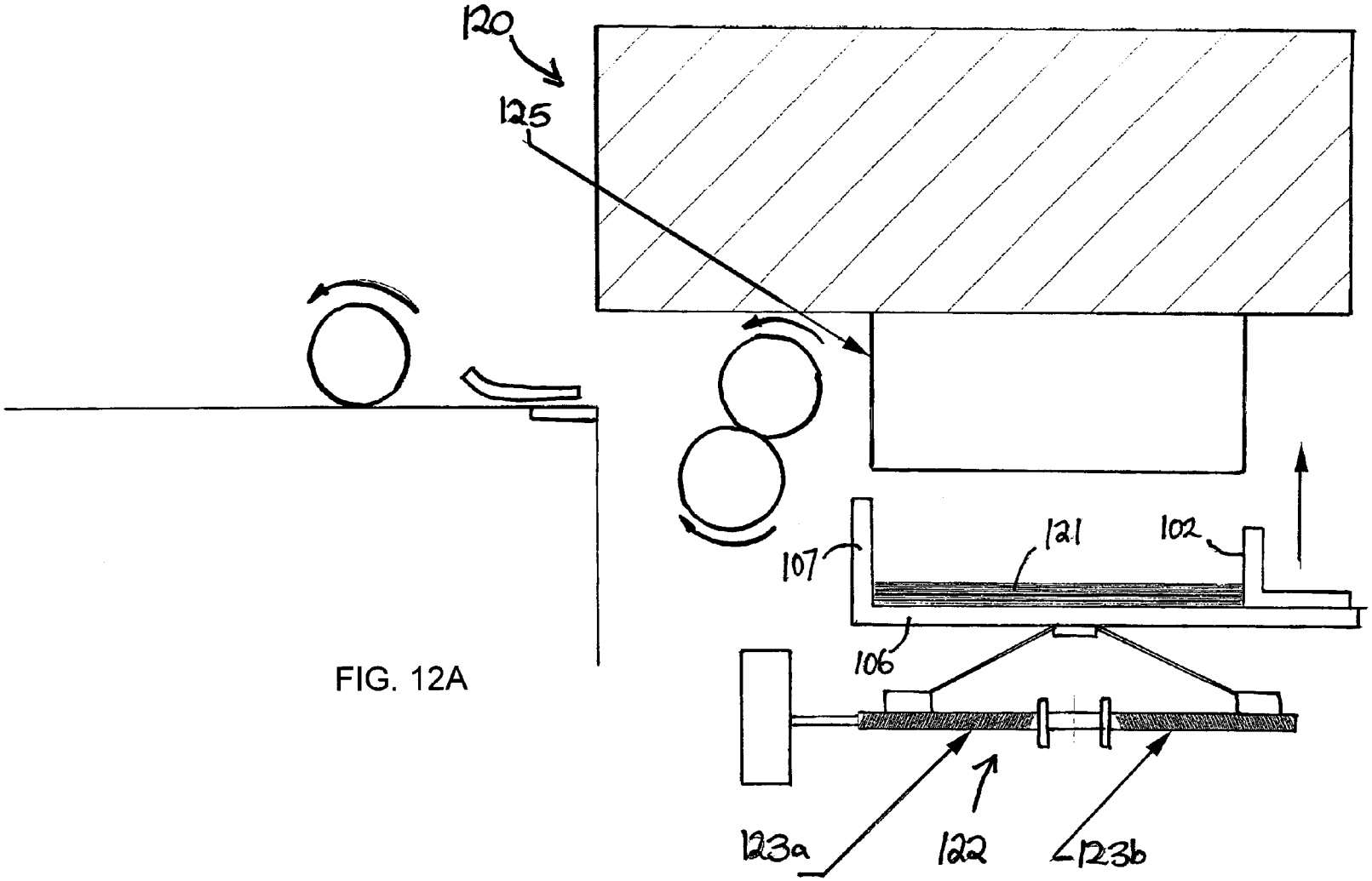
FIG. 12*a* is a schematic side view of the stacking means and a pressing means shown in open position.
Figure 12B:
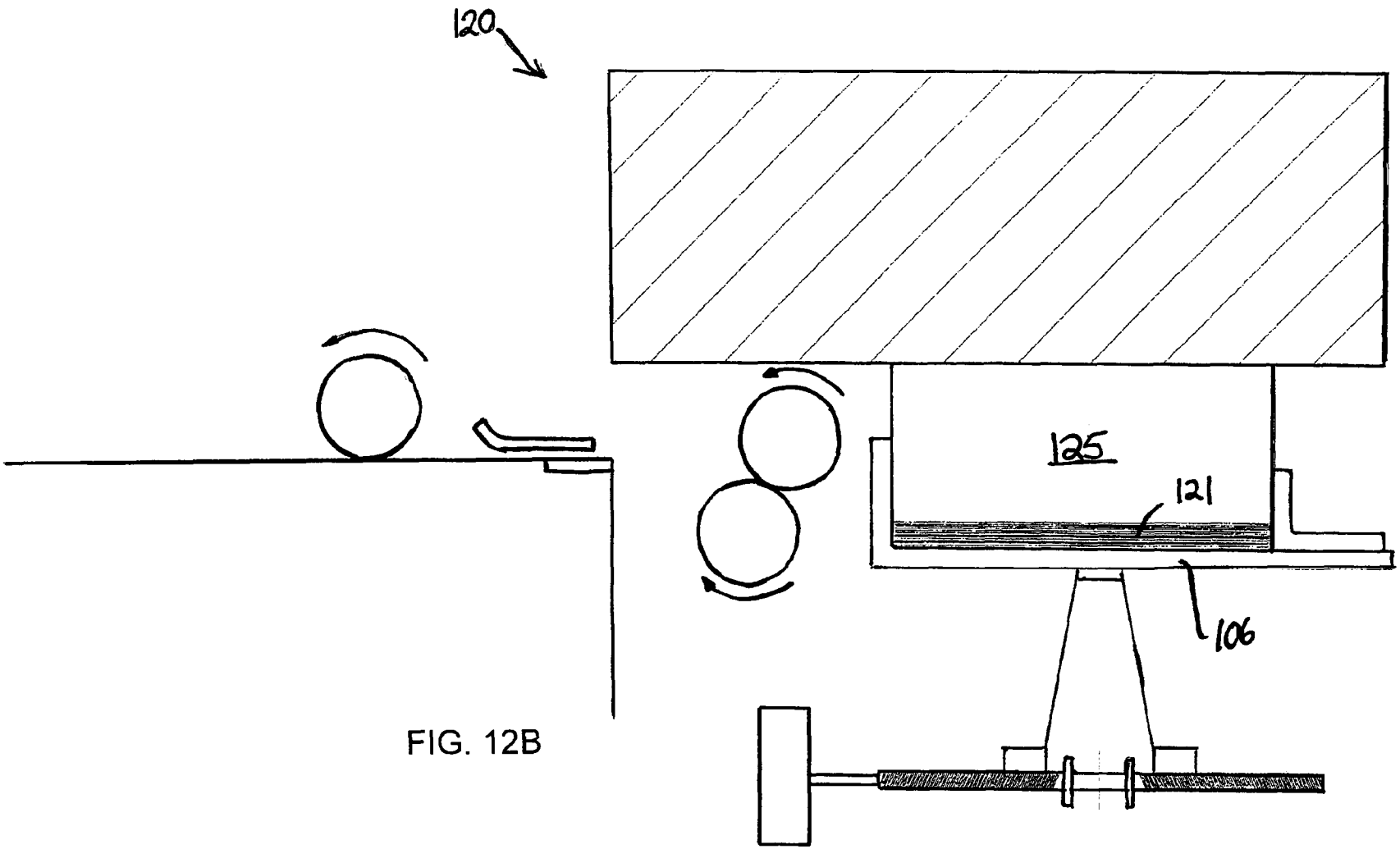
FIG. 12*b* is a schematic side view of the pressing means in closed position.

With reference to FIGS. 12 and 13, the cut strips 24*b* are compressed by the pressing means 120 to term a notepad 121. Once a sufficient and predetermined number of cut strips 24*b* have collected forming the stack 101, a platform 106 forming the floor of the stacking rack 103 is raised by a scissor lift 122 having right and left hand threaded lead screws 123*a,b* and pressed against a fixed barrier 125 to cause the adhesive on each upper strip surface to stick to the immediately adjacent underside surface of the next-above strip 24*b* to form the notepad 121. The pressing operation may be performed immediately following each new deposit of a cut strip 24*b* onto the stack 101 whereby to incrementally form the compressed stack that, in turn, forms the notepad 121. Alternatively, the pressing operation can be performed at predetermined intervals, such as when the uncompressed stack 101 is becoming too high to feed a new cut strip onto the stack 101.

Figure 13B:
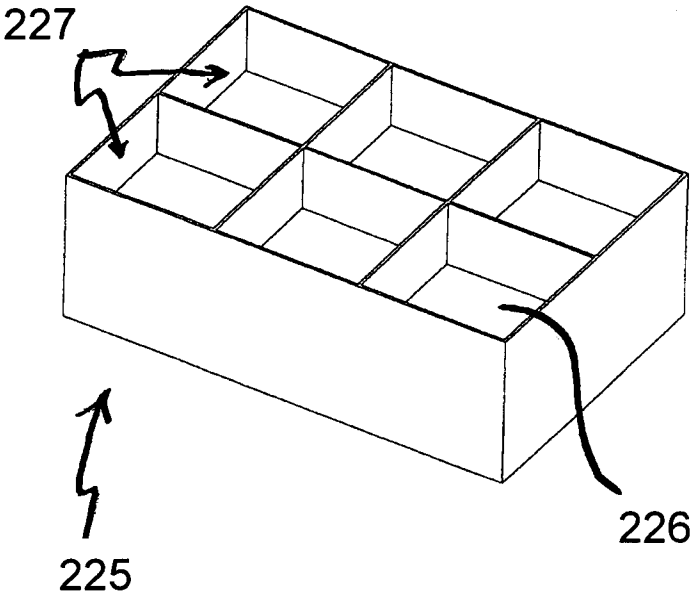
FIG. 13*b* is a perspective view of an empty stacking means shown in FIG. 13*a;*
Figure 13A:
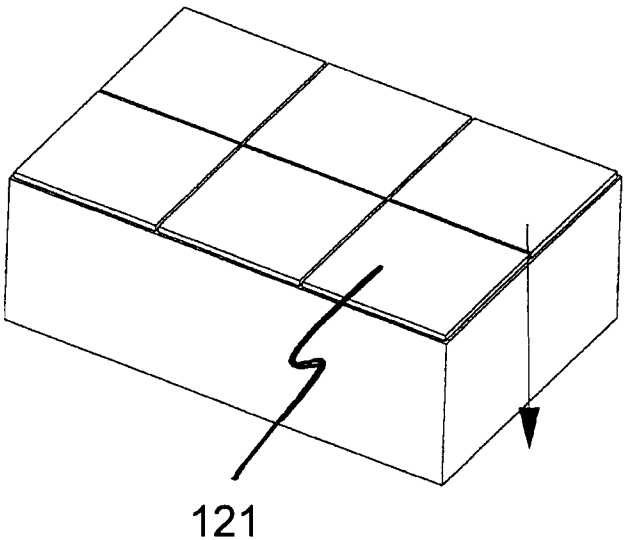
FIG. 13*a* is a perspective view of a stacking means containing cut sheets.

In FIG. 13*b* there is shown a stacking mechanism 225 in which the floor 226 is sprung or floating to permit the floor 226 to index down with the accumulation of paper in each cassette or discreet section 227. FIG. 13*a* specifically shows cut sheets each forming a stack 121. The stacking mechanism 225 is suitable for receiving sheets 24 longitudinally cut by duel spaced blades such as the blades 143 shown in FIG. 6*a*.

Figure 13C:
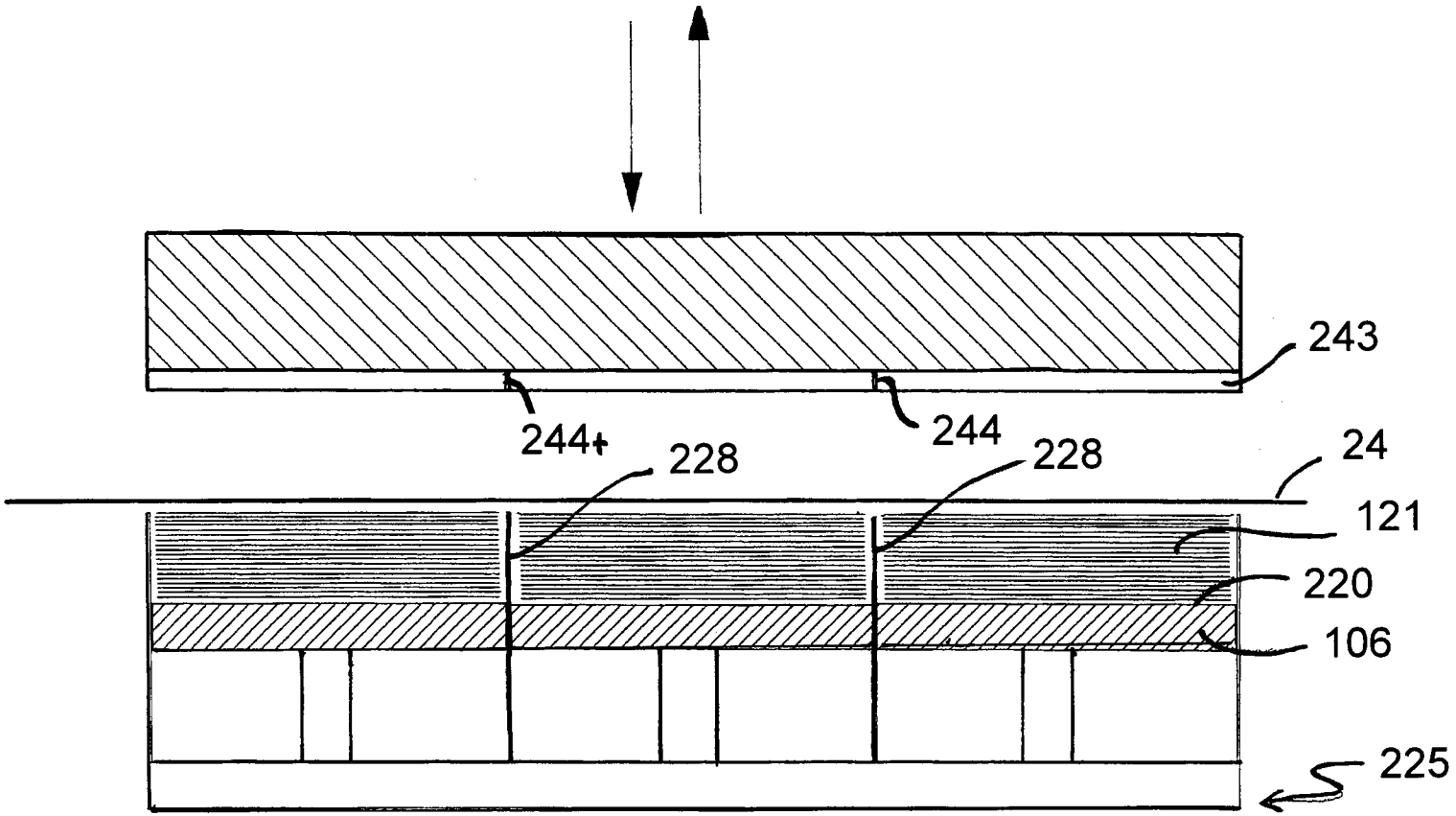
FIG. 13*c* is a schematic end view of a cutting and stacking means according to an embodiment of the invention.

In FIG. 13*c*, the cassette stacking box 225 is shown with its sprung floor 226 each supported on a platform 106. A punch blade 243 having slots 244 corresponding to the internal walls 228 of the stacker box 225 to ensure that the blade 243 cuts the paper 24 without interfering with the walls 228, the paper 24 being supported for the punching-cutting operation by the platform 106 and/or the previously cut sheets already stacked in stack 121. The stack 121 is supported on the sprung floor 226 that indexes down against the bias of the sprung floor 226.

Figure 13D:
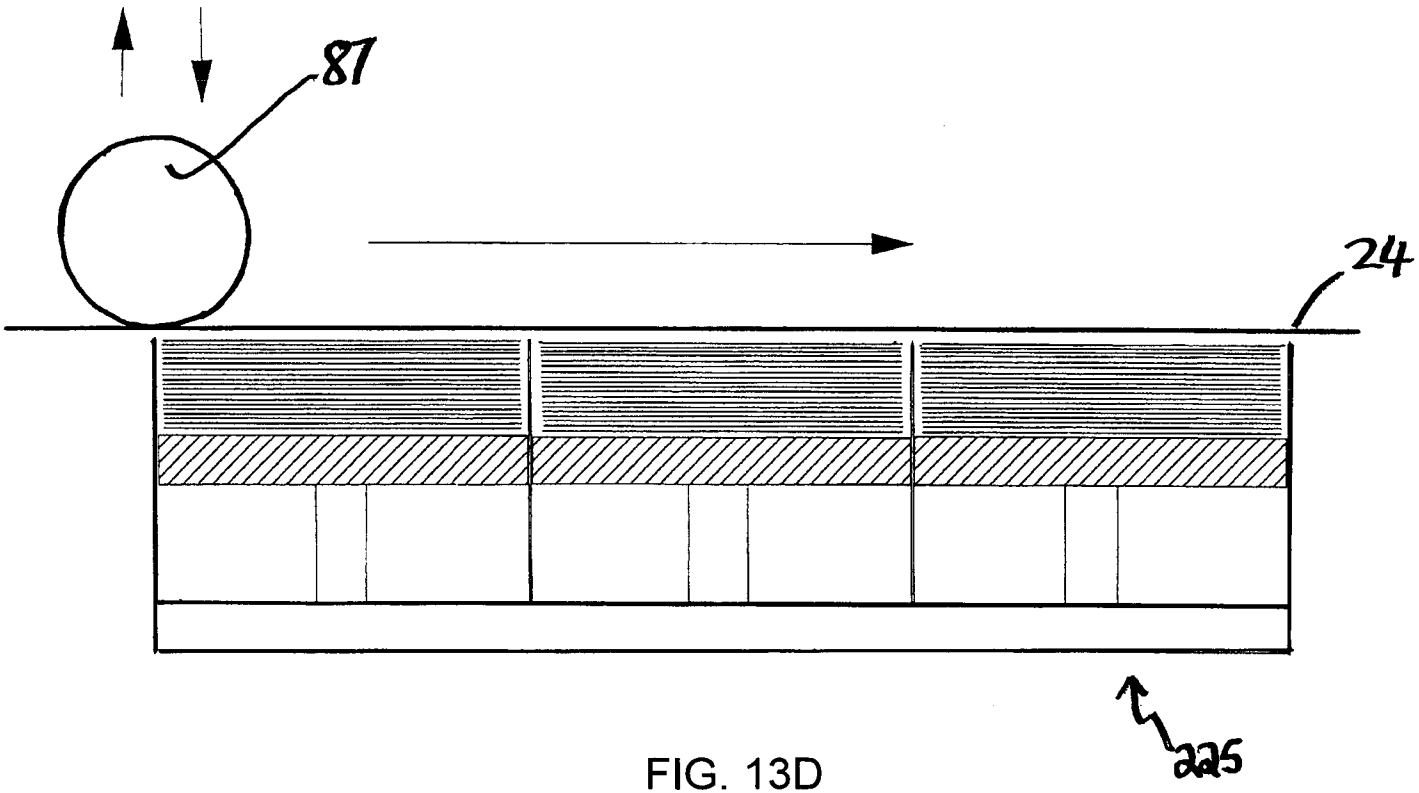
FIG. 13*d* is a schematic end view of a cutting and stacking means suitable liar various embodiments of the present invention.

Referring to FIG. 13*d*, the paper 24 fed into the stacker mechanism 225 is transversely cut by transverse cutting means 87 in the form of a rolling blade, the blade 87 cutting against the shearing edge of the frame 84 (not shown). In this arrangement a roller 82 first feeds the paper 24 partially past the transverse cutting means 87 before the rolling cutting blade 87 is lowered to effect a transverse run across the sheet 24 to effect the transverse cut.

Figure 14:
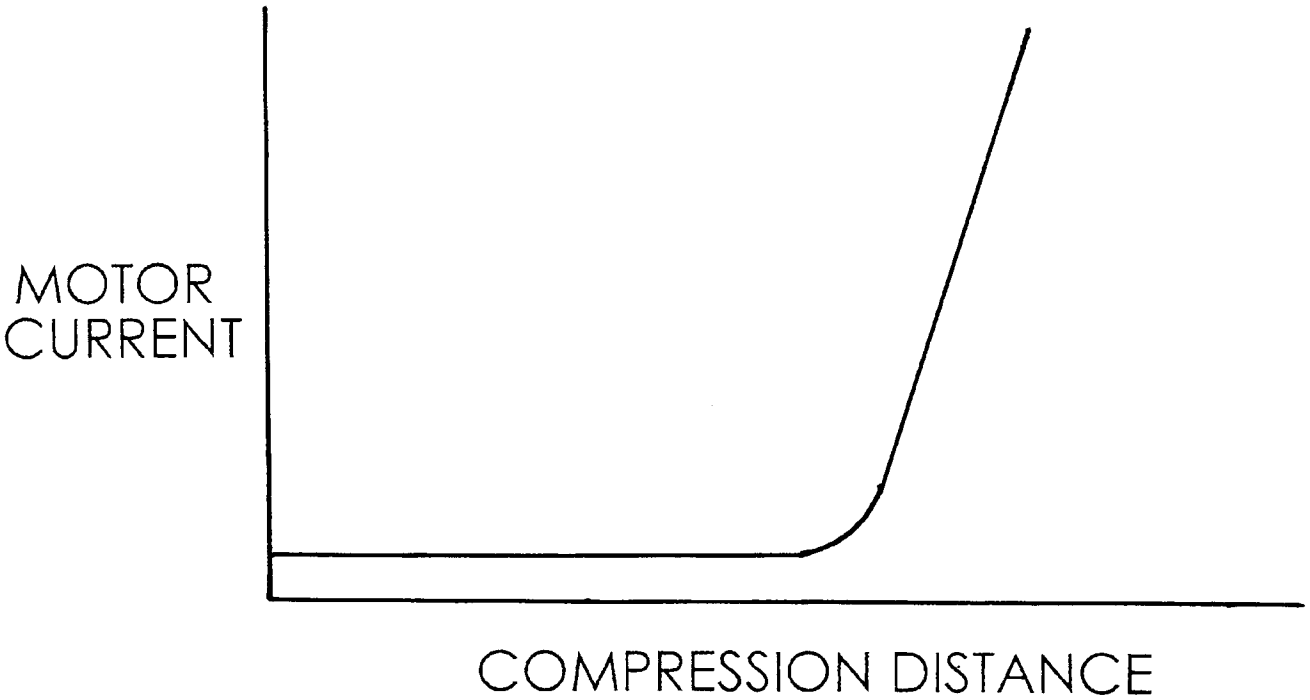
FIG. 14 is a graphic representation of motor current verses compression distance of the pressing means and motor thereof.

FIG. 14 demonstrates the relationship between the current required to drive the scissor lift 122 and the compression distance between the rack floor 106 and the barrier 125. It indicates that compressing the loosely packed sheets 24*b* require little work, but as the stack 101 becomes compacted, further compression is not possible without large compressive forces and the motor current required increases dramatically.

Once the notepad 121 has been formed, the stack rack 103 may be lowered, the notepad removed from the stack rack 103, for example by an operator, and the cycle of notepad production re-started.

Figure 15:
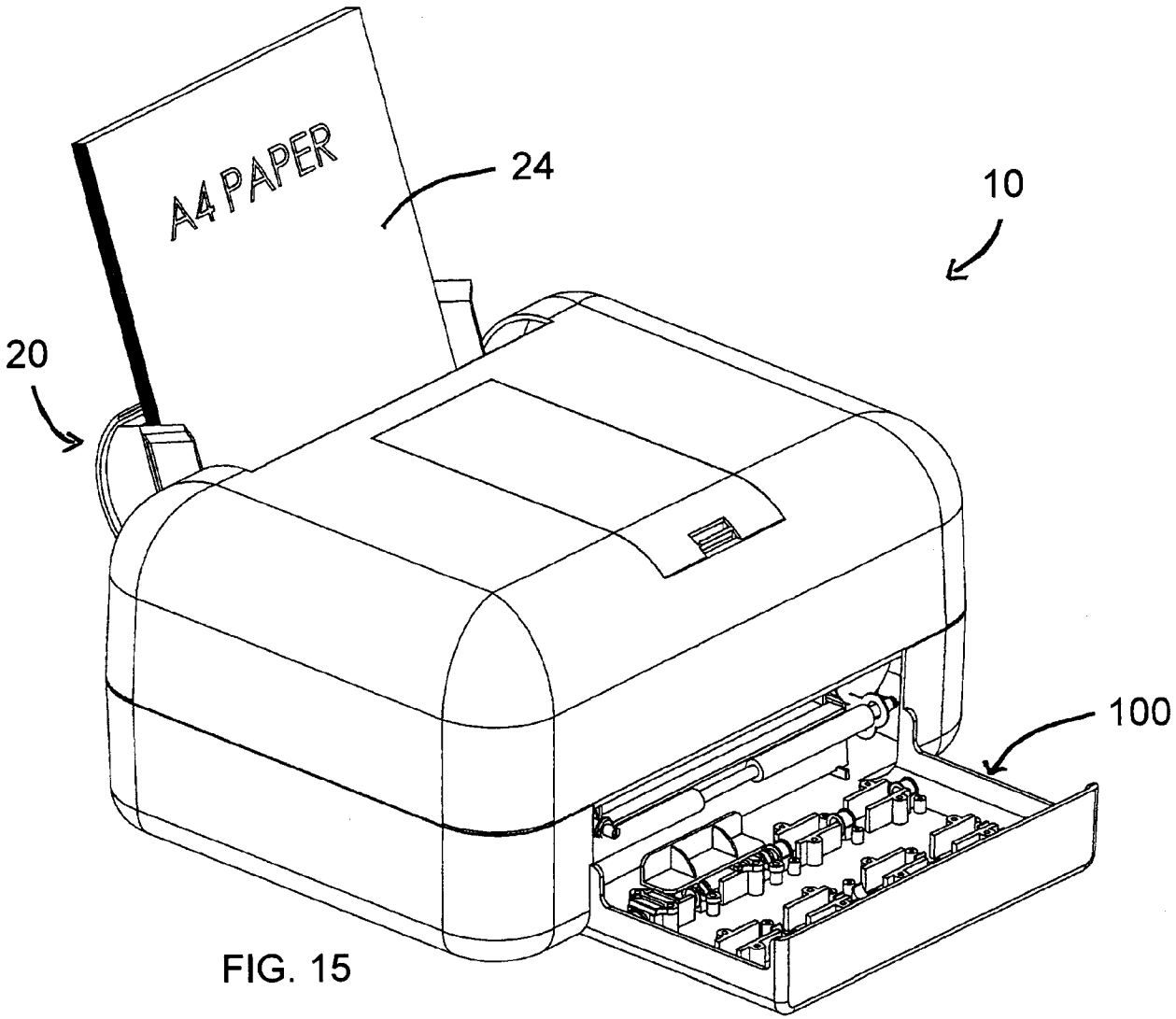
FIG. 15 is a perspective view of the device according to the preferred embodiment.

In FIG. 15, the device 10 is shown in complete form with A4 size paper 24 stacked in the feeder 20 ready for processing.

Figure 16:
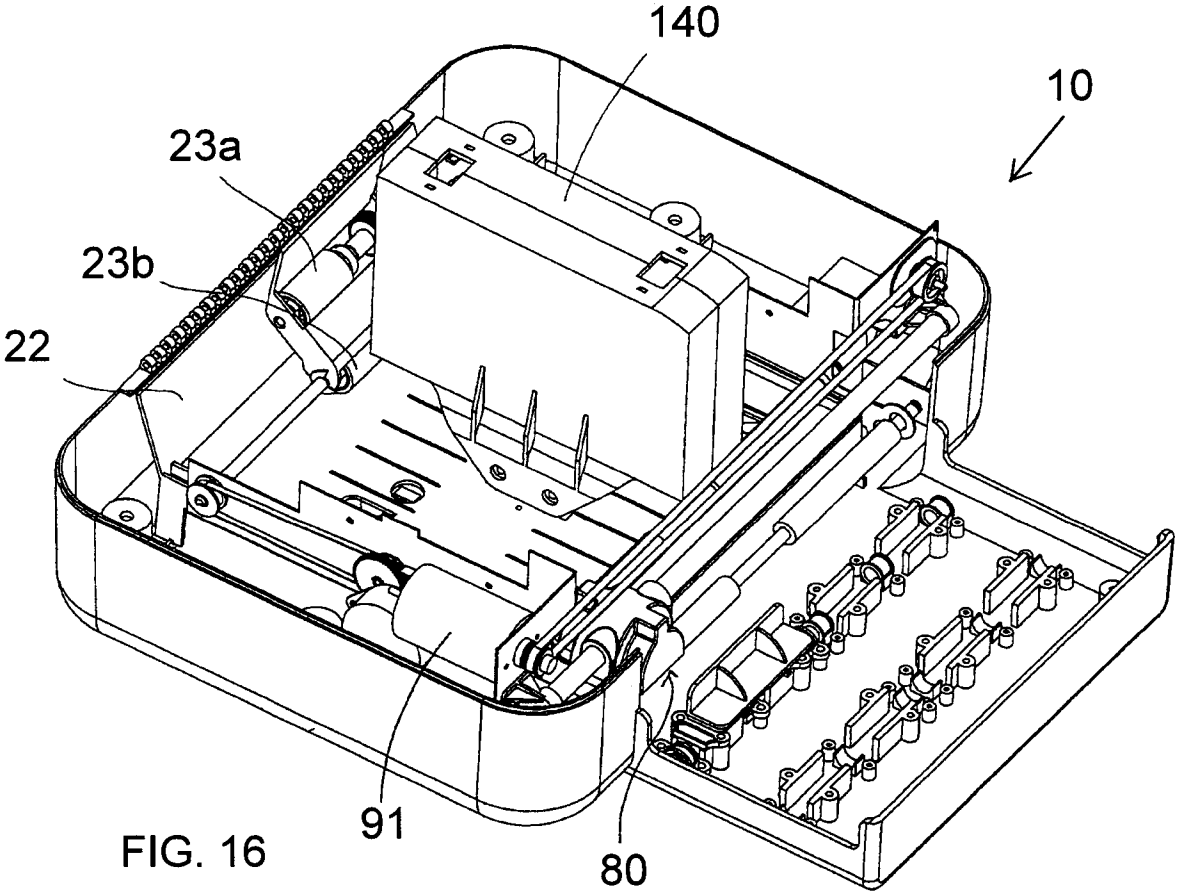
FIGS. 16 and 17 are perspective views of the device with the top covers removed.

In FIG. 16, the drive motor 91 for the lateral cutting means 80 is shown. The central module 140 houses the above body panel components of the alignment correction means 30, longitudinal cutting means 40 and adhesive applicator 60.

Figure 17:
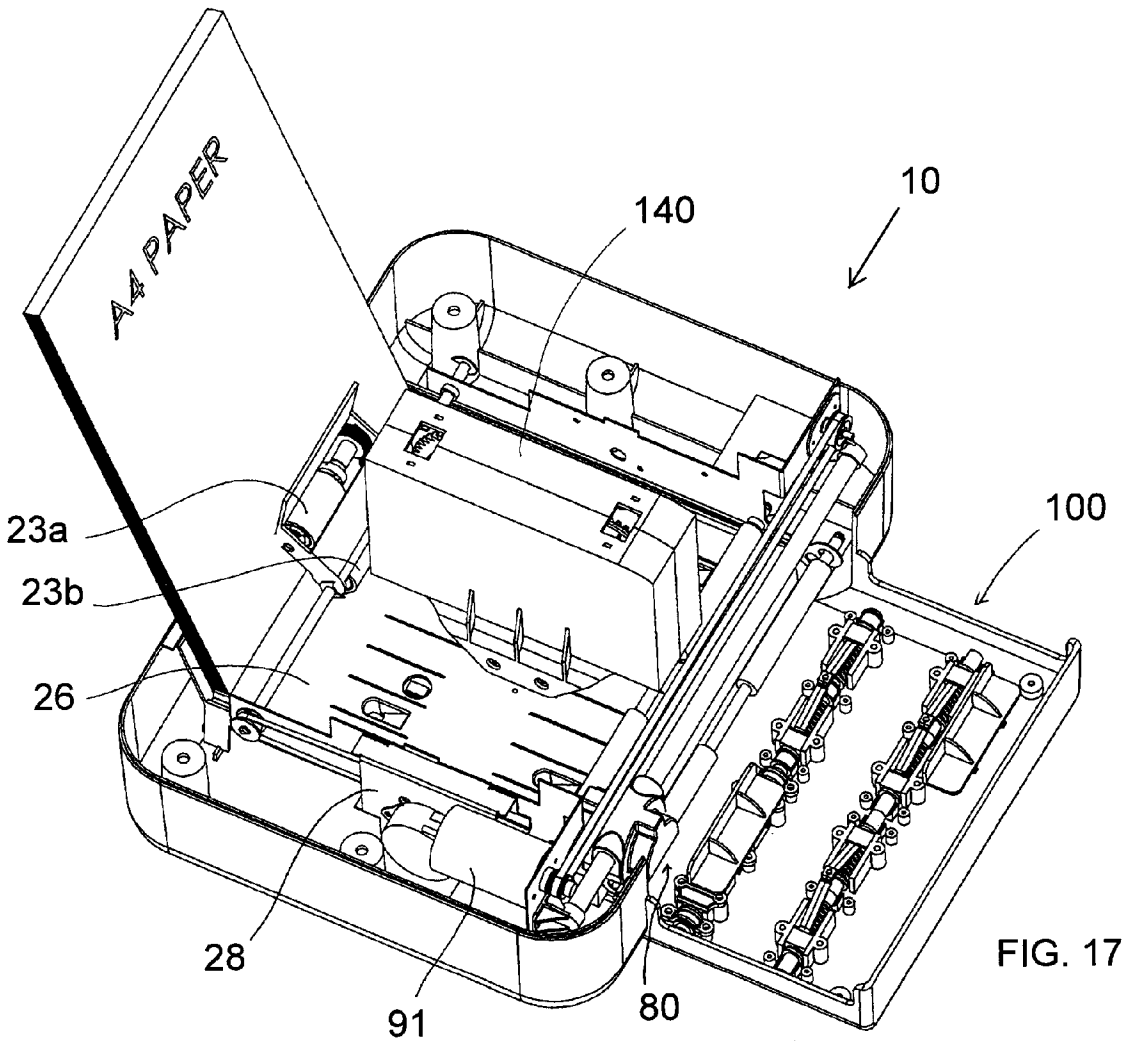

In FIG. 17 the stacking means 100 may include a stacking rack (not shown) resting above the scissor lifts 122. The drive motor (obscured) for rollers 23*a,b* is located behind vertical side panel 28 and under body panel 26.

Figure 18:
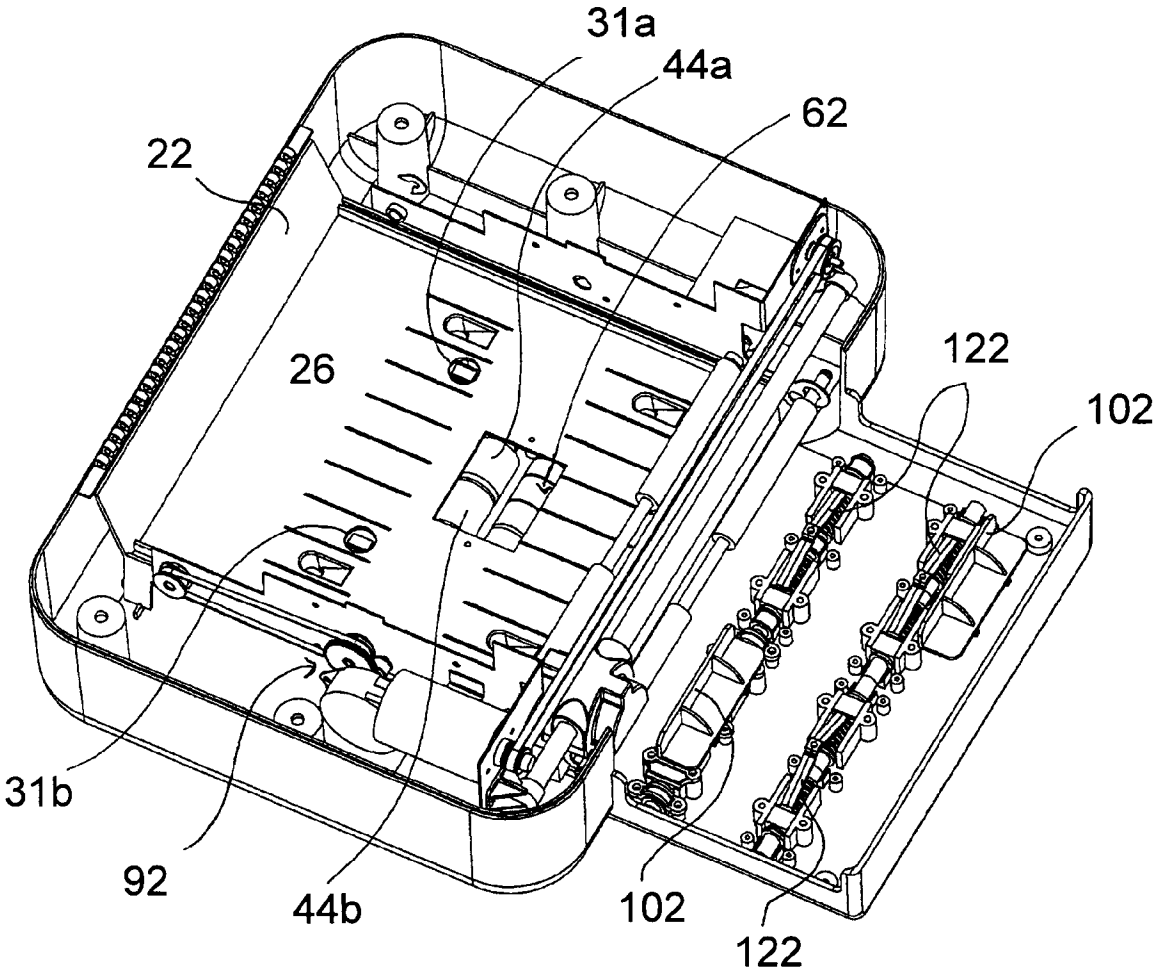
FIGS. 18-21 are perspective views of the roller mechanisms and drive motors with upper components of the device removed.
Figure 19:
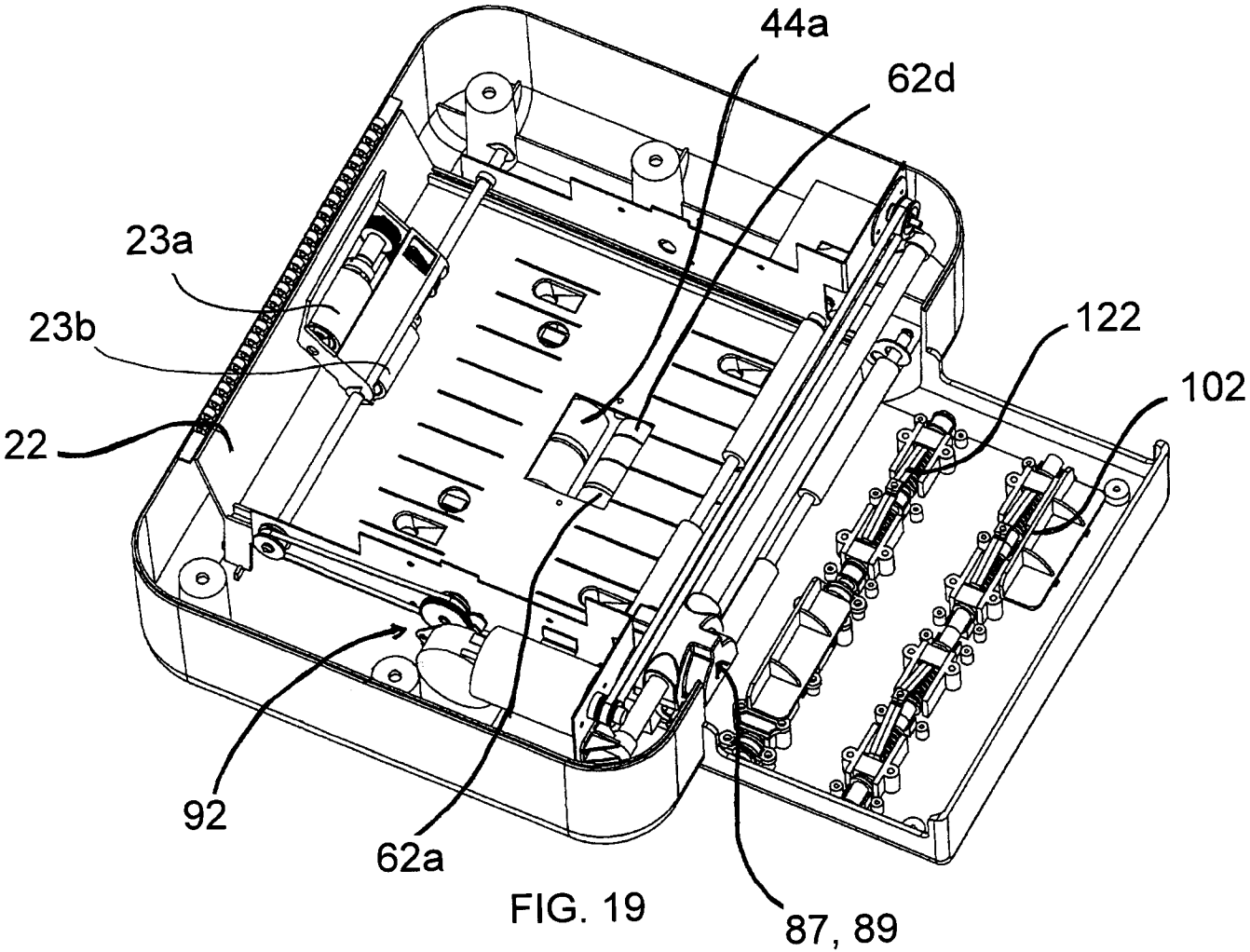
Figure 20:
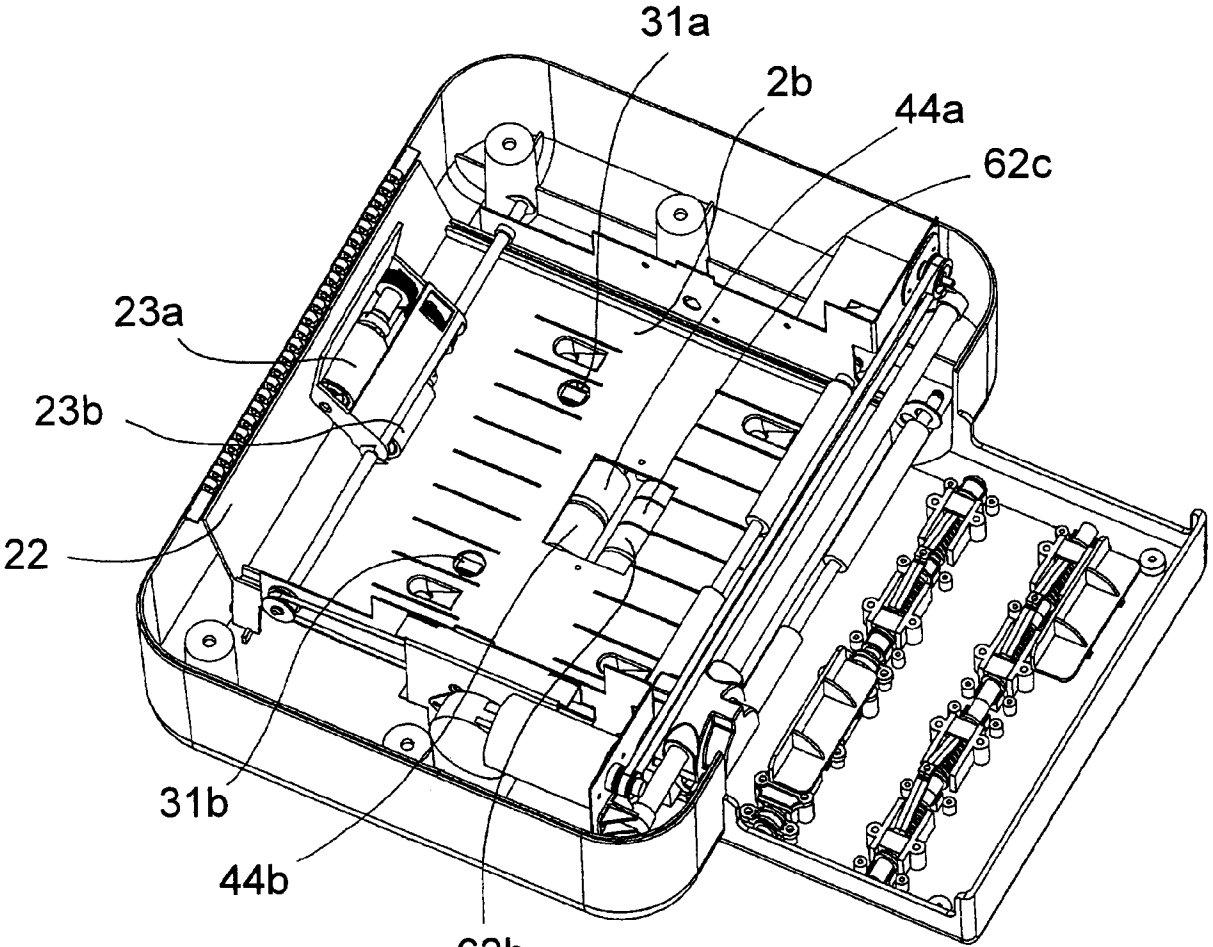
Figure 21:
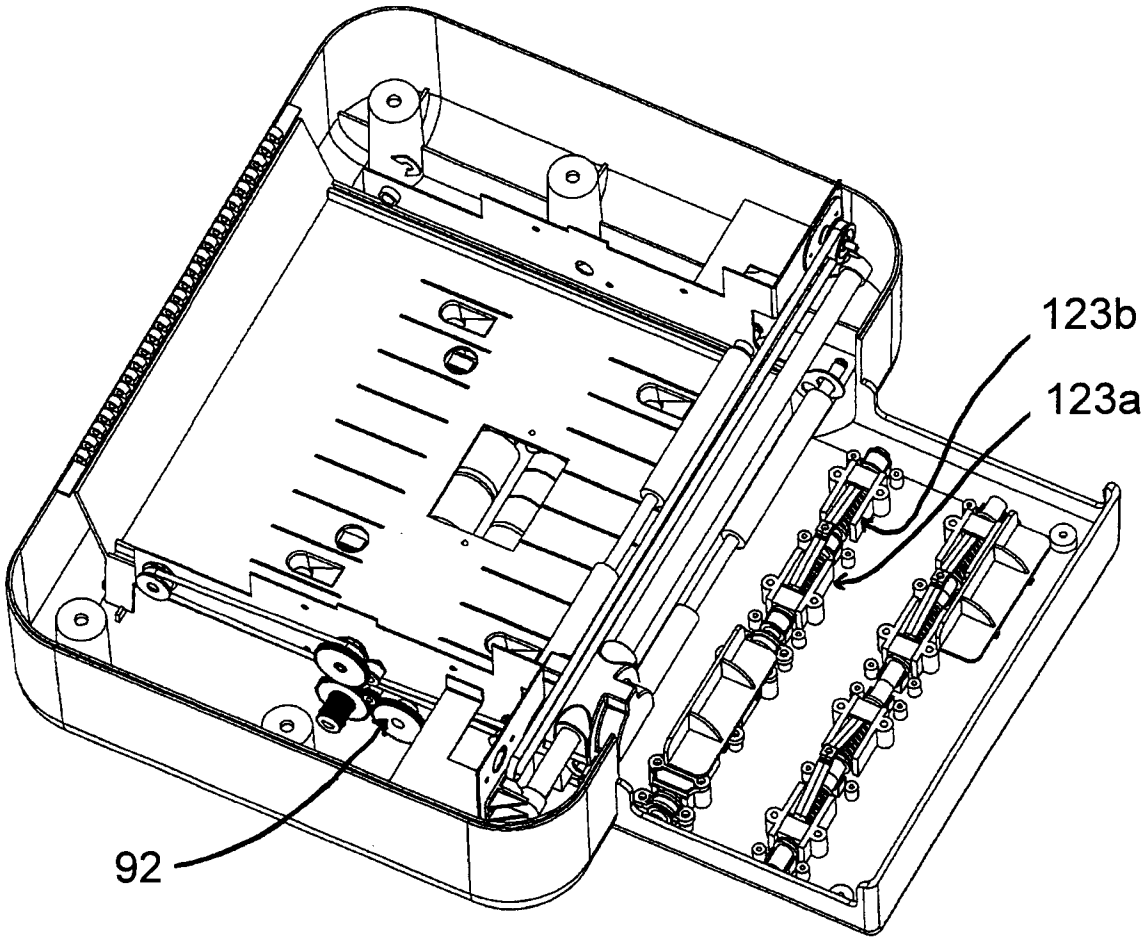
Figure 22:
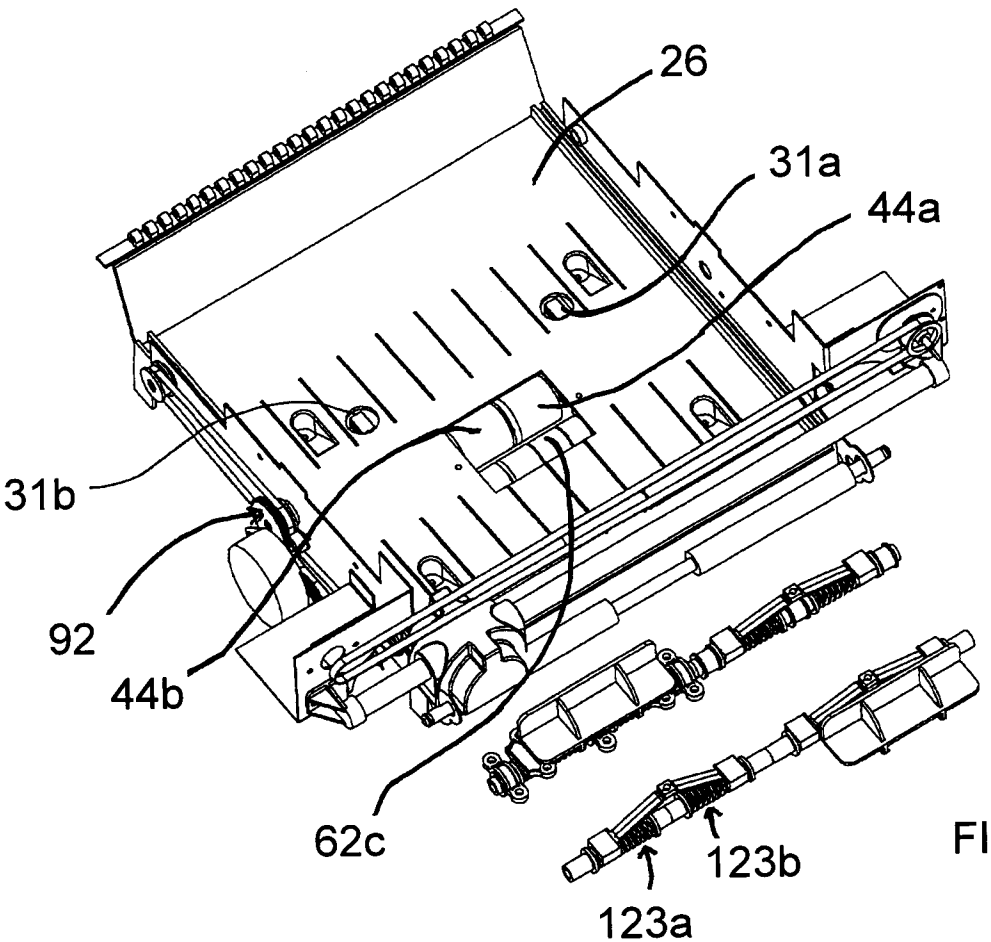
FIG. 22 is a schematic exploded perspective view of the drive mechanisms of the device of the preferred embodiment.
Figure 23:
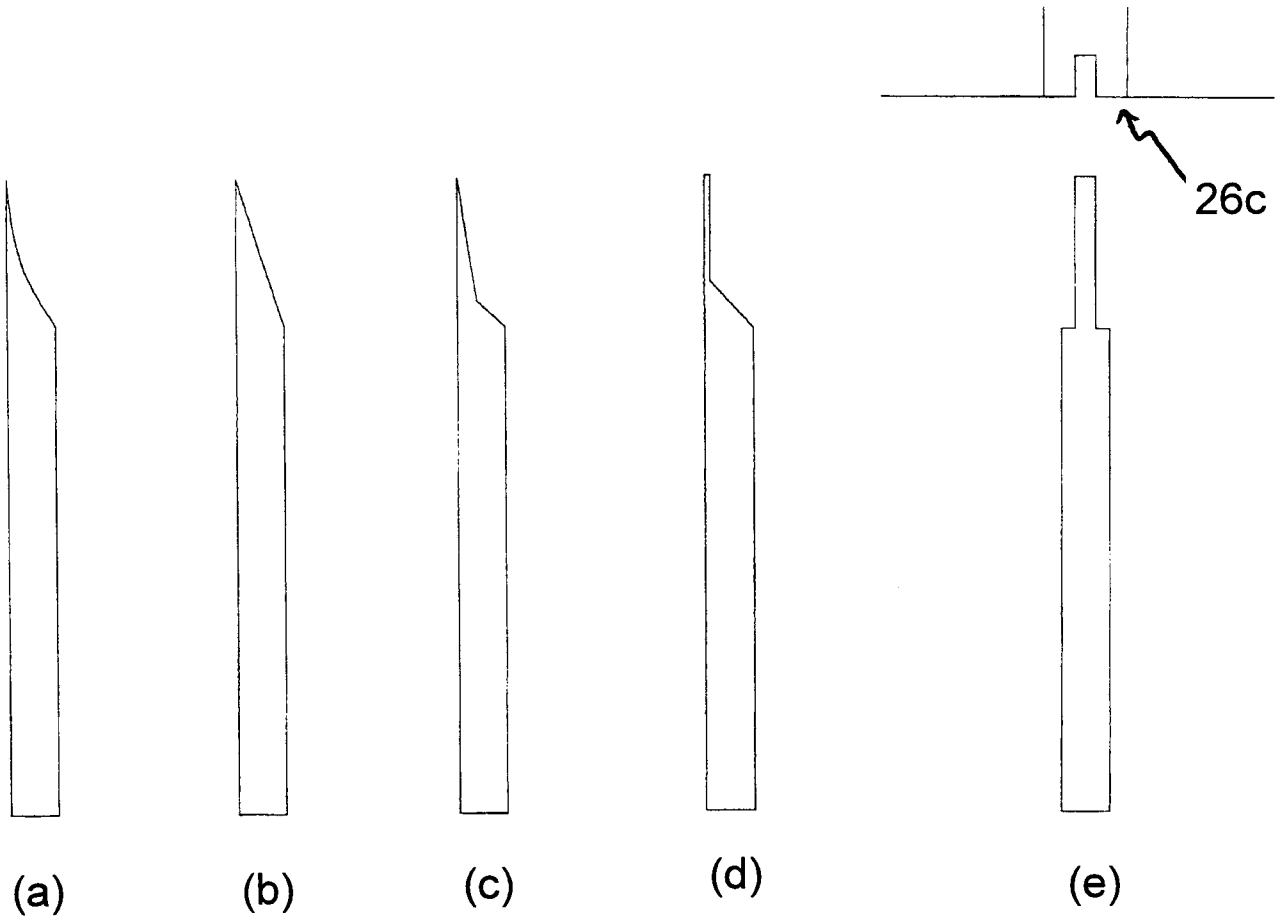
FIGS. 23*a*-23*e* are schematic side views of various punch blades suitable for use in various embodiments of the present invention.

In FIG. 18, the pinion gearing 92 is driven by a motor (obscured) that, in turn, drives rollers 44*a,b*.

In FIGS. 16 and 18-22, the adjustable wall 102 of the stacking rack and the scissor lift screws 122 including lead screws 123*a,b* are shown in various arrangements. As shown in FIGS. 18-22 and particularly FIG. 22, the sub-structure of the device 10 under the body panel 26 includes the photodiode sensors 31*a,b*, and rollers 44*a,b* and 62*a-d*.

Referring finally to FIGS. 23*a-e*, there is shown a variety of different punch blade shapes that may be usefully employed in the transverse or longitudinal cutting operations of the various pad forming devices, and particularly the longitudinal and/or lateral cutting means herein described. In each a complimentary slot, recess or other shearing edge 26*c* an example being shown in FIG. 23*e*) may be advantageously provided.

The devices shown and described herein, including devices 10-10*f*, may be made from standard-materials typically associated with office equipment such as printers, photocopiers and scanners. The knife or blade components 42,45,84,87 are preferably made from stainless steel or tungsten carbide. The roller surfaces are preferably made from elastomeric polymer materials typically associated with paper feeder rollers found in printer and fax machine equipment.

The preferred pressure-sensitive adhesive for the sheets is an acrylate copolymer microsphere structured adhesive as disclosed in U.S. Pat. Nos. 3,691,140 (issued to Silver on Mar. 3, 1970) and 3,857,731 (issued to Merrill et al on Apr. 6, 1973). This type of adhesive allows for the removal or separation of the sheets and the repositioning of the dispensed sheets on different receptor surfaces without injury to the surfaces.

Within the meaning of this specification, a desk top device may be a unitary device such as a printer, fax machine or photocopier. For example, the desk top device may be small in size and no larger than 1.2 $m^3$, preferably less than 0.3 $m^3$ and still more preferably less than 0.2 $m^3$ in volume and/or has a foot print that is less than 1.2 $m^2$, preferably less than 0.5 $m^2$ and still more preferably less than 0.4 $m^2$.

Figure 35:
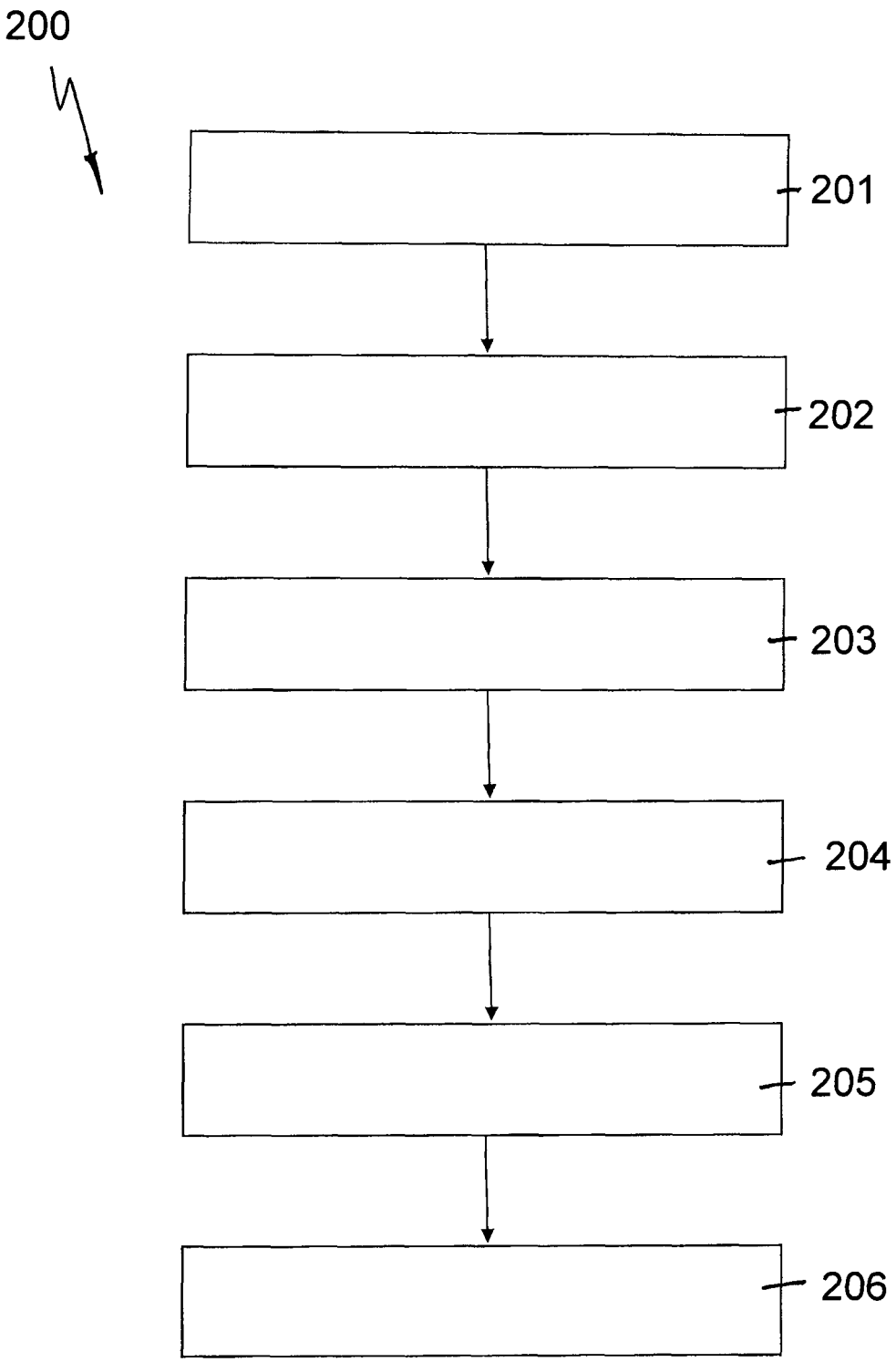
FIG. 35 is a flow chart showing a method of manufacturing a notepad in accordance with one embodiment or the present invention.

Referring to FIG. 35, the method 200 of forming a notepad according to a preferred embodiment of the present invention is shown. The method 200 comprises a number of steps as previously described.

In step 201, one or more sheets are loaded into the notepad forming device in a predetermined orientation. The sheets are then fed into the device in step 202 for processing. At step 203, the or each sheet is cut to a desired dimension by a cutting means in the manner as previously described. At step 204, adhesive is then applied to a portion of the cut sheet following which, the sheets are stacked into position in step 205. The stacked sheets are then formed into the notepad, whereby they are available to a user of the device for collection in step 206. The step of forming the sheets into a notepad may comprise pressing the sheets together top facilitate bonding of the re-positionable adhesive, when snob an adhesive is used with the method 200 in step 204. It will be appreciated that when non-repositionable adhesive is used the step of forming the notepad will not require a pressing step. Ti will also be appreciated that the order of the steps 201-206 may vary. For example, the cutting step 203 and the adhesive application step 204 may be performed in reverse order. Similarly, the collation step 205 and the formation step 206 may be performed in a single step.

The present invention also provides for a replaceable adhesive applicator cartridge for use with a notepad forming device 10 as described above. However, it will be appreciated by those skilled in the art that the replaceable adhesive applicator cartridge could be equally applied in relation to a variety of sheet processing devices that process planar sheets or fibrous material, such as paper and other print media, into bound documents.

Figure 24:
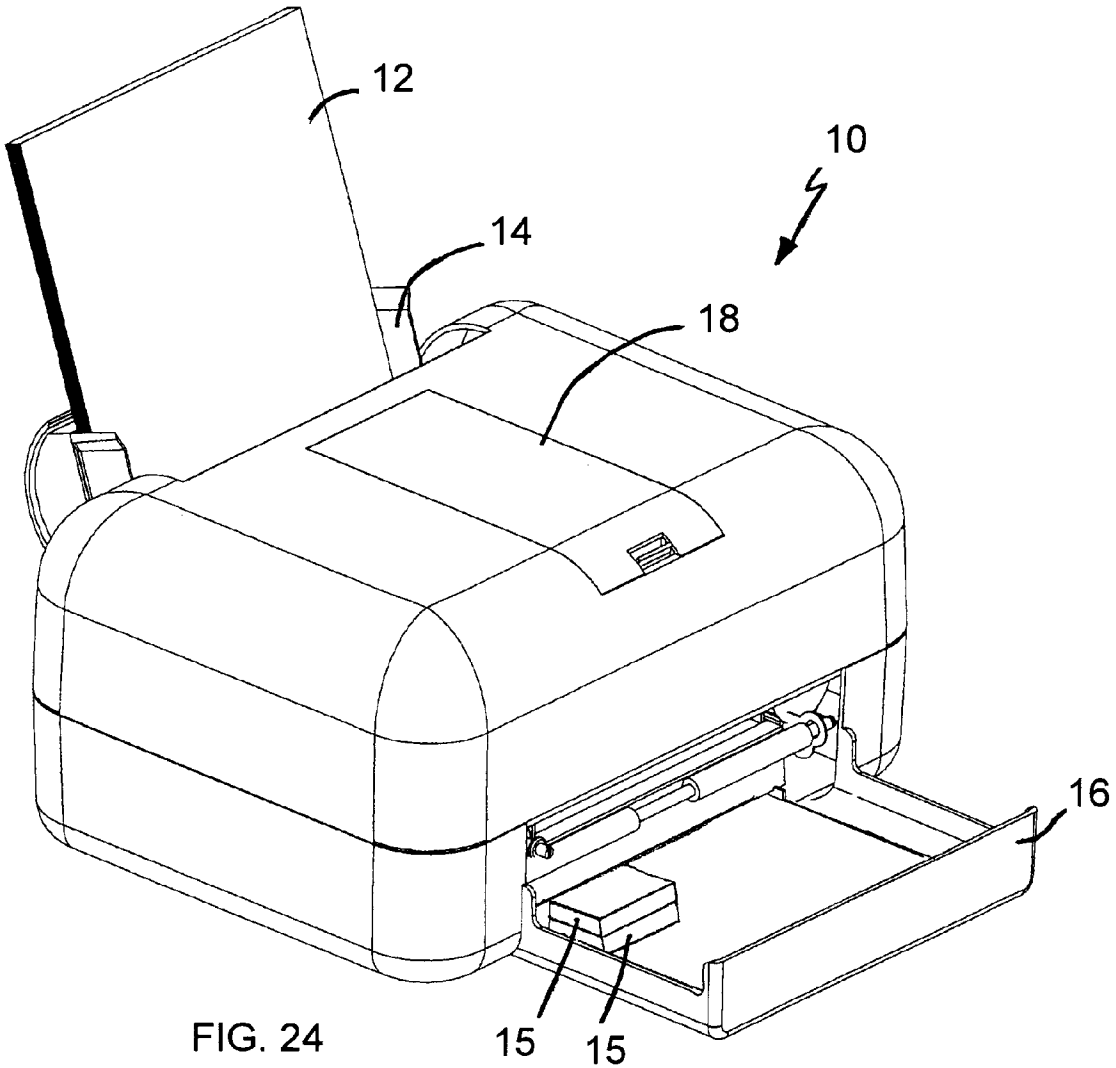
FIG. 24 is perspective view of a notepad forming device suitable for use with an adhesive applicator cartridge in accordance with the present invention.

Referring to FIG. 24, a notepad forming device 10 is shown. As discussed above, the notepad forming device 10 is a desk-top unit that receives a plurality of individual planar sheets 12 loaded into a sheet loading mechanism 14. The device 10 then processes the sheets 12 to form one or more pads 15 of processed sheets that are delivered to an output tray 16 for collection and use. The pads 15 formed by the device 10 comprise a stack of sheets of a size predetermined by the user. Each sheet is bound together to form the pad 15 by a suitable adhesive applied to a common edge of each sheet in the stack. As previously discussed, the suitable adhesive may be applied to an underside of each sheet such that when each sheet is stacked to form a pad 15, the adhesive binds the sheets together. It will be appreciated that the manner in which the sheets are bound together to form pad 15 may vary and still fail within the spirit of the present invention.

The size of the pads 15 formed by the device 10 may vary in accordance with the requirements of the user. To achieve a variety of pad 15 sizes, the device 10 includes lateral and longitudinal cutting means as described above; to cut the individual planar sheets 12 into a desired size. The longitudinal and latitudinal cutting means are controlled in accordance with instructions received by a user of the device.

The sheets 12 loaded into the device 10 are typically sheets of paper or similar print media. The sheets 12 may be A4 or foolscap sized sheets and may be printed on one or both sides, or may be virgin sheets of paper. The sheets 12 may be previously printed sheets of paper to facilitate the recycling or reuse of such paper into pads 15. It will be appreciated that the sheets 12 may also be in the form of sheets of cardboard, plastic or other polymeric material suitable for processing by device 10.

The processed sheets are bound together by an adhesive which is applied to one or more surfaces of sheet during processing. In this regard, the device 10 has one or more sheet handling members in the limn of driven rollers or the like which transport individual sheets 12 from the sheet feeding mechanism 14, through a cutting means and an adhesive applicator, to be delivered in the form of a pad 15 to the output tray 16.

The adhesive used to hind the processed sheets together into the pad 15 may vary depending upon the type of pad 15 required. To form pads 15 the type in which individual sheets can be removed and repositioned on another surface, such as a Post-It™ note pad marketed under the trademark "Post-It" by Minnesota Mining and manufacturing Company, St. Paul, Minn., the adhesive may be a low-tack or pressure sensitive adhesive. To form pads 15 having more firmly bound pages or sheets, a higher strength or permanent adhesive may be employed. In the event of a permanent adhesive being used in the device 10 individual sheets of the pad 15 may contain a frangible portion such a perforated region, to facilitate the removal of individual pages from the pad 15, during use.

The adhesive used by the device 10 may be interchangeable or replenishable through the use of a replaceable or replenishable adhesive applicator cartridge 50. The adhesive applicator cartridge 50 may be accessed by way of an access port 18 formed in a surface of the device 10. Upon accessing the adhesive applicator cartridge 50, the user may replace the cartridge 50, or replenish the adhesive contained within the applicator cartridge 50 where appropriate.

A variety of different types of adhesive applicator cartridges are shown in FIGS. 25-28.

Figure 25:
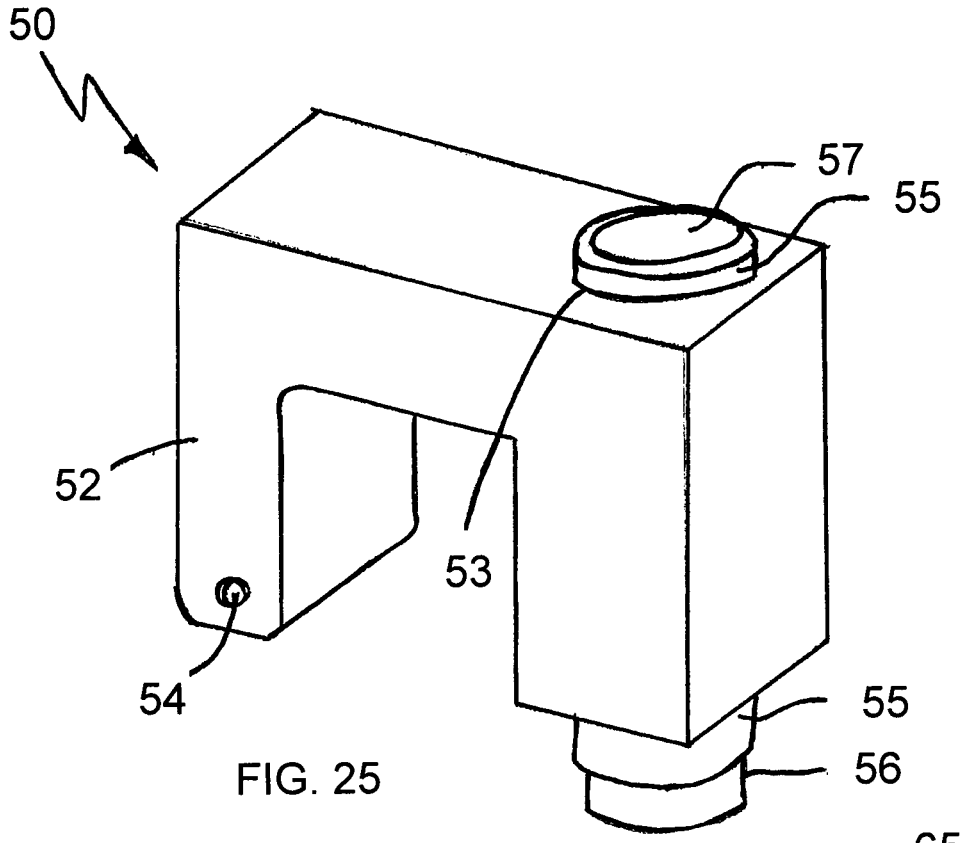
FIG. 25 is a perspective view of an adhesive applicator cartridge according to an embodiment of the present invention.

Referring to FIG. 25, a first type of adhesive applicator cartridge 50 is shown. The cartridge 50 comprises a body 52 that is shaped to be received within suitable recess formed in the device 10. The body 52 has a pivot point 54 fanned therein, to define a point about which the body 52 is able to pivot during use. The pivot point 54 may be in the form of a recess or indentation formed in the body 52 which receives a pin or lug (not shown) provided on the device 10 when the body 52 is mounted thereto. Alternatively, the pivot point 54 may be a lug provided to extend from the surface of the body 52 to be received within a corresponding recess provided in the device 10 when the body 52 is mounted thereto.

The body 52 has a bore 53 formed therethrough that receives a cylinder 55. The cylinder 55 is shaped to receive an adhesive 56 therein. The adhesive 56 is in the form of an adhesive stick, or similar elongate shape, and is inserted into the cylinder 55 and retained therein. A cap 57 may be provided on an end of the cylinder 55 to seal the end of the stick of adhesive 56.

The stick of adhesive 56 is received within the cylinder 55 such that it projects beyond a lower surface of the cylinder 55 as shown in FIG. 25. A control mechanism (not shown) may be provided with the housing 52 to control, longitudinal movement the stick of adhesive 56 within the cylinder 55. The control mechanism may be configured to appropriately advance the stick of adhesive as it is consumed during use, to ensure that a portion of the adhesive 56 constantly projects beyond the end of the cylinder 55. The control mechanism may also be configured to retract the stick of adhesive 56 within the cylinder 55 when not in use, and may also be configured to provide a warning signal to the user of the device 10 when the adhesive 56 requires replacement.

Figure 29A:
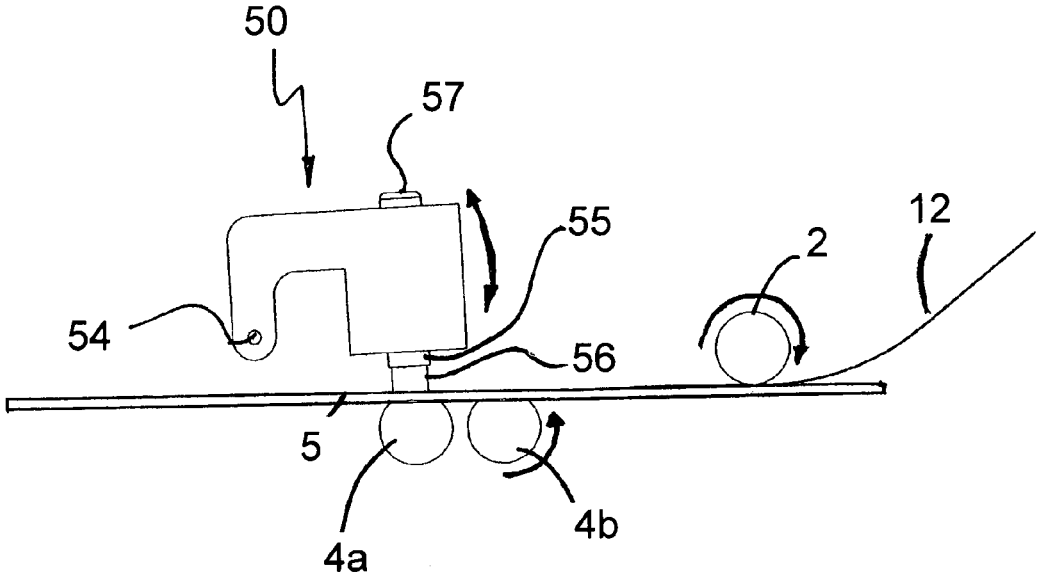
FIG. 29A is a side view of the adhesive applicator cartridge of FIG. 25 in an operating position during use.
Figure 29B:
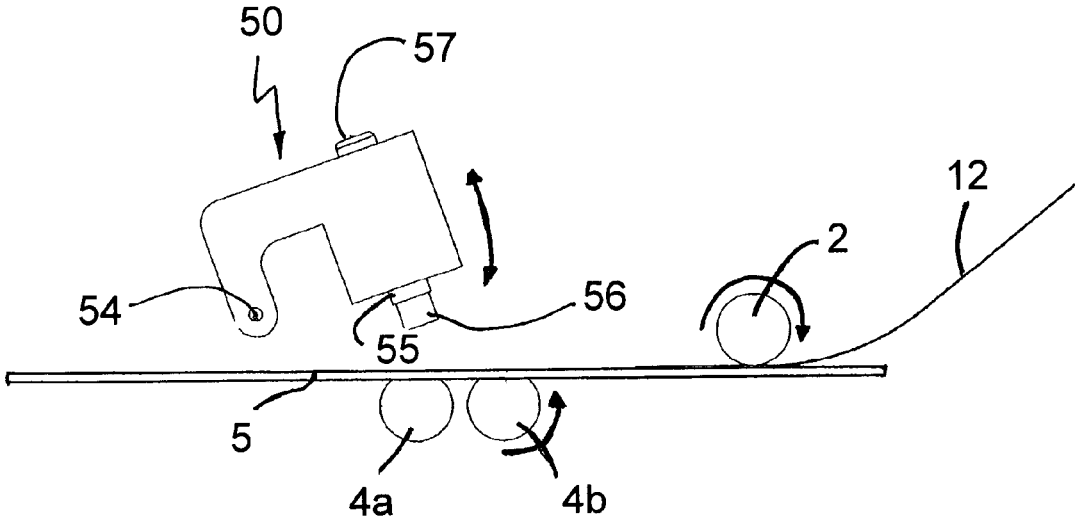
FIG. 29B is a side view of the adhesive applicator cartridge of FIG. 25 in an idle position during use.

Referring to FIGS. 29*a* and 29*b*, the adhesive applicator cartridge 50 in FIG. 25 is shown located within the device 10 for use. FIG. 29*b* shows the cartridge 50 in an idle position. In this idle position, cartridge 50 is pivoted away from transport surface 5, namely the surface upon which a sheet 12 being processed by the device 10 is transported. In such a position, the stick of adhesive 56 is unable to contact a sheet 12 passing thereby to deposit adhesive thereon.

Upon initiation of the device 10, the feed roller 2 feeds individual sheets 12 from the sheet loading mechanism 12 to advancement rollers 4*a* and 4*b*. Advancement roller 4*b* is a driven roller that is driven at substantially the same speed as the feed roller 2 to provide constant feeding of the sheets 12 past the adhesive applicator cartridge 50.

Upon detection of a sheet 12 being received by the advancement rollers 4*a* and 4*b*, the cartridge 50 is brought into an adhesive application position as shown in FIG. 29*a*. In this position, the sheet 12 is transported by advancement roller 4*b* and an edge of the driven sheet 12 is located between the end of the stick of adhesive 56 and the free advancement roller 4*b*. In this arrangement, adhesive is directly applied along an edge of the sheet 12 as the sheet 12 is advanced past the cartridge 50.

Upon detection of the sheet 12 progressing beyond the advance rollers 4*a* and 4*b*, the cartridge 50 is caused to pivot to its the idle position (FIG. 29*b*) to release the sheet 12. The cartridge remains in the idle position until a corresponding sheet 12 is detected in the region of the advancements rollers 4*a*, 4*b*.

It will be appreciated that one or more proximity sensors (not shown) may be employed to detect the position of the sheet 12 being processed as it travels along the transport surface 5. The proximity sensors may be used to control pivotal movement of the cartridge 50 between the idle position and the adhesive application position, as desired. Such sensors and the operation thereof are well known in the art.

It will also be appreciated that one or more lateral and/or longitudinal cutting means may be positioned adjacent to, or in association with, the cartridge 50 to cut the sheet 12 into desired dimensions.

Figure 30:
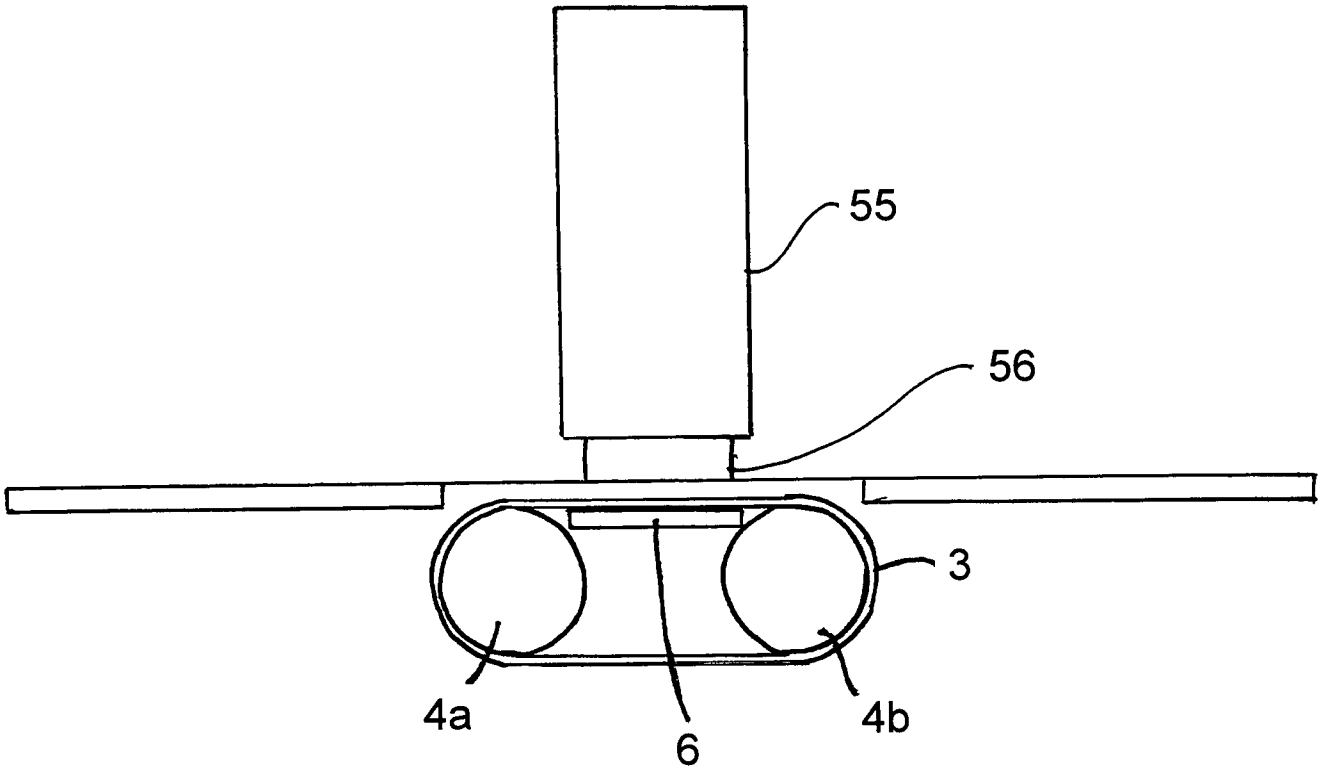
FIG. 30 is an enlarged view of an alternative arrangement for the adhesive applicator cartridge of FIG. 25 to apply adhesive to a sheet.

An alternative embodiment of the arrangement of FIGS. 29*a*, 29*b* is shown in FIG. 30. In this arrangement, each of the advancement rollers 4*a*; 4*b* are connected by belt 3 to aid in the advancement of the sheet 12 past the stick of adhesive 56. A plate 6 is located between rollers 4*a* and 4*b* to provide a surface against which the stick of adhesive 56 can act to facilitate the deposition of adhesive onto the surface of sheet 12.

Figure 26:
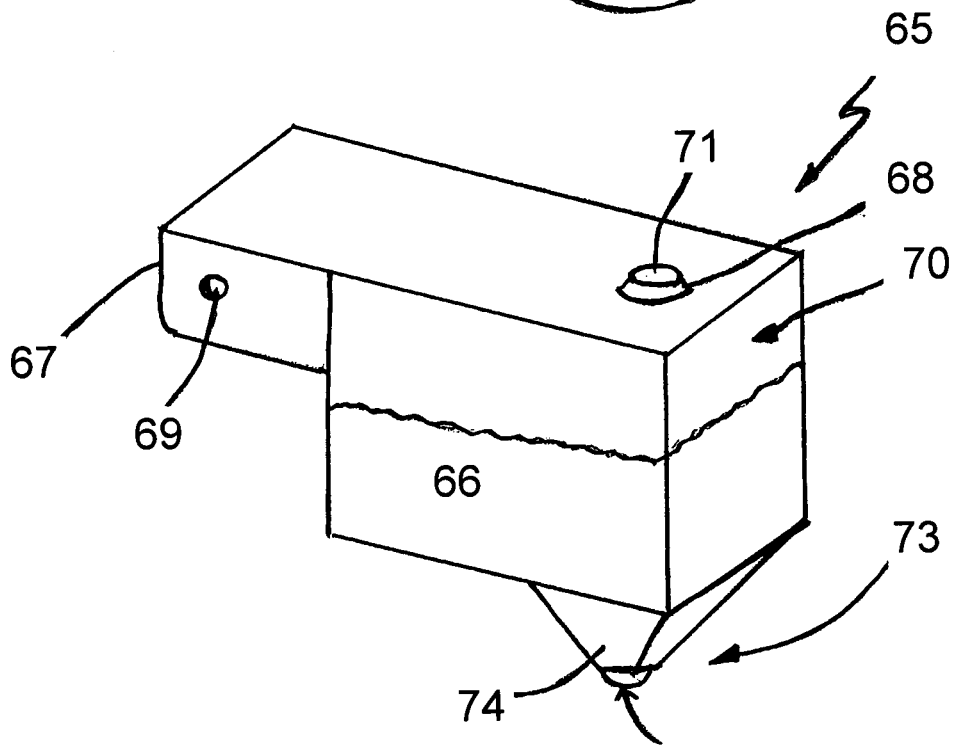
FIG. 26 is a perspective view or an adhesive applicator cartridge according to an alternative embodiment of the present invention.

Referring to FIG. 26, an alternative embodiment of an adhesive applicator cartridge 65 is shown. The cartridge 65 comprises a body 67 that is shaped to be received within a suitable recess formed in the device 10. The body 67 has a recess or pivot point 69 formed therein to define a point about which the body 67 is able to pivot during use. The pivot point 6.9 may be in the form of a recess or indentation formed the body 67 that receives a pin or lug (not shown) provided on the device 10 when the body 67 is mounted thereto. Alternatively, the pivot point 69 may be a lug provided to extend from the surface of the body 67 to be received within a corresponding recess provided in the device 10 when the body 67 is mounted thereto.

The body 67 is in the form of a hollow receptacle having a storage reservoir 70 for storing a volume of liquid adhesive 66. The reservoir 70 is accessible by way of an inlet 68 to facilitate filling thereof. The inlet 68 is sealed by a cap 71 which can be removed to facilitate refilling of the reservoir when required.

An applicator 73 is mounted at a lower end of the body 67 so as to be in fluid communication with the liquid adhesive 66 contained within reservoir 70. The applicator 73 comprises a ball or roller member 72 secured within an outlet chamber 74 of the reservoir 70 such that it is free to roll therein. The ball or roller member 72 projects at least partially from the chamber 74 to apply adhesive 66 to a surface of a passing sheet, in the manner as described below.

Figure 31:
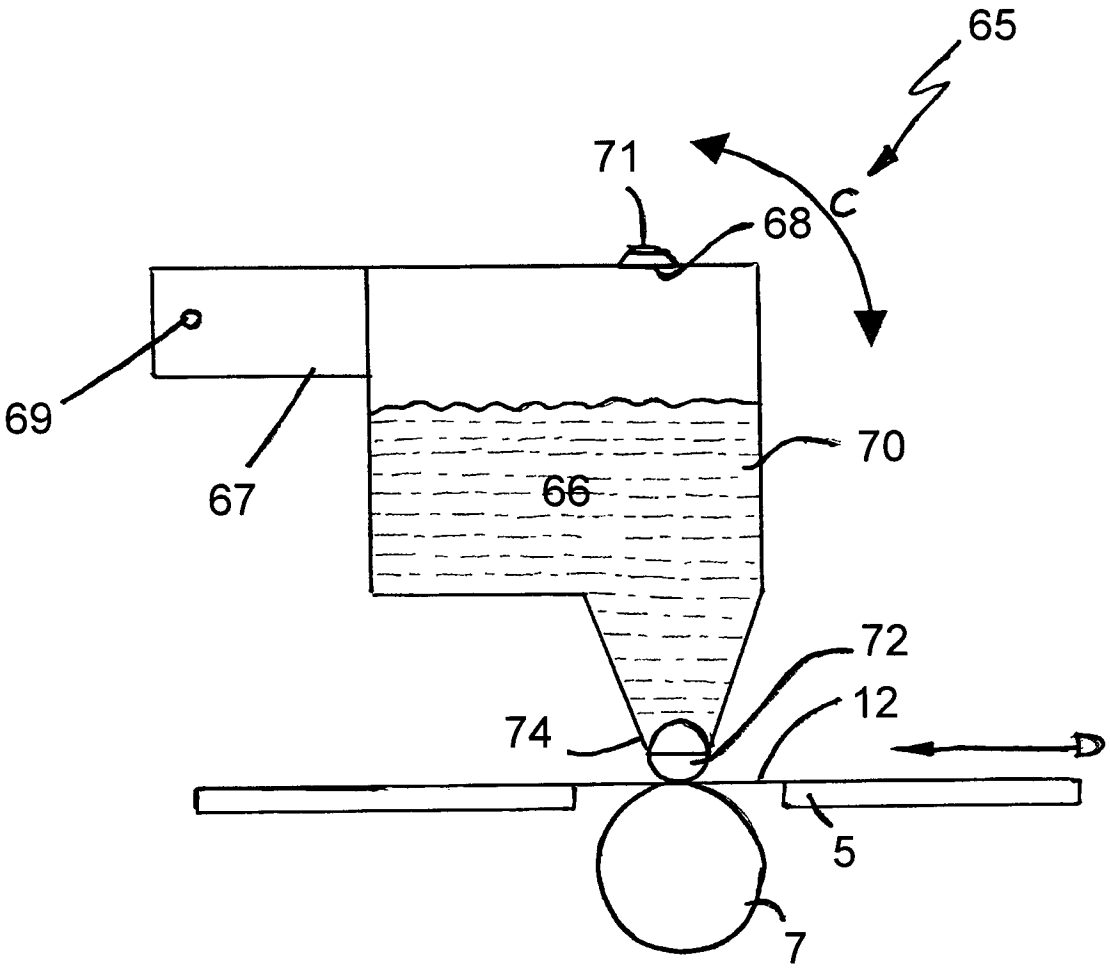
FIG. 31 is a side view of the adhesive applicator cartridge of FIG. 26 in an operating position during use.

The adhesive applicator cartridge 65 is shown in use in FIG. 31. The cartridge 65 is mountable to the device 10 such that it is free to pivot about pivot point 69 in the direction of arrow C. It will be appreciated that when the cartridge 65 is in an idle position, the body 67 is pivoted away from the transport surface 5 such that the ball or roller 72 is positioned remote therefrom.

A sheet 12 is advanced towards the cartridge 65 in the direction of arrow D. Upon detection of the sheet 12 being adjacent advancement roller 7, the cartridge 65 is pivoted into an application position, as shown in FIG. 31. In the application position, the ball or roller 72 acts against the surface of the sheet 12, preferably adjacent an edge of the sheet 12, such that the sheet 12 is sandwiched between the ball or roller 72 and the advancement roller 7. Rotational movement of advancement roller 7 is transferred to the ball or roller 72 of the cartridge 67, thereby applying adhesive to the surface of the sheet 12 as it travels therebetween.

Upon detection of the sheet 12 passing beyond the ball or roller 72, the cartridge 65 is to then pivoted to the idle position such that another sheet 12 can be advanced for application of the adhesive thereto.

It will be appreciated that as the liquid adhesive 66 is applied to the sheets 12, the volume of liquid adhesive 66 present therein will become depleted. Upon detection of the volume of the liquid adhesive reaching a critical level, a sensor may provide an indication to the device 10 to warn the user to replace and/or replenish the cartridge 65.

Figure 27:
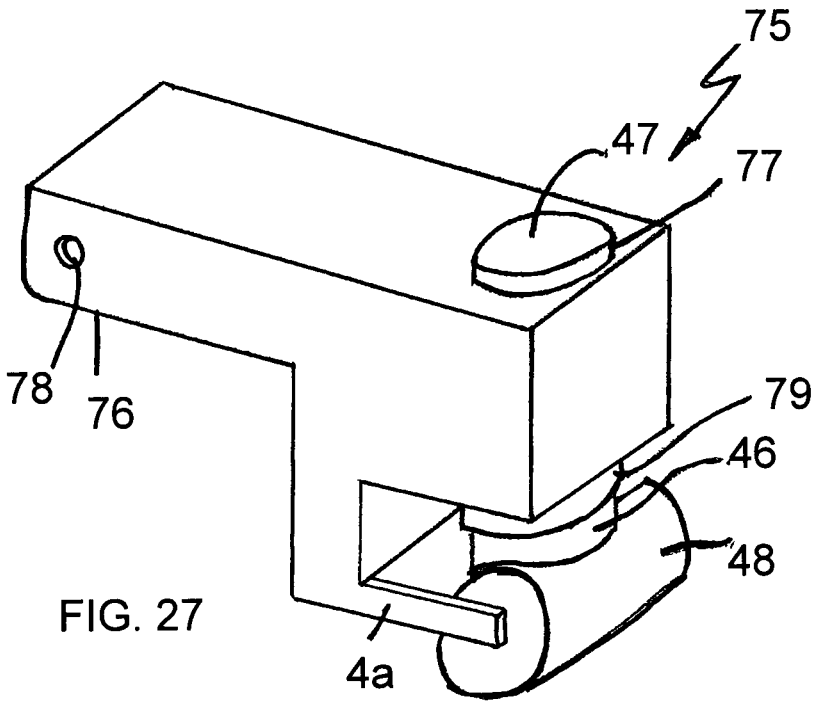
FIG. 27 is a perspective view of an adhesive applicator cartridge according to yet another embodiment of the present invention.

Referring to FIG. 27, yet another embodiment of an adhesive applicator cartridge 75 is shown. In this embodiment the cartridge 75 comprises a body 76 that is shaped to be received in a suitable recess formed in the device 10. The body 76 has a pivot point 78 formed therein, to define a point about which the body 76 is able to pivot dining use. The pivot point 78 may be in the form of a recess or indentation formed in the body 76 that receives a pin or lug (not shown) provided on the device 10 when the body 76 is mounted thereto. Alternatively, the pivot point 78 may be a lug provided to extend from the surface of the body 76 to be received within a corresponding recess provided in the device 10 when the body 76 is mounted thereto.

The body 76 has a central bore 77 having a cylinder 79 secured therein. An adhesive 46, in the form of a stick, is shaped to be inserted within the cylinder 79. A cap 47 may be provided on an end of the cylinder 79 to seal an end of the stick of adhesive 46. The stick of adhesive 46 is received within the cylinder 79 such that an end of the adhesive 46 projects onto a roller applicator 48 that is rotatably secured between a pair of arms 49 that extend from the body 76.

In this arrangement, the stick of adhesive 46 applies adhesive directly onto the roller applicator 48, as the roller applicator 48 rotates about its central axis. A control mechanism (not shown) may be provided on the body 76 to control the advancement of the stick of adhesive 46 within the cylinder 79. Such a control mechanism ensures that the stick of adhesive 46 is in constant contact with a surface of the roller applicator 48 as it is being consumed during use.

Figure 32:
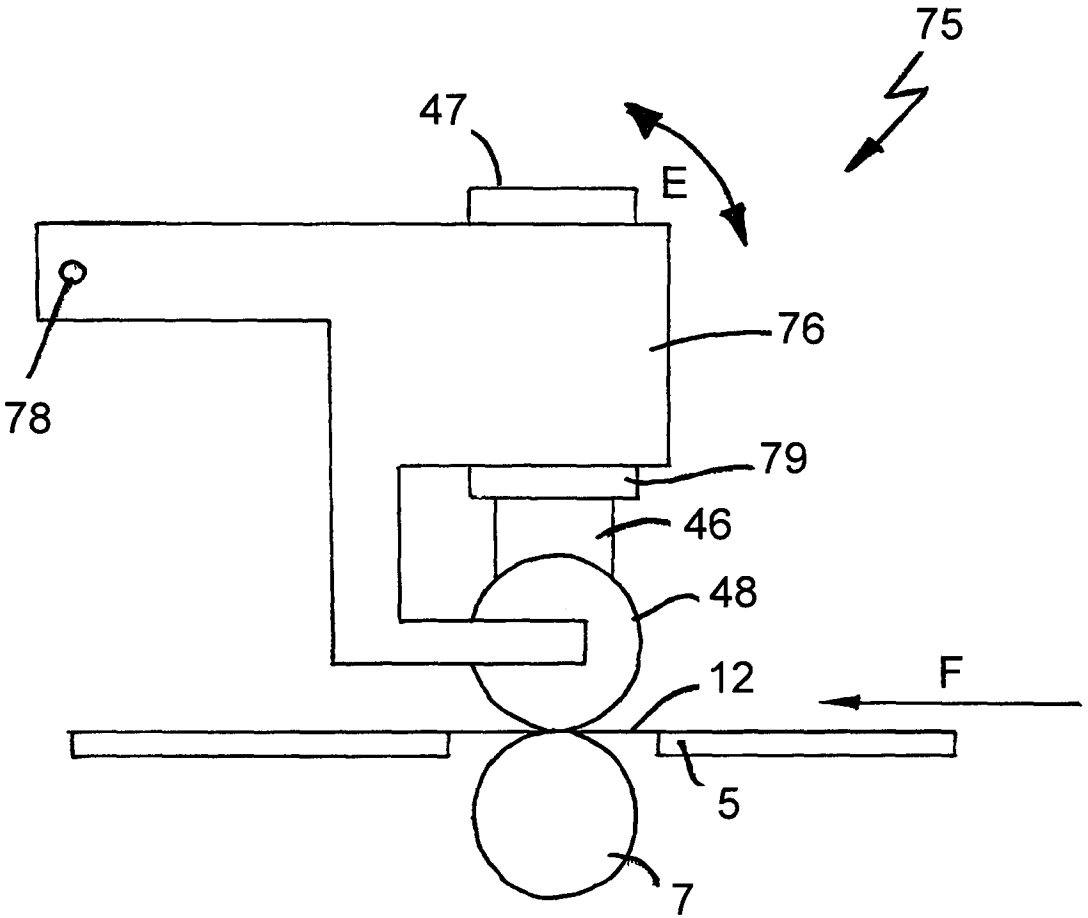
FIG. 32 is a side view of the adhesive applicator cartridge of FIG. 27 in an operating position during use.

The adhesive applicator 75 is shown in use in FIG. 32. The cartridge 75 is mounted within a recess provided in the device 10, such that it is free to pivot about pivot point 78 in the direction of arrow F. It will be appreciated that when cartridge 75 is in an idle position, the body 76 is pivoted away from the transport surface 5 such that the roller applicator 48 is located remote therefrom.

A sheet 12 is advanced toward the cartridge 75 in the direction of arrow F. Upon detection of the sheet 12 being adjacent the advancement roller 7, the cartridge 75 is pivoted into an application position as shown in FIG. 32. In the application position, the sheet 12 is located between the roller applicator 48 and the advancement roller 7 such that the roller applicator 48 is able to apply adhesive along an edge surface of the sheet 12 as the sheet advances. Rotational movement of advancement roller 7 is transferred to the roller applicator 48 of the cartridge 76 thereby ensuring that a continuous trail of adhesive is applied to the surface of the sheet 12.

Following detection of the sheet 12 passing beyond the roller applicator 48, the cartridge 75 is pivoted to the idle position such that another sheet 12 can be advanced for application of the adhesive thereto.

Figure 28:
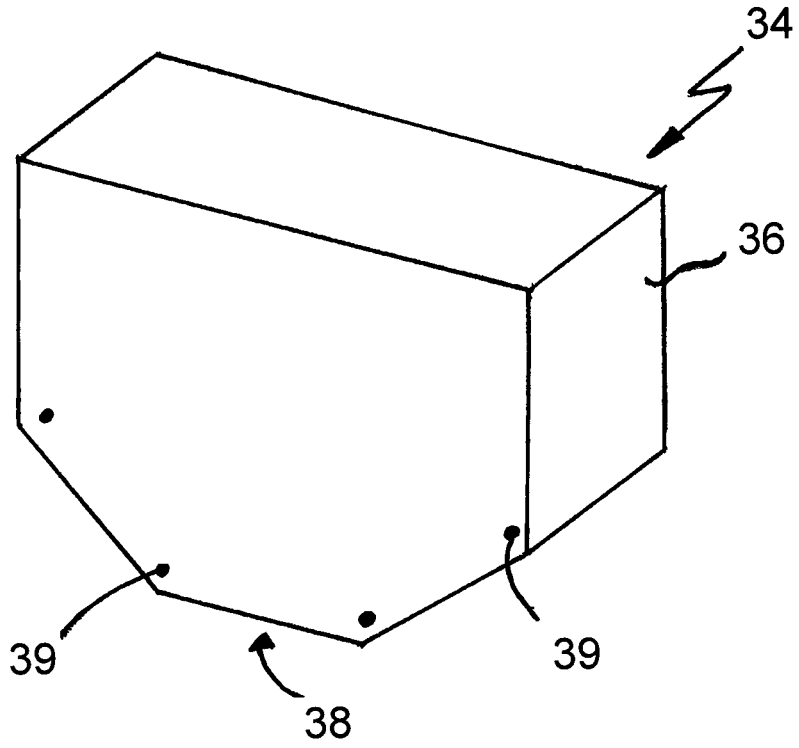
FIG. 28 is a perspective view of an adhesive applicator cartridge according to still yet another alternative embodiment of the present invention.
Figure 33:
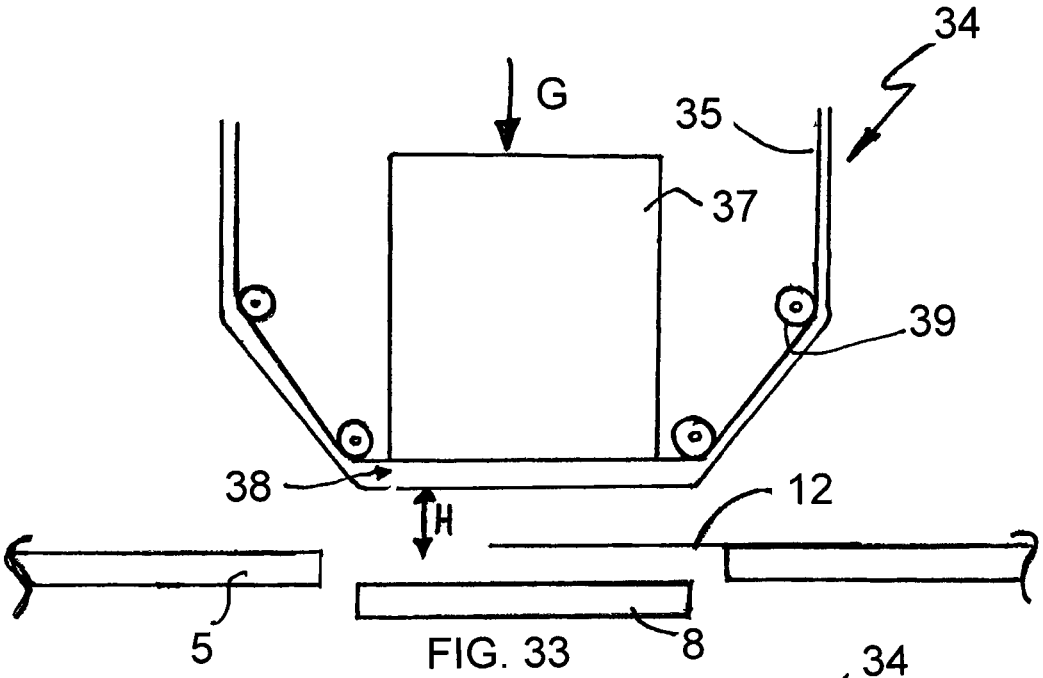
FIG. 33 is a cross-sectional side view of the adhesive applicator cartridge of FIG. 28 during use.
Figure 34:
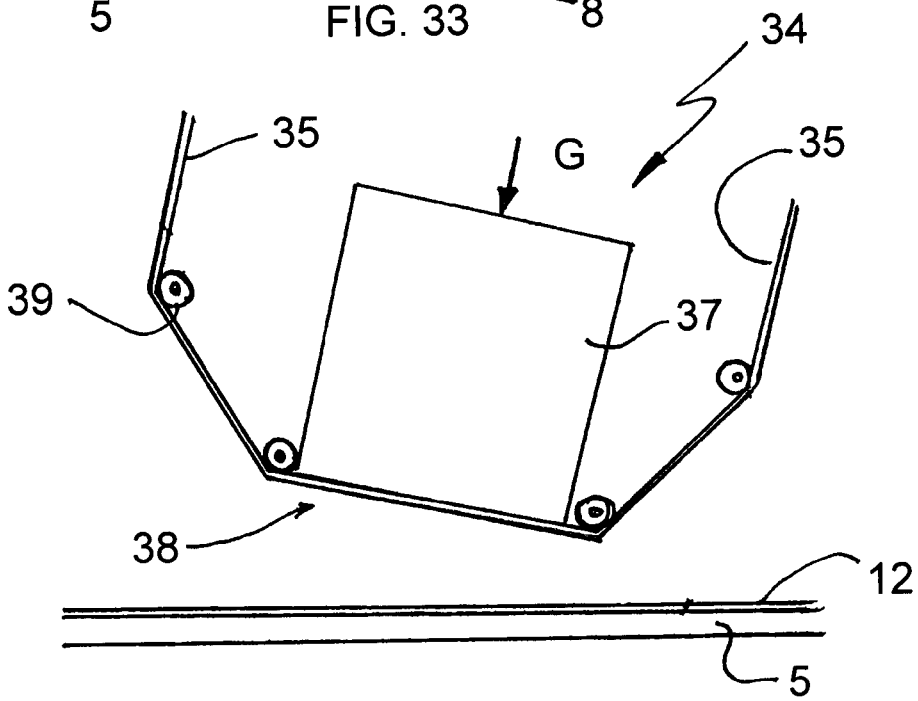
FIG. 34 is a cross-sectional side view of an alternative arrangement of the adhesive applicator cartridge of FIG. 28 during use.

Referring to FIG. 28, yet another embodiment of an adhesive applicator cartridge 34 is shown. Once again, the cartridge 34 comprises a body 36 that is shaped to be received within a suitable recess formed in the device 10. The body 36 houses an adhesive tape 35 that is wound around the internal perimeter of the body 36 hi the manner as shown in FIGS. 33 and 34. The body 36 also houses a moveable stamp applicator 37 that is moveable within the body 36 to apply force against an inner surface of the adhesive tape 35 such that the adhesive contained on the outer surface of the adhesive tape can be applied to a surface of a passing sheet 12. The body 36 has an open end portion 38 through which the stamp applicator 37 and adhesive tape 35 can extend under application of a force G to the stamp applicator 37.

Referring to FIG. 33, the body 36 of the adhesive applicator cartridge 34 is fixed in position to provide a gap of constant width 11 between the transport surface 5 and the cartridge 34. Upon detection of a sheet 12 adjacent the open end 38 of the cartridge 34, the stamp applicator 37 is caused to move in the direction of arrow (3, such that it projects beyond the open end 38. Such movement of the stamp applicator 53 applies a force against the inner sleaze of the adhesive tape 35, causing the adhesive tape to project beyond the open end 38. The stamp applicator 53 and the tape 35 apply a force to the surface of the sheet 12 thereby pressing the sheet against the plate 8 provided below the open end 38 of the body 36. This pressing force causes the adhesive present do the outer surface of the adhesive tape 35 to be transferred to the surface of the sheet 12 in the form of a strip of adhesive. The sheet 12 is then able to be transported for collation and pressing into a pad 15.

A plurality of winding rollers 39 are mounted within the body 36 to progress the adhesive tape 35 as it is being consumed during the application process. The consumed tape is collected on a roll which can be monitored to provide a signal to the user of the device 10 that the cartridge 34 requires placement.

An alternative embodiment of adhesive applicator cartridge 34 is shown in FIG. 34. In this embodiment, the cartridge 34 operates in substantially the same manner as described above in relation to FIG. 33. However, the cartridge 34 is mounted on an angle with respect to the transport surface 5 and is moveable in a rocking motion so as to roll across the surface of the sheet 12 to apply the adhesive tape thereto.

The various embodiments of the adhesive applicator cartridge described above provide for a simple and effective means for applying adhesive to one or more sheets of paper or the like for binding the sheets together. The cartridges enable an automated means for applying adhesive and provides a simple means for refilling or replacing the cartridges where required.

It will be appreciated by those skilled in the art that many modifications and variations may be made to the methods of the invention described herein without departing from the spirit and scope of the invention.

The claims defining the invention:

1. A pad forming device for forming a pad from a plurality of individual sheets of material, the device comprising:

a body defining a space within which the device is contained;

a feeder mounted to said body for receiving one or more of said plurality of individual sheets of material and feeding said individual sheets into said body;

a cutter provided within said body to cut each individual sheet fed from the feeder to predetermined dimensions;

an adhesive applicator provided within said body to apply an adhesive to a portion or portions of each sheet cut from cutter;

a stacker provided within the body to arrange each sheet wherein the adhesive have been applied in one or more stacks;

a former unit provided within the body to form the on or more stack of sheets together to form on or more said pads;

a collector mounted to said body for receiving the one or more formed pad for collection;

and one or more transport mechanisms provided within the body to transport the individual sheets and subsequent formed pad within said space in a continuous path between the feeder and the collector.

2. A pad forming device according to claim 1, wherein said device is of a size that is less than 1.2 $m^3$ in volume and/or has a foot print that is less than 1.2 $m^2$.

3. A pad forming device according to claim 1, wherein the device is incorporated into a piece of office equipment, wherein the piece of office equipment comprises a printer, photocopier, scanner, fax machine, or multifunction device.

4. A pad forming device according to claim 1, wherein the feeder comprises an inlet formed in the body through which the plurality of individual sheets are received.

5. A pad forming device according to claim 4, wherein one or more driven rollers are provided with the feeder to feed said individual sheets into said body.

6. A pad forming device according to claim 1, wherein the cutter is mounted within the body to define a cutting zone through which the fed sheets pass.

7. A pad forming device according to claim 6, wherein the cutter comprises one or more blades positioned to cut the fed sheets as they pass through the cutting zone.

8. A pad forming device according to claim 1, wherein the adhesive applicator is mounted within the body to apply a layer, strip or band of adhesive material to a portion or portions of each fed sheet.

9. A pad forming device according to claim 8, wherein the layer, strip or band of adhesive material is applied to at least a portion of a first side of each fed sheet.

10. A pad forming device according to claim 9, wherein the layer, strip or band of adhesive material is applied along an edge of the first side of each sheet.

11. A pad forming device according to claim 10, wherein the adhesive applicator includes a reciprocating stamp member in communication with the adhesive material to apply the layer of adhesive material along the edge of the first side of each sheet.

12. A pad forming device according to claim 10, wherein the adhesive applicator includes a roller member in communication with the adhesive material to apply the layer, strip or band of adhesive material along the edge of the first side of each sheet.

13. A pad forming device according to claim 8, wherein the adhesive applicator includes an adhesive storage vessel to store said adhesive material for application to each fed sheet.

14. A pad forming device according to claim 13, wherein the adhesive applicator is removable from the body.

15. A pad forming device according to claim 9, wherein the stacker collects said fed sheets and orientates said sheets in a stack such that first side of each sheet is in contact with a reverse side of an adjacent sheet.

16. A pad forming device according to claim 15, wherein the former unit comprises a press to apply a pressing force to the stack of sheets such that the adjacent sheets adhere to each other in the region along the layer, strip or band of adhesive material to form said notepad.

17. A pad forming device according to claim 16, wherein the collector comprises an output tray attached to said body upon which the formed pad is received.

18. A pad forming device according to claim 1, wherein one or more transport mechanisms are provided within the body to transport the individual sheets and subsequent formed pad therethrough.

19. A pad forming device according to claim 18, further comprising a controller for controlling and co-ordinating the operation of any one or more of the feeder, cutter, adhesive applicator, stacker, former unit and one or more transport mechanisms such that the pad is formed within the body.

* * * * *